US010750866B2

(12) United States Patent
Grupenhof

(10) Patent No.: US 10,750,866 B2
(45) Date of Patent: Aug. 25, 2020

(54) DISPLAY UNIT WITH BUILT-IN SHELVING SUPPORTS

(71) Applicant: InnerWorkings, Inc., Chicago, IL (US)

(72) Inventor: Austin G. Grupenhof, Hamilton, OH (US)

(73) Assignee: INNERWORKINGS, INC., Chicago, IL (US)

( * ) Notice: Subject to any disclaimer, the term of this patent is extended or adjusted under 35 U.S.C. 154(b) by 0 days.

(21) Appl. No.: 15/849,604

(22) Filed: Dec. 20, 2017

(65) Prior Publication Data

US 2018/0192774 A1 Jul. 12, 2018

Related U.S. Application Data

(60) Provisional application No. 62/437,025, filed on Dec. 20, 2016.

(51) Int. Cl.

| | |
|---|---|
| ***A47B 96/02*** | (2006.01) |
| ***A47B 57/54*** | (2006.01) |
| ***A47B 57/26*** | (2006.01) |
| ***A47B 57/04*** | (2006.01) |
| ***A47F 5/11*** | (2006.01) |

(52) U.S. Cl.

CPC ..... *A47B 96/024* (2013.01); *A47B 57/04* (2013.01); *A47B 57/265* (2013.01); *A47B 57/54* (2013.01); *A47F 5/116* (2013.01); *A47B 2220/0086* (2013.01)

(58) Field of Classification Search

CPC .... A47F 5/116; A47F 5/10; A47B 2220/0086; A47B 2220/0083; A47B 96/024; A47B 57/54; A47B 57/265; A47B 57/04

USPC ..... 211/135, 72, 73, 149, 85, 195; 229/120.03, 120.14, 120.32, 121; 108/165, 157.14, 51.3; 206/750, 175, 206/299, 784, 600; 248/174, 346.3

See application file for complete search history.

(56) References Cited

U.S. PATENT DOCUMENTS

D38,720 S 8/1907 Soellner et al.
1,448,138 A * 3/1923 List ..... B65D 5/5266 206/740

(Continued)

OTHER PUBLICATIONS

Grupenhof, Quayle Office Action, U.S. Appl. No. 29/588,435, Aug. 23, 2017, 4 pgs.

(Continued)

*Primary Examiner* — Jonathan Liu
*Assistant Examiner* — Devin K Barnett
(74) *Attorney, Agent, or Firm* — Morgan, Lewis & Bockius LLP

(57) ABSTRACT

Disclosed herein are various embodiments of a display unit with built-in, hollow vertical supports that are formed out of a single sheet of material. As one example, a display unit having a plurality of built-in, hollow vertical supports for supporting one or more shelves is provided. The display unit includes: a first single sheet of material folded into: (i) a plurality of vertical panels; and (ii) a first set of built-in, hollow vertical supports of the plurality of built-in, hollow vertical supports, wherein each built-in, hollow vertical support contacts one or more of the plurality of vertical panels; and a first shelf of the one or more shelves disposed within the frame and supported by each built-in, hollow vertical support of the first set of built-in, hollow vertical supports.

21 Claims, 57 Drawing Sheets

(56) References Cited

U.S. PATENT DOCUMENTS

RE18,639 E * 11/1932 Levine ..... B65D 85/325 206/521.1
2,129,488 A * 9/1938 Bomberger ..... B65D 65/403 206/145
D111,736 S 10/1938 De Sabato et al.
2,132,785 A * 10/1938 Hill ..... A47F 5/116 108/165
2,150,743 A * 3/1939 Mancuso ..... G09F 5/00 211/135
2,527,702 A * 10/1950 Buttery ..... B65D 5/4802 229/120.14
2,706,066 A * 4/1955 Wells ..... A47F 1/08 221/130
3,036,753 A * 5/1962 Davis ..... B65D 5/08 206/509
3,175,751 A * 3/1965 Burgess ..... B65D 5/4802 229/120.14
3,219,254 A * 11/1965 Hall ..... B65D 85/327 206/521.15
D208,340 S 8/1967 Pollenz et al.
3,372,813 A * 3/1968 Ishida ..... A47F 5/116 211/135
3,647,133 A * 3/1972 Christensson ..... B65D 5/12 229/125.17
3,656,611 A * 4/1972 Mertz ..... B65D 5/48024 206/764
D232,204 S 7/1974 Kaner et al.
3,834,324 A * 9/1974 Lang ..... A47B 87/0246 108/91
3,834,608 A * 9/1974 Giebel ..... B65D 5/48034 229/120.14
D233,388 S 10/1974 Moss
3,877,396 A * 4/1975 Patterson ..... A47B 47/06 108/183
RE28,530 E * 8/1975 D'Alessio ..... B65D 5/5016 206/459.5
4,182,244 A * 1/1980 Hutchins, Jr. ..... A47B 47/06 108/53.1
D256,644 S 9/1980 Marks
D259,684 S 6/1981 Davis
4,292,901 A * 10/1981 Cox ..... B65D 71/0096 108/55.1
4,300,691 A * 11/1981 Shemtov ..... B65D 5/48024 206/782
D279,442 S 7/1985 Silver
4,601,390 A * 7/1986 Rosenthal ..... B65D 71/0022 206/175
4,618,115 A * 10/1986 Belokin, Jr. ..... A47F 5/116 211/135
4,630,740 A * 12/1986 Belokin, Jr. ..... A47F 5/116 211/194
4,678,088 A * 7/1987 Flum ..... A47F 5/116 211/132.1
D294,441 S 3/1988 Hoch
D296,737 S 7/1988 Bezzerides et al.
4,793,267 A * 12/1988 Birillo ..... A47B 5/00 108/108
4,809,847 A * 3/1989 Schneider ..... B65D 5/16 206/45.28
4,854,246 A * 8/1989 Belokin ..... A47F 5/116 108/162
D307,839 S 5/1990 Johnson, Jr.
4,942,830 A * 7/1990 Macaluso ..... A47B 43/02 108/162
D314,296 S 2/1991 Mason
5,042,651 A * 8/1991 Davis ..... A47B 43/02 206/459.5
5,048,701 A 9/1991 Simpson
D323,262 S 1/1992 Flum
5,183,166 A * 2/1993 Belokin, Jr. ..... A47F 5/116 211/130.1
5,190,211 A * 3/1993 Stoddard ..... A47F 5/116 211/135
5,213,220 A * 5/1993 McBride ..... A47B 43/00 211/126.16
5,221,013 A * 6/1993 Santucci ..... A47B 45/00 211/153
D340,369 S 10/1993 Dokoupil et al.
5,277,310 A * 1/1994 Mertz ..... B65D 5/5028 206/320
D344,419 S 2/1994 Stoddart
5,315,936 A * 5/1994 Smith ..... A47F 5/116 108/165
5,318,219 A * 6/1994 Smith ..... B65D 19/06 206/386
D359,180 S * 6/1995 Bedney ..... D30/161
5,465,851 A * 11/1995 Smith ..... A47F 5/0807 108/162
5,531,327 A * 7/1996 Darby ..... B65D 19/18 108/53.5
5,632,390 A * 5/1997 Podergois ..... A47F 5/116 211/149
D383,332 S 9/1997 Schneider
D385,438 S 10/1997 Jay
D390,723 S 2/1998 Jay
D396,581 S 8/1998 Schubert
5,865,316 A * 2/1999 Smith ..... A47F 5/112 206/503
5,927,647 A * 7/1999 Masters ..... F02K 1/72 239/265.19
D418,331 S 1/2000 Christescu
D421,350 S 3/2000 Bidwell et al.
D421,687 S 3/2000 Curci
6,126,254 A * 10/2000 Maglione ..... A47B 43/02 248/174
D438,729 S 3/2001 Sikora
6,267,255 B1 * 7/2001 Brush ..... A47F 5/112 206/386
6,305,597 B1 * 10/2001 Donegan ..... B65D 5/4204 206/806
D450,488 S 11/2001 Stone et al.
D452,393 S 12/2001 Bedard
D456,176 S 4/2002 Dashefsky
6,372,322 B1 * 4/2002 Devaguptapu ..... B32B 3/12 156/197
D474,351 S 5/2003 Lyons
D477,158 S 7/2003 Calcerano et al.
D483,201 S 12/2003 Berish et al.
D487,549 S 3/2004 Berish et al.
6,752,281 B1 * 6/2004 Mason ..... A47F 5/0018 211/131.1
D496,193 S 9/2004 Mason
D496,194 S 9/2004 Mason
D500,810 S 1/2005 Osigwe et al.
7,066,342 B2 * 6/2006 Baechle ..... B65D 5/006 206/600
D530,290 S 10/2006 Dupuis
7,131,543 B2 11/2006 Mason
D537,652 S 3/2007 MacDonald
7,252,200 B1 * 8/2007 Hester ..... A47F 5/116 211/126.16
D602,710 S 10/2009 Thurston
7,677,433 B2 * 3/2010 Little ..... B65D 5/526 206/744
7,703,864 B2 * 4/2010 Moser ..... B65D 5/5213 206/747
D629,232 S 12/2010 Forcellina
7,905,365 B2 * 3/2011 Virvo ..... A47F 5/116 211/73
D657,590 S * 4/2012 Looser ..... D6/675.1
8,210,358 B2 * 7/2012 Haddad ..... A47F 5/10 206/600
8,286,809 B2 * 10/2012 Mestres Armengol ..... A47F 5/116 211/135
D675,040 S 1/2013 Koenigsknecht et al.
D684,795 S 6/2013 Koenigsknecht et al.
D690,139 S 9/2013 Trinh et al.

(56) References Cited

U.S. PATENT DOCUMENTS

D691,838 S 10/2013 Hinkle
8,627,585 B2 * 1/2014 Herman Baran ..... A47F 5/112 108/162
8,763,941 B1 7/2014 Beck, Jr.
D712,689 S 9/2014 Montagner
8,833,573 B2 * 9/2014 Tomaszewski ..... B65D 19/385 108/186
D731,823 S 6/2015 Kelinske et al.
D734,068 S 7/2015 Dworman
D737,078 S 8/2015 McKinney
9,138,079 B2 * 9/2015 Su ..... A47F 5/11
D745,298 S 12/2015 Workman et al.
9,215,940 B2 12/2015 Kawkins
D747,902 S 1/2016 Matloff
D748,934 S 2/2016 Arrington-Brown
D768,278 S 10/2016 Kumar
D775,871 S 1/2017 Volz et al.
D777,489 S 1/2017 Stauss
D784,055 S 4/2017 Arzaluz
9,743,783 B1 * 8/2017 Bersamin ..... A47F 5/116
D796,235 S 9/2017 Morrell
D797,477 S 9/2017 Horsky et al.
D809,832 S * 2/2018 Grupenhof ..... D6/675.1
9,918,569 B1 * 3/2018 Abel ..... A47F 5/112
D825,231 S 8/2018 Massaud
D825,232 S 8/2018 Massaud
D832,008 S * 10/2018 Grupenhof ..... D6/674
D842,629 S * 3/2019 Grupenhof ..... D6/675.1
10,329,048 B2 * 6/2019 Nelson ..... B65D 5/20
D852,556 S * 7/2019 Grupenhof ..... D6/675.1
10,343,815 B2 * 7/2019 Brendlinger ..... B65D 19/38
2004/0148833 A1 * 8/2004 Virvo ..... G09F 15/0068 40/610
2004/0149815 A1 * 8/2004 Holdsworth ..... B65D 5/0035 229/164
2005/0067321 A1 * 3/2005 Pitts ..... A47F 5/116 206/736
2005/0224435 A1 * 10/2005 Alter ..... A47B 47/028 211/153
2006/0070911 A1 * 4/2006 Lowry ..... B65D 5/52 206/736
2006/0118502 A1 6/2006 Polvere et al.
2006/0260979 A1 * 11/2006 Lutes ..... A47F 5/116 206/768
2007/0000857 A1 * 1/2007 Roth ..... A47B 43/02 211/195
2007/0017843 A1 * 1/2007 Keel ..... B65D 5/0025 206/509
2007/0193479 A1 * 8/2007 Slaats ..... A47F 5/0018 108/53.1
2008/0053940 A1 * 3/2008 Whalen ..... A47B 47/045 211/134
2008/0169340 A1 * 7/2008 Sheffer ..... A47F 5/116 229/120.32
2008/0173602 A1 * 7/2008 Field ..... A47F 5/116 211/149
2008/0237169 A1 * 10/2008 May ..... A47B 23/00 211/195
2008/0265726 A1 * 10/2008 Sheffer ..... A47B 47/06 312/259
2008/0314849 A1 * 12/2008 Duchatellier ..... A47F 3/142 211/86.01
2009/0032432 A1 * 2/2009 Kostos ..... B65D 5/006 206/600
2009/0050589 A1 * 2/2009 Pedler ..... A47B 43/00 211/85.8
2010/0006527 A1 * 1/2010 Kalwat ..... A47F 5/116 211/135
2010/0006529 A1 * 1/2010 Groff ..... A47F 5/116 211/186
2010/0181443 A1 * 7/2010 Bojie ..... A47F 5/112 108/162
2011/0049072 A1 * 3/2011 Dewhurst ..... A47F 5/116 211/135
2011/0308993 A1 * 12/2011 Hill ..... B65D 19/20 206/600
2013/0026060 A1 * 1/2013 Moss ..... B65D 5/0035 206/512
2013/0213915 A1 * 8/2013 Pfeifer ..... A47F 5/11 211/135
2014/0054197 A1 * 2/2014 Buhagiar ..... B65D 5/52 206/756
2014/0318997 A1 * 10/2014 Marini ..... B65D 5/20 206/299
2015/0096921 A1 * 4/2015 Hyatt ..... B65D 5/001 206/762
2015/0108037 A1 * 4/2015 Evans ..... B65D 19/18 206/600
2015/0144525 A1 * 5/2015 Luke ..... A47F 5/116 206/764
2015/0305521 A1 * 10/2015 Volz ..... A47F 5/118 211/135
2016/0015172 A1 * 1/2016 Zelek ..... A47F 5/10 211/149
2016/0015174 A1 * 1/2016 Guizzardi ..... A47B 87/0223 211/186
2016/0023798 A1 * 1/2016 James ..... B65D 5/5021 206/763
2016/0066711 A1 * 3/2016 Mestres Armengol ..... A47F 5/116 211/135
2016/0198870 A1 * 7/2016 Volz ..... A47F 5/116 211/135
2016/0278545 A1 * 9/2016 Fernandez ..... A47B 47/06
2017/0020286 A1 * 1/2017 Pierson ..... A47B 96/021
2017/0079449 A1 * 3/2017 Smith ..... A47F 5/116
2017/0231404 A1 * 8/2017 Pratsch, Jr. ..... A47B 43/02 211/135
2017/0238727 A1 * 8/2017 Ertl ..... B65D 5/5226
2017/0245661 A1 * 8/2017 Heuer ..... A47B 43/00
2018/0042405 A1 * 2/2018 Lilja ..... A47B 43/02
2018/0146803 A1 * 5/2018 Urban ..... A47F 5/116
2018/0160825 A1 * 6/2018 Abel ..... A47F 5/116
2018/0235383 A1 * 8/2018 Josey ..... A47F 10/02
2018/0289178 A1 * 10/2018 McMillan-Sweat .... A47F 5/116
2018/0293919 A1 * 10/2018 Ertl ..... G09F 7/18
2019/0008275 A1 * 1/2019 Sosna ..... B65D 21/0233
2019/0008290 A1 * 1/2019 Ertl ..... A47F 5/116
2019/0014927 A1 * 1/2019 Nixon ..... A47F 5/116
2019/0090663 A1 * 3/2019 Donegan ..... A47F 5/116
2019/0116994 A1 * 4/2019 Mertz, II ..... A47F 5/114

OTHER PUBLICATIONS

Grupenhof, Notice of Allowance, U.S. Appl. No. 29/588,435, dated Feb. 26, 2018, 5 pgs.
Grupenhof, Notice of Allowance, U.S. Appl. No. 29/588,432, dated Oct. 6, 2017, 7 pgs.
Grupenhof, Office Action, U.S. Appl. No. 29/588,438, dated Sep. 25, 2017, 7 pgs.
Grupenhof, Notice of Allowance, U.S. Appl. No. 29/588,438, dated Mar. 19, 2018, 7 pgs.
Grupenhof, Office Action, U.S. Appl. No. 29/588,440, dated Sep. 22, 2017, 5 pgs.
Grupenhof, Notice of Allowance, U.S. Appl. No. 29/588,440, dated May 14, 2018, 8 pgs.
Grupenhof, Notice of Allowance, U.S. Appl. No. 29/588,436, dated Oct. 10, 2017, 7 pgs.
Grupenhof, Notice of Allowance, U.S. Appl. No. 29/588,433, dated Oct. 11, 2017, 7 pgs.
Grupenhof, Office Action, U.S. Appl. No. 29/588,441, dated Oct. 31, 2017, 5 pgs.
Grupenhof, Final Office Action, U.S. Appl. No. 29/588,441, dated Mar. 9, 2018, 4 pgs.
Grupenhof, Notice of Allowance, U.S. Appl. No. 29/588,441, dated Mar. 22, 2019, 5 pgs.

(56) References Cited

OTHER PUBLICATIONS

Grupenhof, Notice of Allowance, U.S. Appl. No. 29/588,442, dated Oct. 10, 2017, 8 pgs.
Grupenhof, Notice of Allowance, U.S. Appl. No. 29/588,444, dated Oct. 10, 2017, 7 pgs.
Grupenhof, Office Action, U.S. Appl. No. 29/588,443, dated Oct. 19, 2017, 5 pgs.
Grupenhof, Notice of Allowance, U.S. Appl. No. 29/588,443, dated Apr. 13, 2018, 5 pgs.
Grupenhof, Office Action, U.S. Appl. No. 29/639,482, dated Oct. 18, 2018, 6 pgs.
Grupenhof, Final Office Action, U.S. Appl. No. 29/639,482, dated Feb. 26, 2019, 5 pgs.
Grupenhof, Notice of Allowance, U.S. Appl. No. 29/639,483, dated Oct. 30, 2018, 8 pgs.
Grupenhof, Office Action, U.S. Appl. No. 29/637,085, Oct. 19, 2018, 6 pgs.
Grupenhof, Notice of Allowance, U.S. Appl. No. 29/637,085, dated Feb. 27, 2019, 5 pgs.
Grupenhof, Notice of Allowance, U.S. Appl. No. 29/637,088, dated Oct. 23, 2018, 8pgs.
Grupenhof, Notice of Allowance, U.S. Appl. No. 29/639,481, dated Oct. 23, 2018, 8 pgs.

* cited by examiner

DISPLAY UNIT WITH BUILT-IN SHELVING SUPPORTS

RELATED APPLICATIONS

This application claims priority to U.S. Provisional Application No. 62/437,025, filed on Dec. 20, 2016, which is hereby incorporated by reference in its entirety.

This application is also related to the following design applications: U.S. Design Pat. application No. 29/588,432; U.S. Design Pat. application No. 29/588,433; U.S. Design Pat. application No. 29/588,435; U.S. Design Pat. application No. 29/588,436; U.S. Design Pat. application No. 29/588,438; U.S. Design Pat. application No. 29/588,440; U.S. Design Pat. application No. 29/588,441; U.S. Design Pat. application No. 29/588,442; U.S. Design Pat. application No. 29/588,443; and U.S. Design Pat. application No. 29/588,444. Each of these related design applications is hereby incorporated by reference in its entirety.

TECHNICAL FIELD

The disclosed embodiments relate generally to temporary display racks, display units, or stands with printed information that are used, for instance, in retail stores to temporarily hold one or more particular products or fungible goods such as food products, cleaning products, health products, hardware products, and the like for a specific marketing campaign. In some instances, the display unit includes a plurality of built-in vertical shelving supports for supporting a significant weight of merchandise placed on shelves of the display unit.

BACKGROUND

Supermarkets, home centers, and other retail establishments, may have temporary display racks, display units, or stands used to display products or fungible goods such as food products, cleaning products, health products, hardware products, and other merchandise. Some racks of this type are typically constructed from permanent display materials such as wood, metal, and plastics. These displays are fairly costly to manufacture and ship, making them expensive to purchase and to deploy through Direct Store Delivery (DSD) systems. Because these displays are typically shipped in an unassembled form, assembly generally requires substantial labor and use of tools to erect these displays at the point of sale. Further, these displays are not easily recyclable and, therefore, are rarely recycled, instead ending up in landfills. Other display racks are made wholly or predominantly from corrugated paperboard on which advertising graphics are printed.

In many instances, these display stands are produced with a combination of cardboard and internal metal supports that are complicated to put together. Furthermore, the merchants may not fill the temporary display racks with the appropriate items for the intended marketing campaign or may not place the products in the correct location on the shelves. As such, it is common for the temporary display racks to be put together offsite, filled with product, and then shipped to the retail establishment. Shipping in this manner induces wear and tear and sometimes causes damage to the temporary display before it even reaches the merchant. Also, the product being carried may be damaged or leak during shipment. Furthermore, this is a costly and inefficient way of shipping the product and the temporary display rack. Additionally, the product manufacturer or consumer package good company running the marketing campaign does not know when (or even if) the merchant places the temporary display in the retail establishment and activates the campaign.

SUMMARY

The embodiments of the invention(s) described herein overcome the various limitations and disadvantages described above. Specifically, the specification describes a temporary display rack (also referred to interchangeably herein as a display unit) with built-in vertical shelving support columns formed from a same single sheet of material as the faces and main body of the display unit. The display unit of the various embodiments described herein thus provides the advantages of additional reinforcement and increased strength based on the folded-in structure of the support columns, thereby allowing substantial weight, in the form of products pre-packaged on the display unit before shipping to the retailer, to be carried on the shelves supported by the support columns, and eliminating the need for additional dividers or separate shelving supports and the extra cost and labor associated with including these in manufacturing a conventional display unit.

Furthermore, at least some of components of the display unit are constructed from recyclable material. The temporary display rack can be shipped flat and assembled quickly on site without requiring the use of tools. Furthermore, the temporary display rack described herein includes a mechanism to assist merchants in placing the desired products on the shelves in the desired position. The temporary display rack described herein also includes a mechanism for the product manufacturer or consumer package good company running the marketing campaign to receive feedback indicating when the marketing campaign is active at the merchant (e.g., when the temporary display rack has been unpacked, assembled, and/or placed on the retail floor with product).

The following presents a summary of the invention in order to provide a basic understanding of some of the aspects of the invention. This summary is not an extensive overview of the invention. It is not intended to identify key/critical elements of the invention or to delineate the scope of the invention. Its sole purpose is to present some of the concepts of the invention in a simplified form as a prelude to the more detailed description that is presented later.

In some embodiments, a display unit having a plurality of built-in, hollow vertical supports for supporting one or more shelves is provided. The display unit includes: a frame comprising a first single sheet of material folded into: (i) a plurality of vertical panels; and (ii) a first set of built-in, hollow vertical supports of the plurality of built-in, hollow vertical supports, wherein each built-in, hollow vertical support contacts one or more of the plurality of vertical panels; and a first shelf of the one or more shelves disposed within the frame and supported by each built-in, hollow vertical support of the first set of built-in, hollow vertical supports.

Various embodiments of systems, methods, and devices within the scope of the appended claims each have several aspects, no single one of which is solely responsible for the desirable attributes described herein. Without limiting the scope of the appended claims, some prominent features are described herein. After considering this discussion, and particularly after reading the section entitled "Detailed Description," one will understand how the features of various embodiments are used.

BRIEF DESCRIPTION OF THE DRAWINGS

For a better understanding of the aforementioned aspects as well as additional aspects and embodiments thereof, reference should be made to the Detailed Description below, in conjunction with the following drawings in which like reference numerals refer to corresponding parts throughout the figures.

BRIEF DESCRIPTION OF THE APPENDICES

Figure 1:
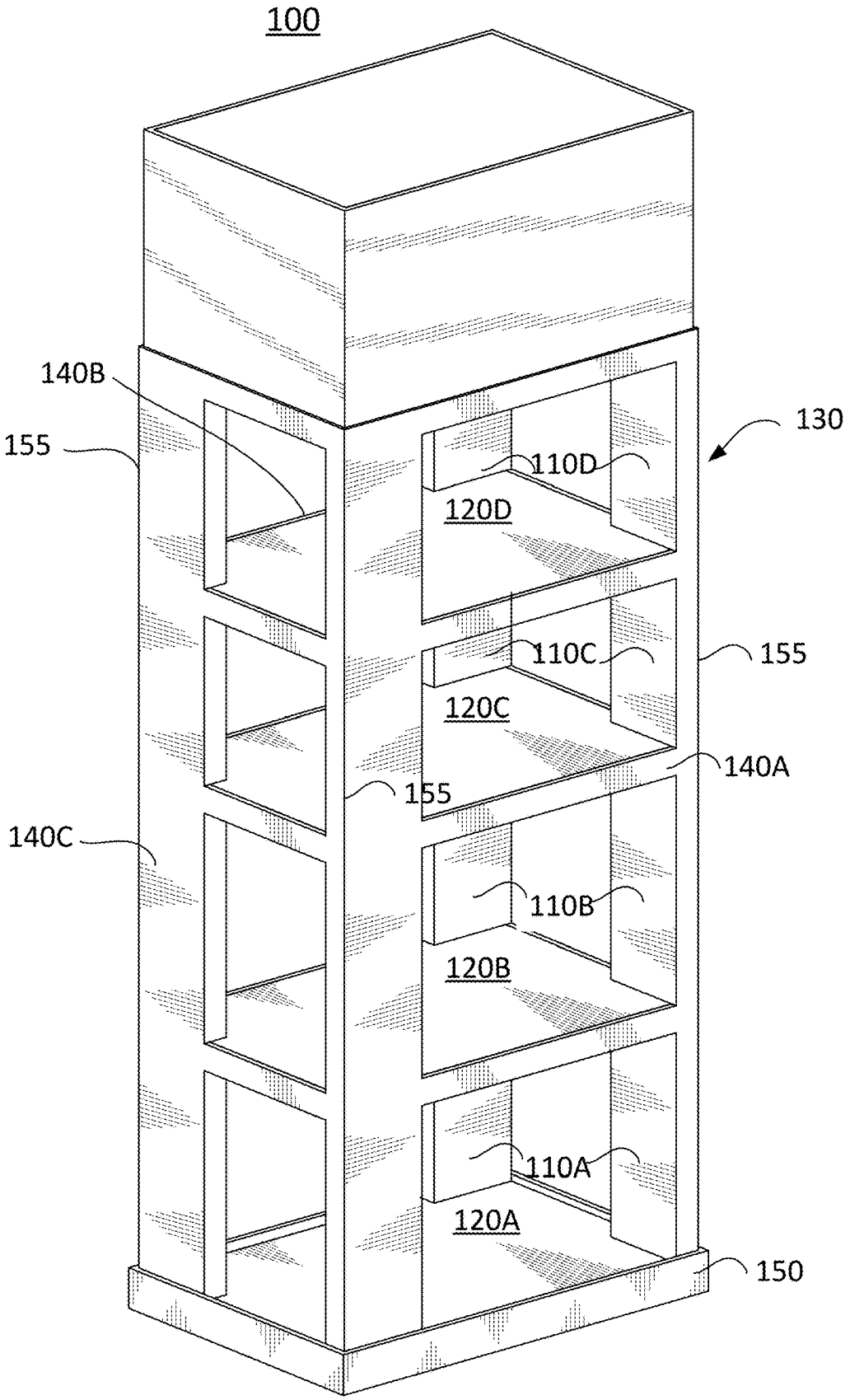
FIG. 1 is a perspective view of a first temporary display unit, in accordance with some embodiments.

For a better understanding of the aforementioned aspects as well as additional aspects and embodiments thereof, reference should be made to the Detailed Description below, in conjunction with the preceding figures and the following appendices.

Appendix A, in the incorporated-by-reference U.S. Provisional Application No. 62/437,025, includes a sequence of illustrations that provide a method of forming a first single sheet of material into the first temporary display rack that includes a plurality of built-in, hollow vertical supports and a second single sheet of material into a base into which the first temporary display rack is inserted, in accordance with some embodiments. Appendix A also shows an exploded view of the first temporary display rack, illustrating each component of the first temporary display rack and example materials used to construct those components, in accordance with some embodiments.

Appendix B, in the incorporated-by-reference U.S. Provisional Application No. 62/437,025, includes a sequence of illustrations that provide a method of forming a first single sheet of material into the second temporary display rack that includes a plurality of built-in, hollow vertical supports and a second single sheet of material into a base into which the second temporary display rack is inserted, in accordance with some embodiments. Appendix B also shows an exploded view of the second temporary display rack, illustrating each component of the second temporary display rack and example materials used to construct those components, in accordance with some embodiments.

Appendix C, in the incorporated-by-reference U.S. Provisional Application No. 62/437,025, includes a sequence of illustrations that provide a method of forming a first single sheet of material into the third temporary display rack that includes a plurality of built-in, hollow vertical supports and a second single sheet of material into a base into which the third temporary display rack is inserted, in accordance with some embodiments. Appendix C also shows an exploded view of the third temporary display rack, illustrating each component of the third temporary display rack and example materials used to construct those components, in accordance with some embodiments.

Appendix D, filed herewith and also included in the incorporated-by-reference U.S. Provisional Application No. 62/437,025, includes a sequence of illustrations that provide a method of forming a first single sheet of material into the fourth temporary display rack that includes a plurality of built-in, hollow vertical supports and a second single sheet of material into a base into which the fourth temporary display rack is inserted, in accordance with some embodiments. Appendix D also shows an exploded view of the fourth temporary display rack, illustrating each component of the fourth temporary display rack and example materials used to construct those components, in accordance with some embodiments.

Appendix E, in the incorporated-by-reference U.S. Provisional Application No. 62/437,025, includes a sequence of illustrations that provide a method of forming a first single sheet of material into the fifth temporary display rack that includes a plurality of built-in, hollow vertical supports and a second single sheet of material into a base into which the fifth temporary display rack is inserted, in accordance with some embodiments. Appendix E also shows an exploded view of the fifth temporary display rack, illustrating each component of the fifth temporary display rack and example materials used to construct those components, in accordance with some embodiments.

Appendix F, filed herewith and also included in the incorporated-by-reference U.S. Provisional Application No. 62/437,025, includes a sequence of illustrations that provide a method of forming a first single sheet of material into the sixth temporary display rack that includes a plurality of built-in, hollow vertical supports and a second single sheet of material into a base into which the sixth temporary display rack is inserted, in accordance with some embodiments. Appendix F also shows an exploded view of the sixth temporary display rack, illustrating each component of the sixth temporary display rack and example materials used to construct those components, in accordance with some embodiments.

Appendix G, in the incorporated-by-reference U.S. Provisional Application No. 62/437,025, includes a sequence of illustrations that provide a method of forming a first single sheet of material into the seventh temporary display rack that includes a plurality of built-in, hollow vertical supports and a second single sheet of material into a base into which the seventh temporary display rack is inserted, in accordance with some embodiments. Appendix G also shows an exploded view of the seventh temporary display rack, illustrating each component of the seventh temporary display rack and example materials used to construct those components, in accordance with some embodiments.

Appendix H, in the incorporated-by-reference U.S. Provisional Application No. 62/437,025, includes a sequence of illustrations that provide a method of forming a first single sheet of material into the eighth temporary display rack that includes a plurality of built-in, hollow vertical supports and a second single sheet of material into a base into which the eighth temporary display rack is inserted, in accordance with some embodiments. Appendix H also shows an exploded view of the eighth temporary display rack, illustrating each component of the eighth temporary display rack and example materials used to construct those components, in accordance with some embodiments.

Appendix I, filed herewith and also included in the incorporated-by-reference U.S. Provisional Application No. 62/437,025, includes a sequence of illustrations that provide a method of forming a first single sheet of material into the ninth temporary display rack that includes a plurality of built-in, hollow vertical supports and a second single sheet of material into a base into which the ninth temporary display rack is inserted, in accordance with some embodiments. Appendix I also shows an exploded view of the ninth temporary display rack, illustrating each component of the ninth temporary display rack and example materials used to construct those components, in accordance with some embodiments.

Appendix J, in the incorporated-by-reference U.S. Provisional Application No. 62/437,025, includes a sequence of illustrations that provide a method of forming a first single sheet of material into the tenth temporary display rack that includes a plurality of built-in, hollow vertical supports and a second single sheet of material into a base into which the tenth temporary display rack is inserted, in accordance with some embodiments. Appendix J also shows an exploded view of the tenth temporary display rack, illustrating each component of the tenth temporary display rack and example materials used to construct those components, in accordance with some embodiments.

DETAILED DESCRIPTION

Reference will now be made in detail to embodiments, examples of which are illustrated in the accompanying drawings. In the following detailed description, numerous specific details are set forth in order to provide a thorough understanding of the present embodiments. However, it will be apparent to one of ordinary skill in the art that the present various embodiments may be practiced without these specific details. In other instances, well-known components and methods have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another (e.g., first side panel and second side panel). For example, a first element could be termed a second element, and, similarly, a second element could be termed a first element, without changing the meaning of the description, so long as all occurrences of the first element are renamed consistently and all occurrences of the second element are renamed consistently. The first element and the second element are both elements, but they are not the same element.

The terminology used in the description of the embodiments herein is for the purpose of describing particular embodiments only and is not intended to be limiting of the claims. As used in the description of the embodiments and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," as well as the terms "includes" and/or "including" when used in this specification, specify the presence of stated features, integers, steps, operations, elements, and/or components, but do not preclude the presence or addition of one or more other features, steps, elements, components, and/or groups thereof. Furthermore, as used herein, the term "if" may be construed to mean "when" or "upon" or "in response to," depending on the context.

Many of the components of the temporary display unit described below are made of recyclable (e.g., honeycomb cardboard) material and are held in an assembled relationship by inter-fitting tabs and receiving slots. These components are lightweight, particularly relative to their strength, are easy to transport, and are capable of being set-up within the retail environment in two minutes or less. The manner in which the various structural components and graphics panels fit together provides a distinct advantage in terms of structural performance and ease of assembly, permitting the display units to be efficiently deployed in the retail environment (and in such a way that ensures merchants are also complying with supplier requirements or requirements specific to a particular marketing campaign with which the display unit is associated).

Figure 2:
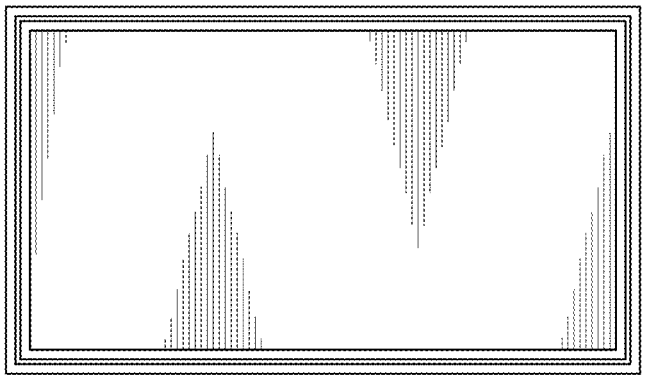
FIG. 2 is a top view.
Figure 3:
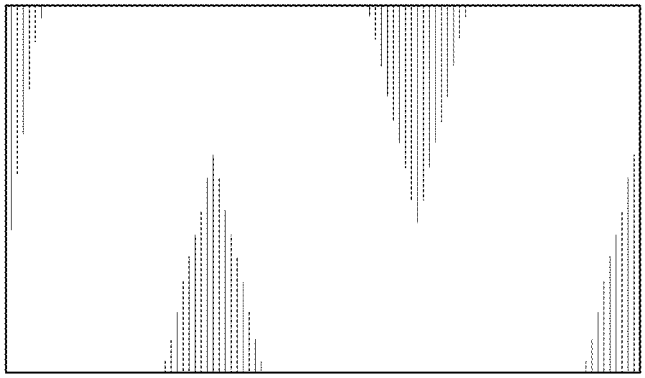
FIG. 3 is a bottom view of the first temporary display unit, in accordance with some embodiments.

FIGS. 1-6B and Appendix A (of the incorporated-by-reference U.S. Provisional Application No. 62/437,025) illustrate a first temporary display unit, in accordance with some embodiments. FIG. 1 is a perspective view of a first temporary display unit 100 having a plurality of built-in, hollow vertical supports 110 (e.g., 110A through 110D) for supporting one or more shelves 120 (e.g., 120A through 120D) in accordance with some embodiments. FIG. 2 is a top view, and FIG. 3 is a bottom view of the first temporary display unit 100, in accordance with some embodiments.

In some embodiments or circumstances, the temporary display unit 100 is referred to as a display rack and, thus, the terms are used interchangeably herein. Also, to avoid repetition, even though some features of the embodiments disclosed herein are described with respect to particular embodiments (e.g., with reference to one of the first through the tenth temporary display units described herein, and these features may still apply to all embodiments, e.g., each of the temporary display units all include various pluralities of built-in, hollow vertical supports which allow the display units to support significant merchandise while requiring very little material to construct each respective temporary display unit).

Figure 29:
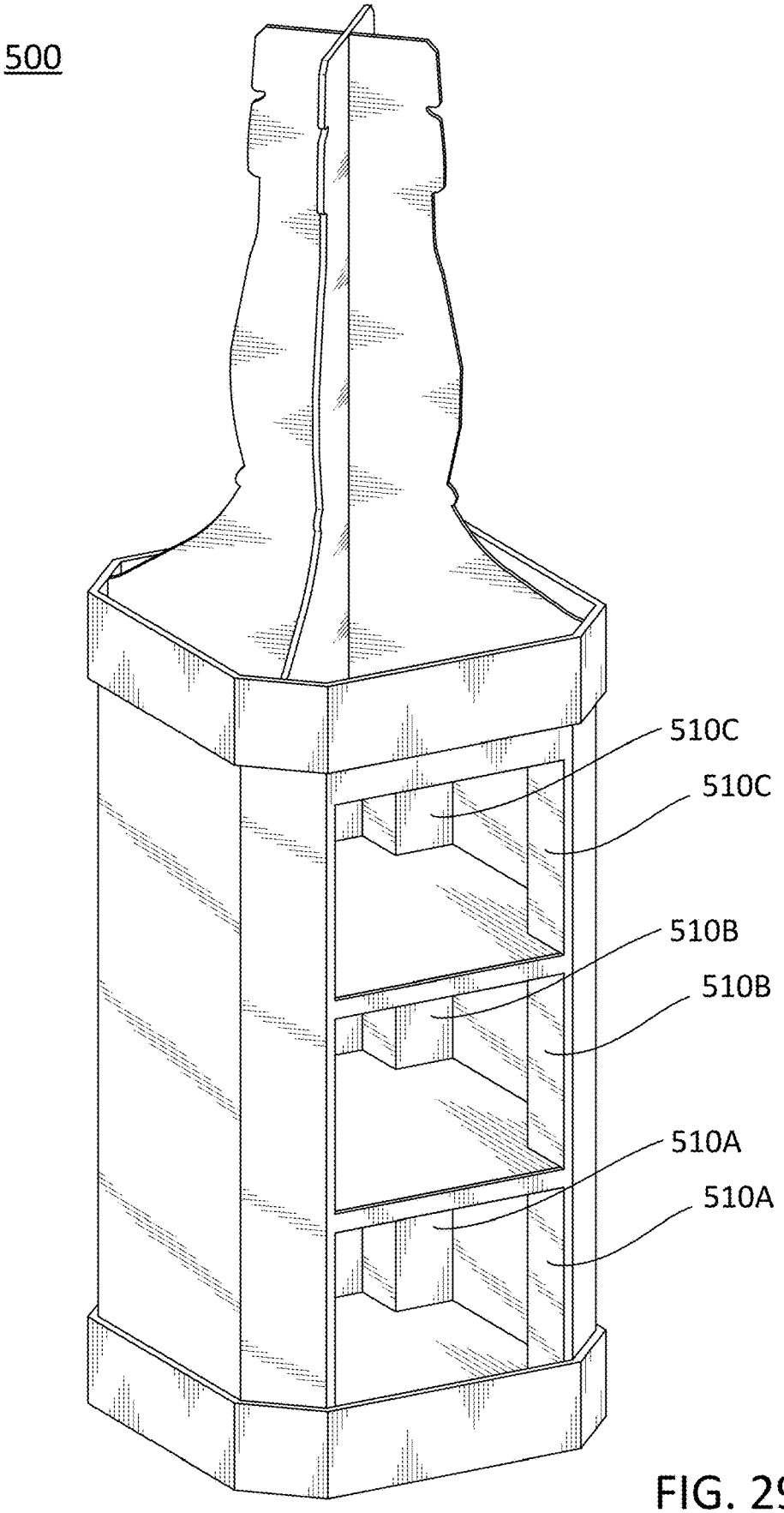
FIG. 29 is a perspective view of a fifth temporary display unit, in accordance with some embodiments.
Figure 30:
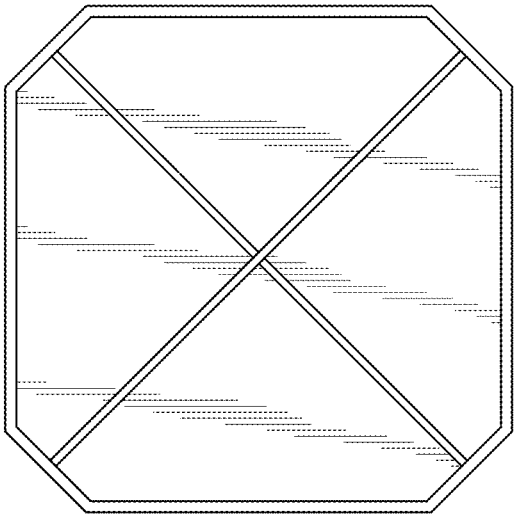
FIG. 30 is a top view.
Figure 31:
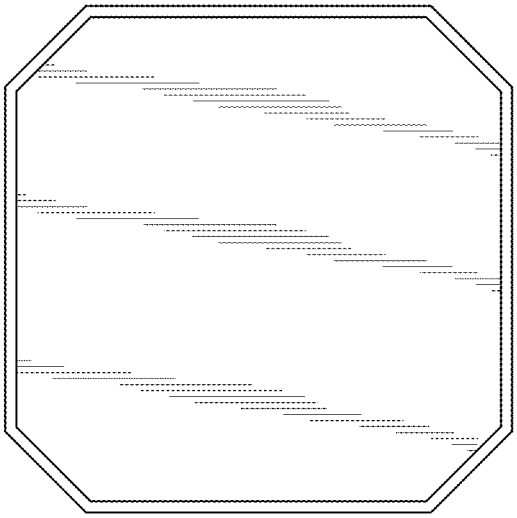
FIG. 31 is a bottom view of the fifth temporary display unit, in accordance with some embodiments.
Figure 32:
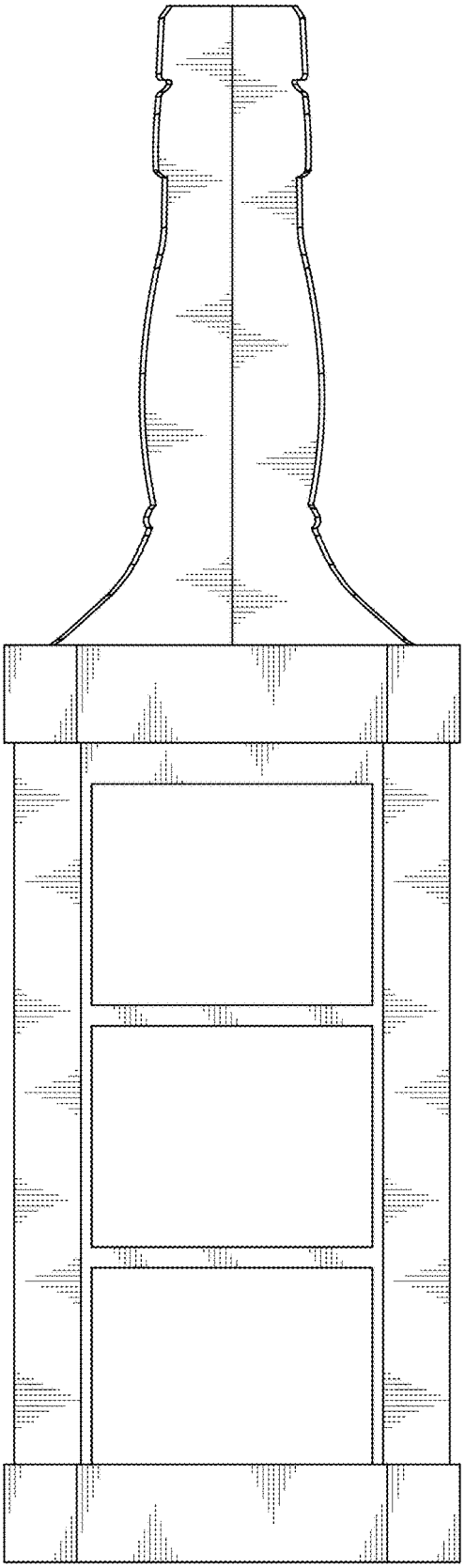
FIG. 32 is a front view.
Figure 33:
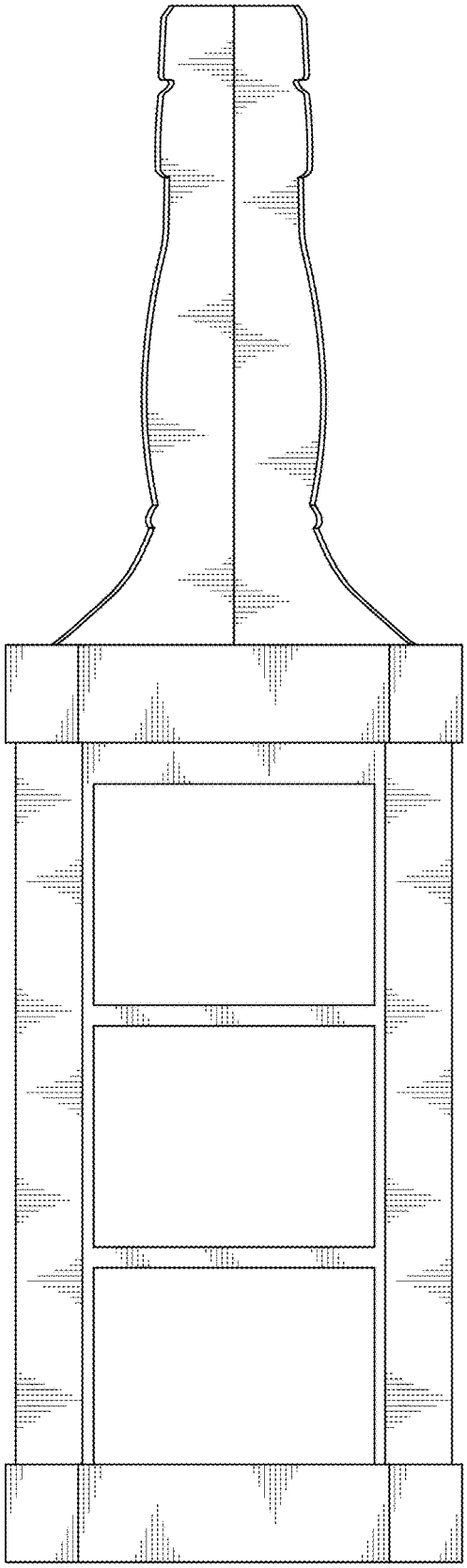
FIG. 33 is a rear view of the fifth temporary display unit, in accordance with some embodiments.
Figure 34:
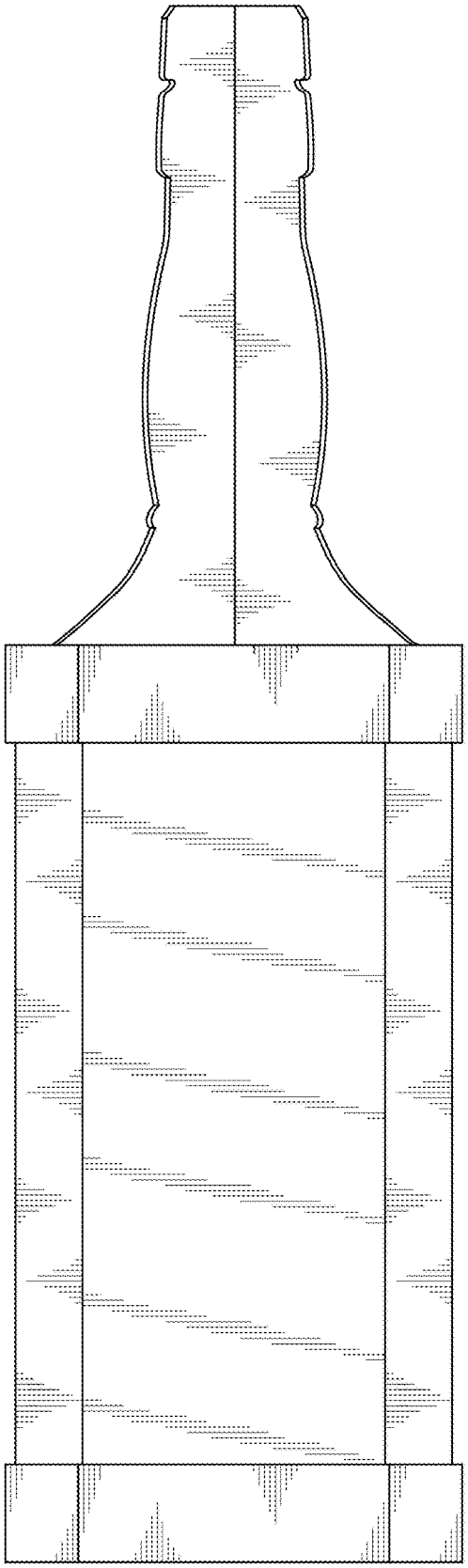
FIG. 34 is a first side view.
Figure 35:
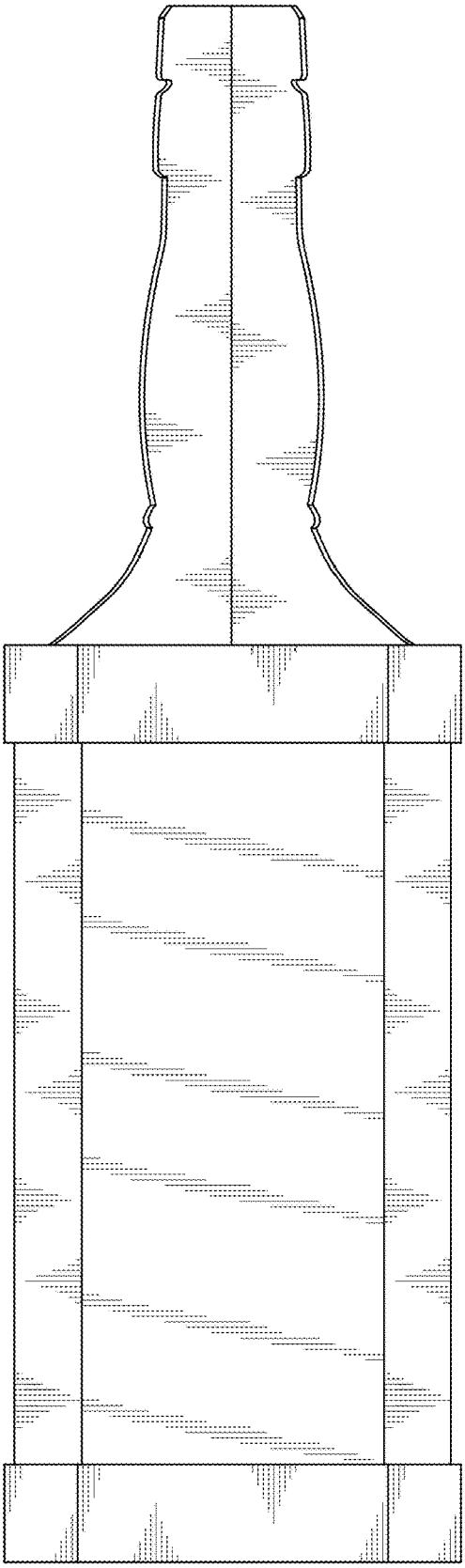
FIG. 35 is a second side view of the fifth temporary display unit, in accordance with some embodiments.
Figure 36:
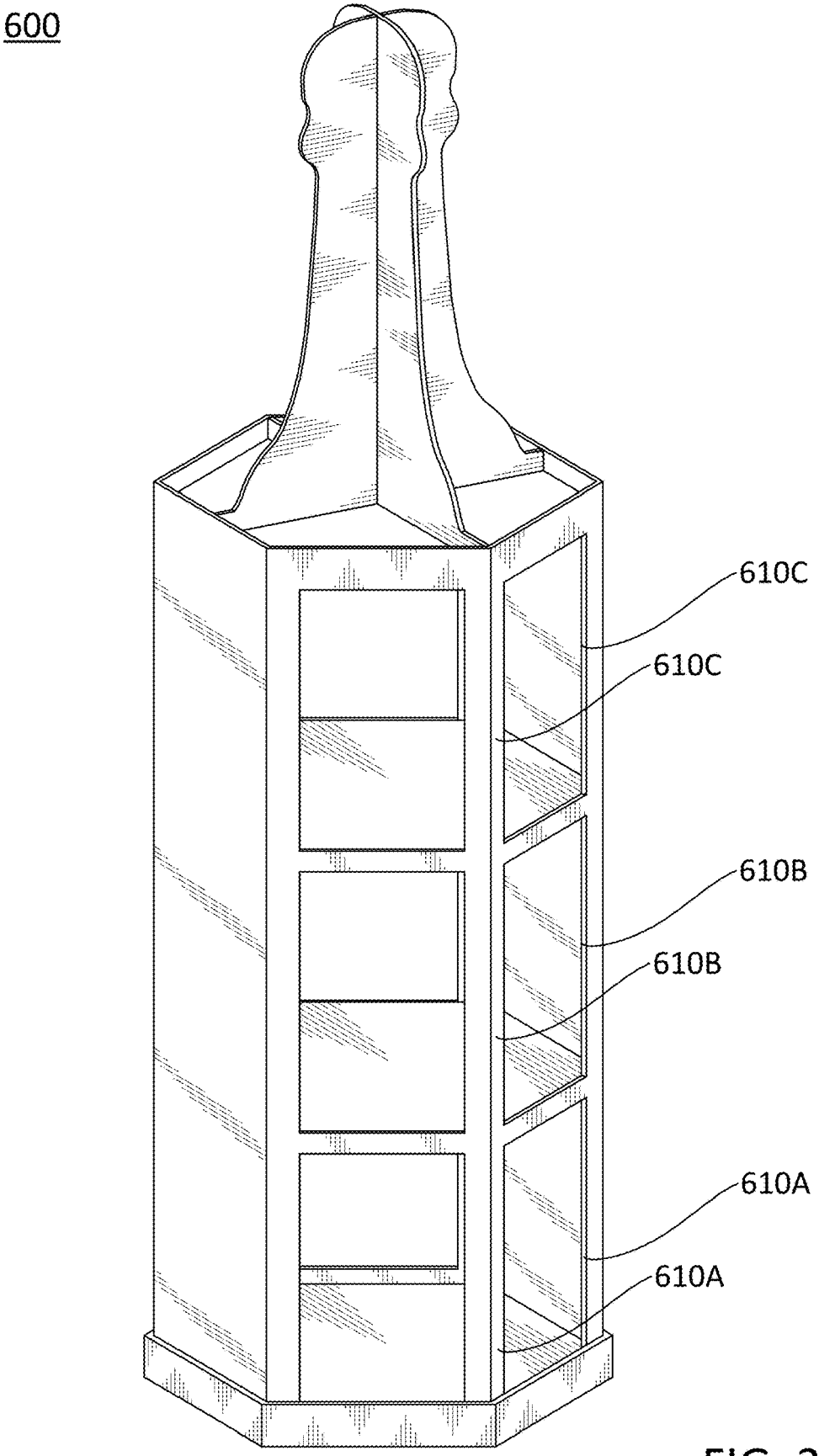
FIG. 36 is a perspective view of a sixth temporary display unit, in accordance with some embodiments.
Figure 37:
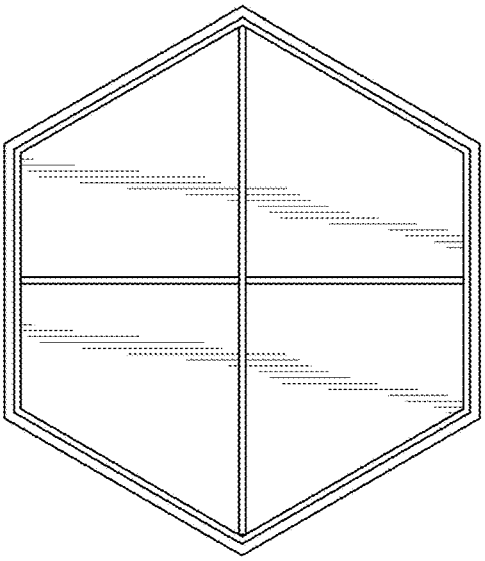
FIG. 37 is a top view.
Figure 38:
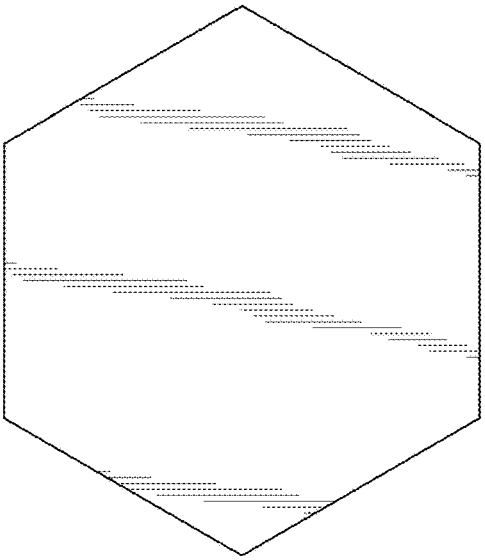
FIG. 38 is a bottom view of the sixth temporary display unit, in accordance with some embodiments.
Figure 39:
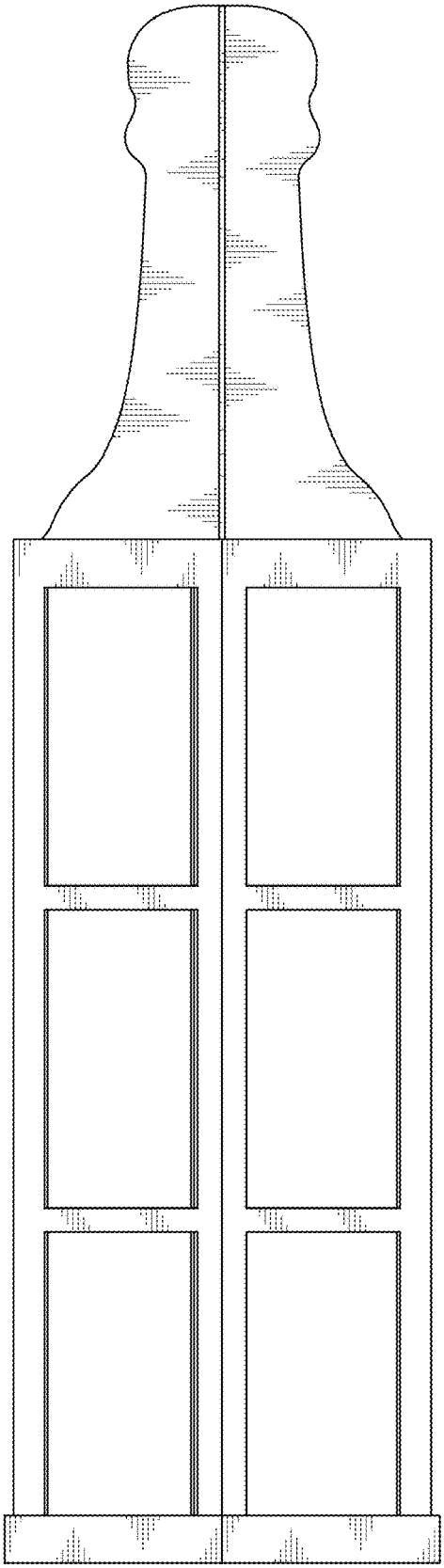
FIG. 39 is a front view.
Figure 40:
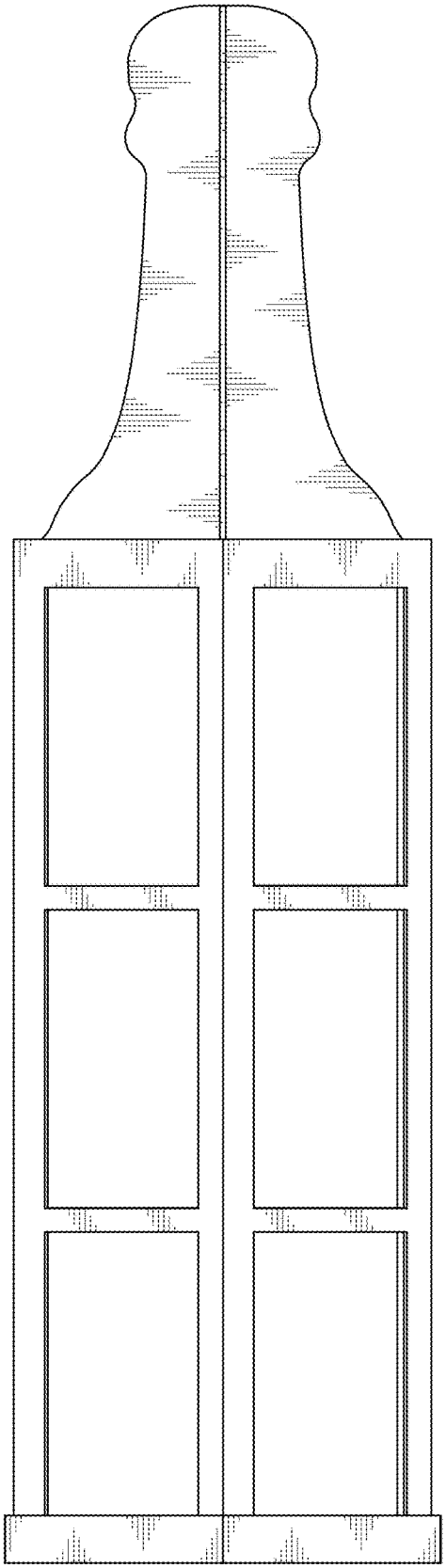
FIG. 40 is a rear view of the sixth temporary display unit, in accordance with some embodiments.
Figure 41:
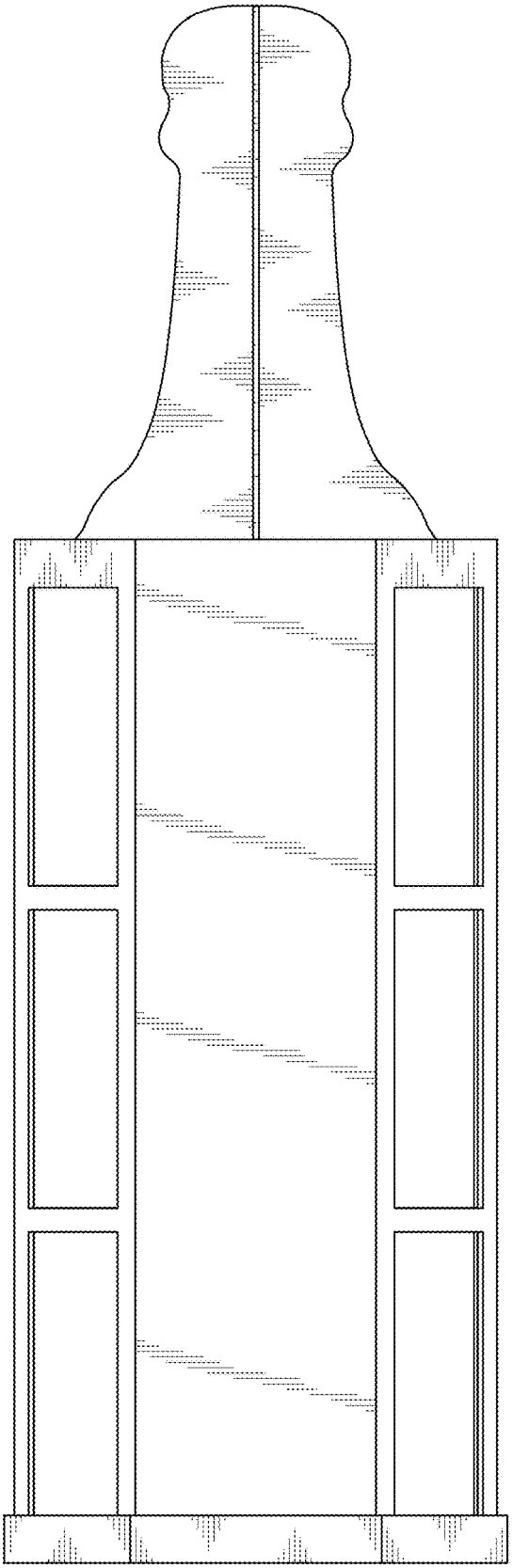
FIG. 41 is a first side view.
Figure 42:
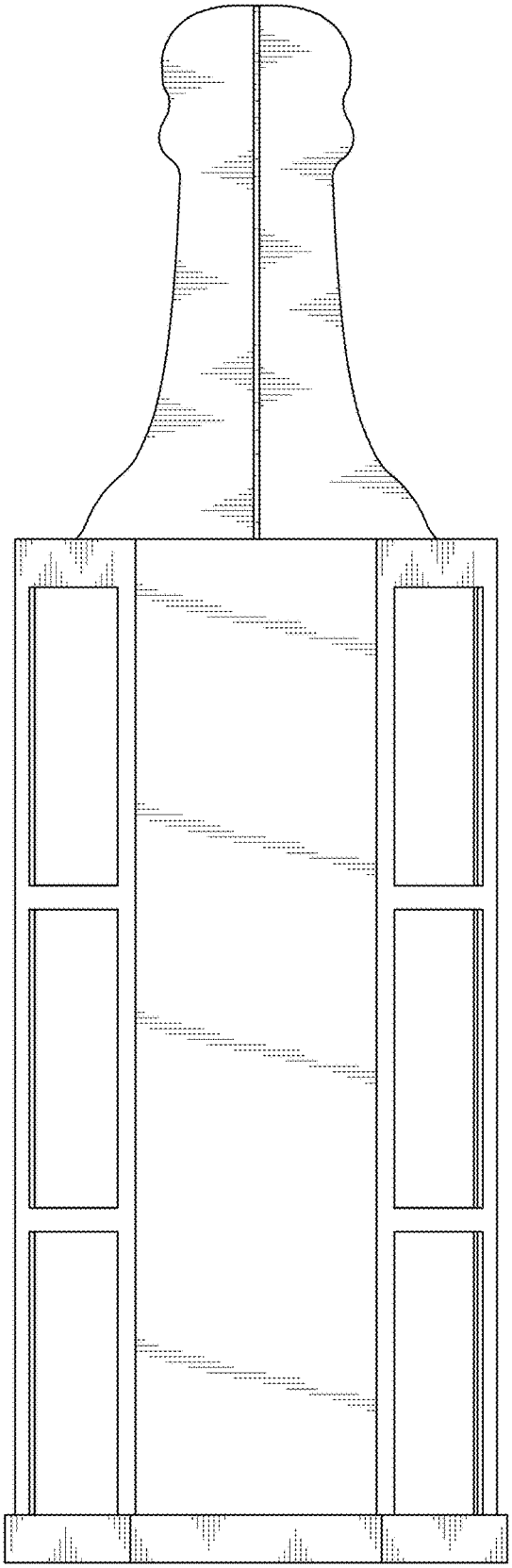
FIG. 42 is a second side view of the sixth temporary display unit, in accordance with some embodiments.
Figure 43:
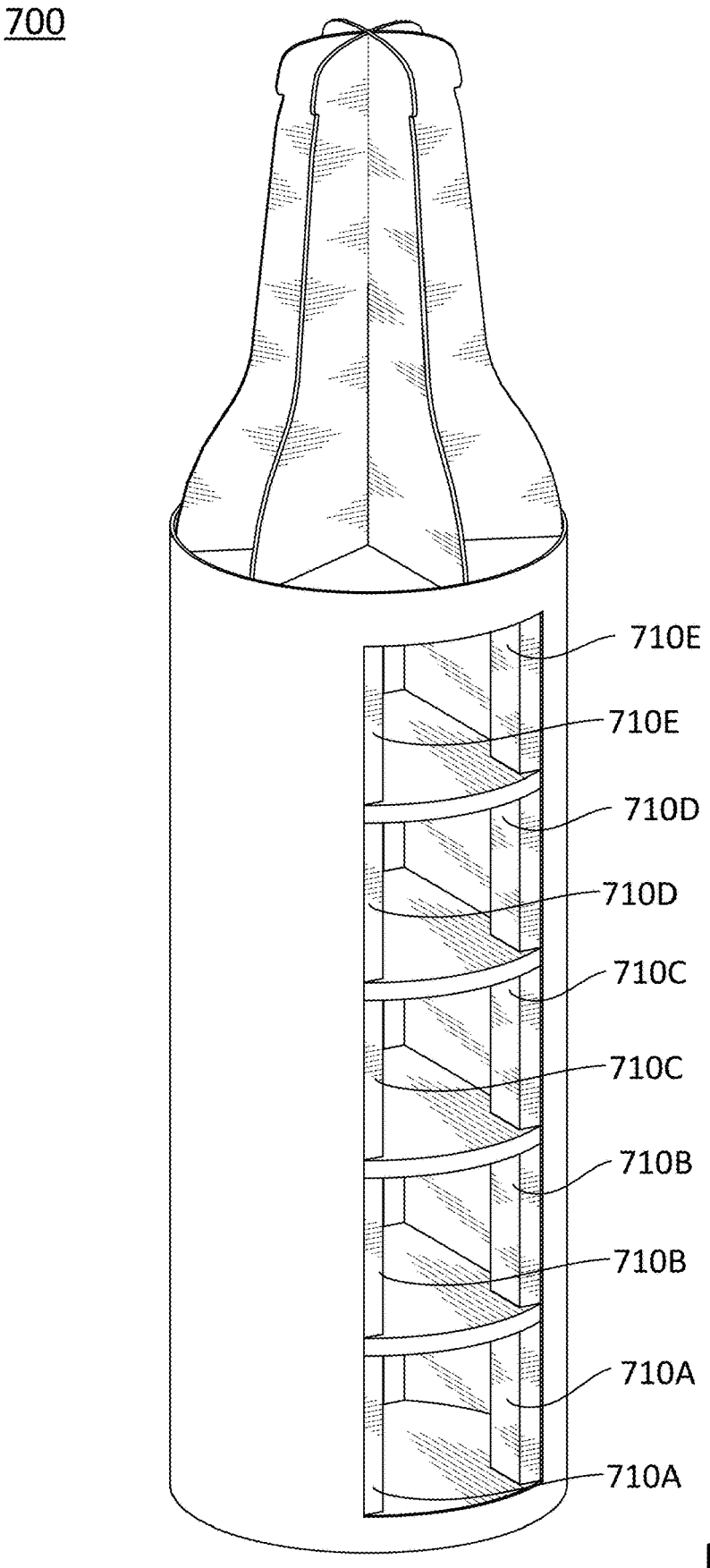
FIG. 43 is a perspective view of a seventh temporary display unit, in accordance with some embodiments.
Figure 44:
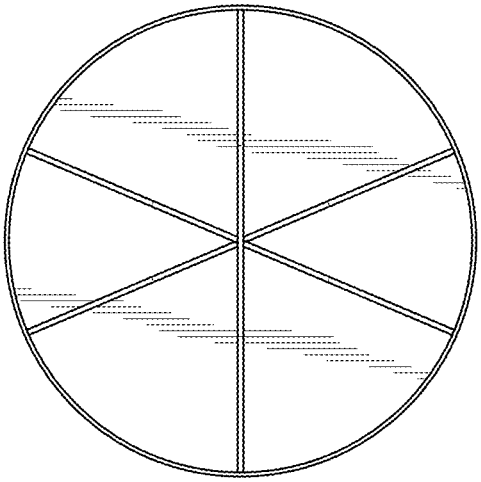
FIG. 44 is a top view.
Figure 45:
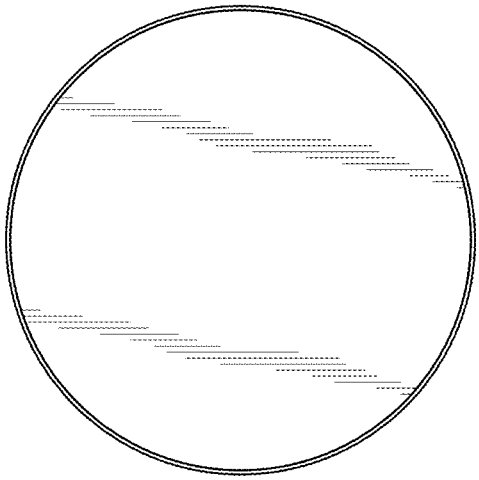
FIG. 45 is a bottom view of the seventh temporary display unit, in accordance with some embodiments.
Figure 46:
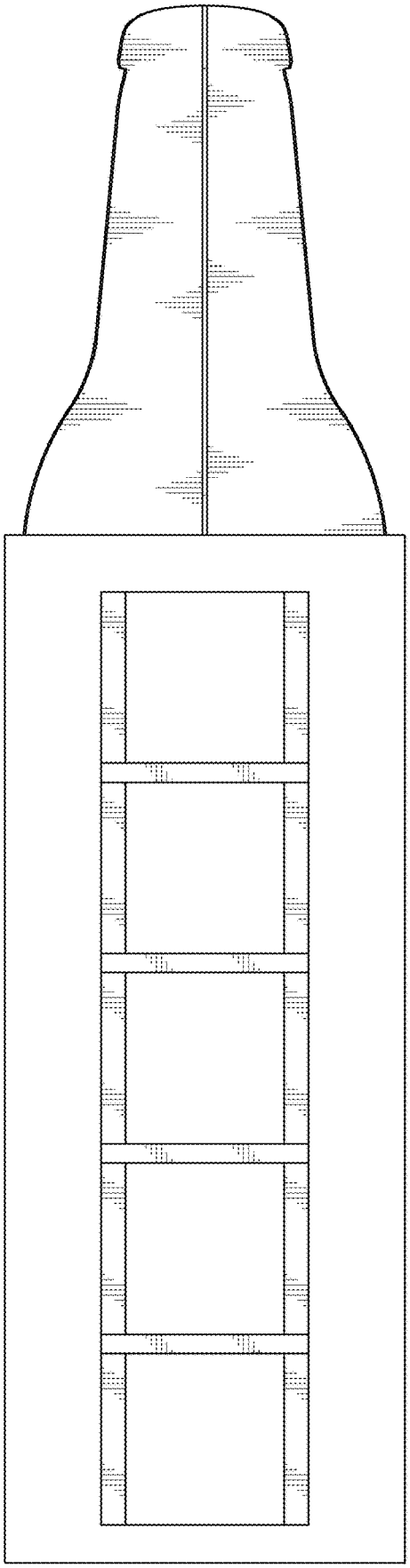
FIG. 46 is a front view.
Figure 47:
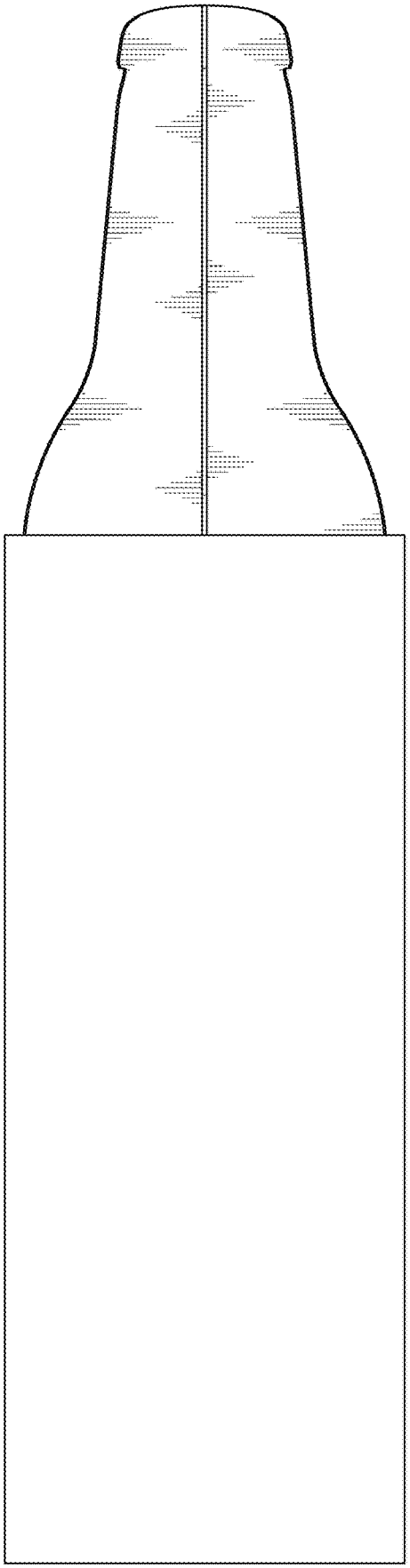
FIG. 47 is a rear view of the seventh temporary display unit, in accordance with some embodiments.
Figure 48:
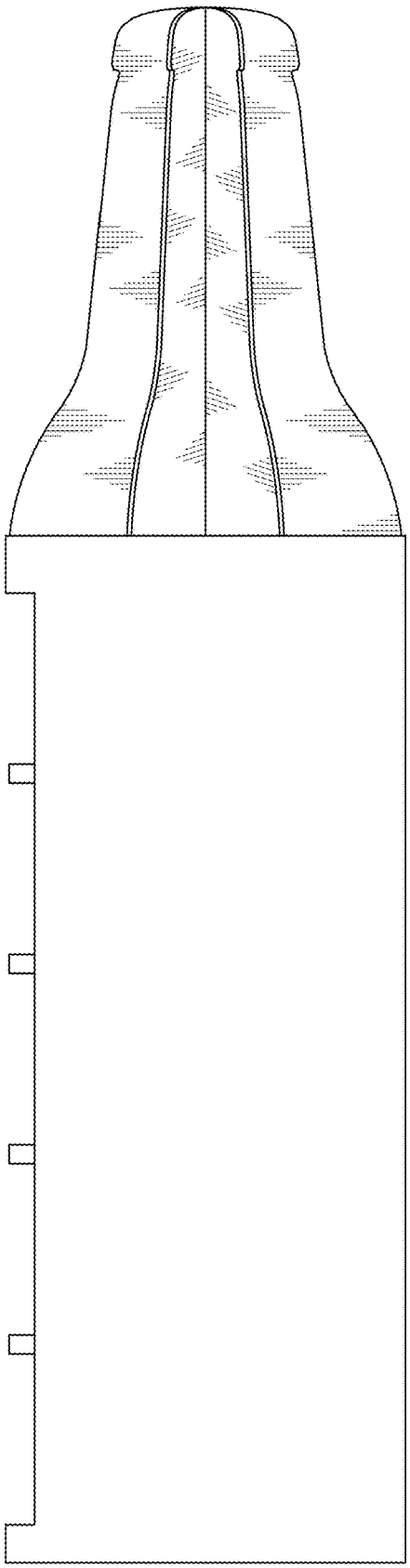
FIG. 48 is a first side view.
Figure 49:
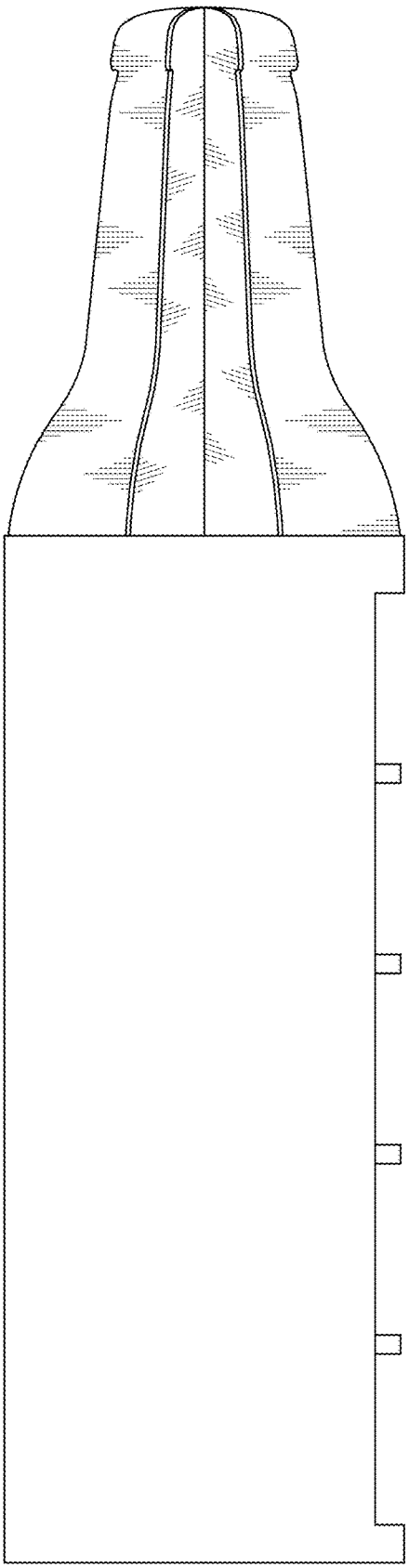
FIG. 49 is a second side view of the seventh temporary display unit, in accordance with some embodiments.
Figure 50:
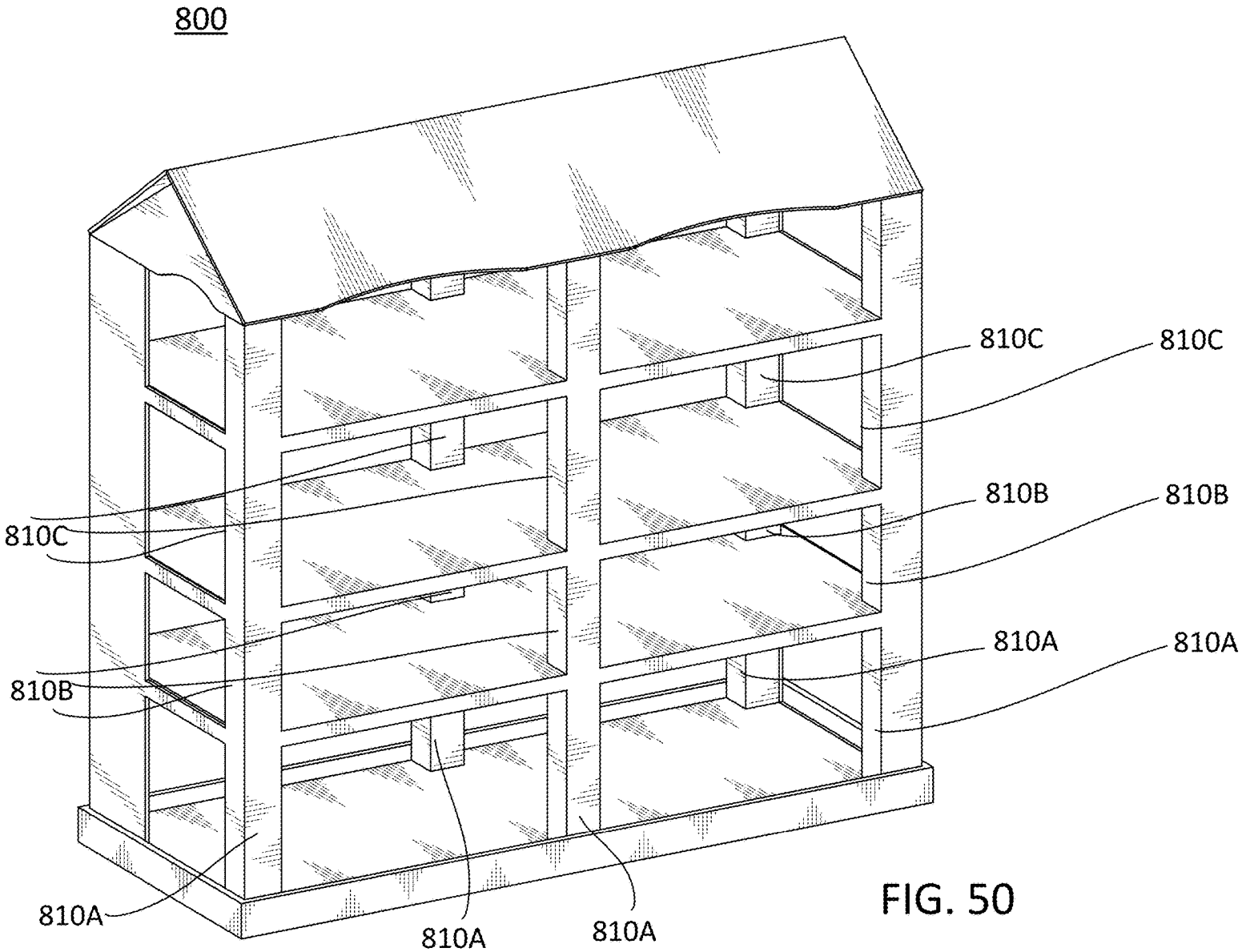
FIG. 50 is a perspective view of an eighth temporary display unit, in accordance with some embodiments.
Figure 51:
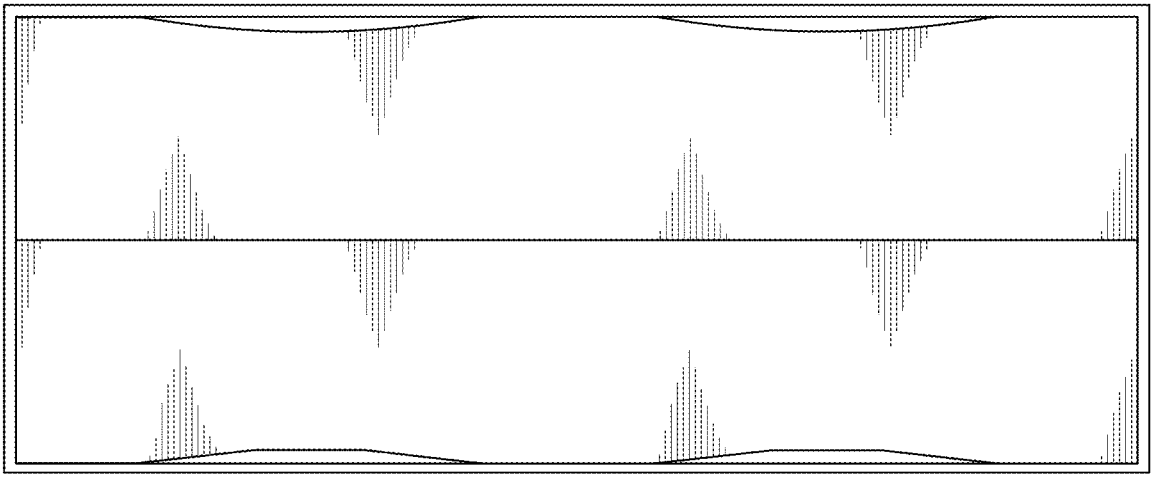
FIG. 51 is a top view.
Figure 52:
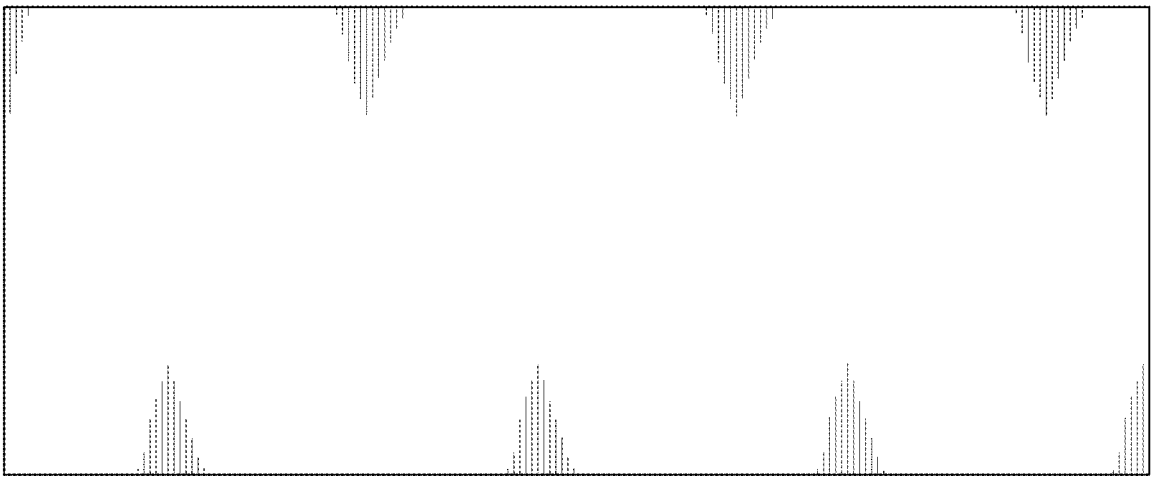
FIG. 52 is a bottom view of the eighth temporary display unit, in accordance with some embodiments.
Figure 53:
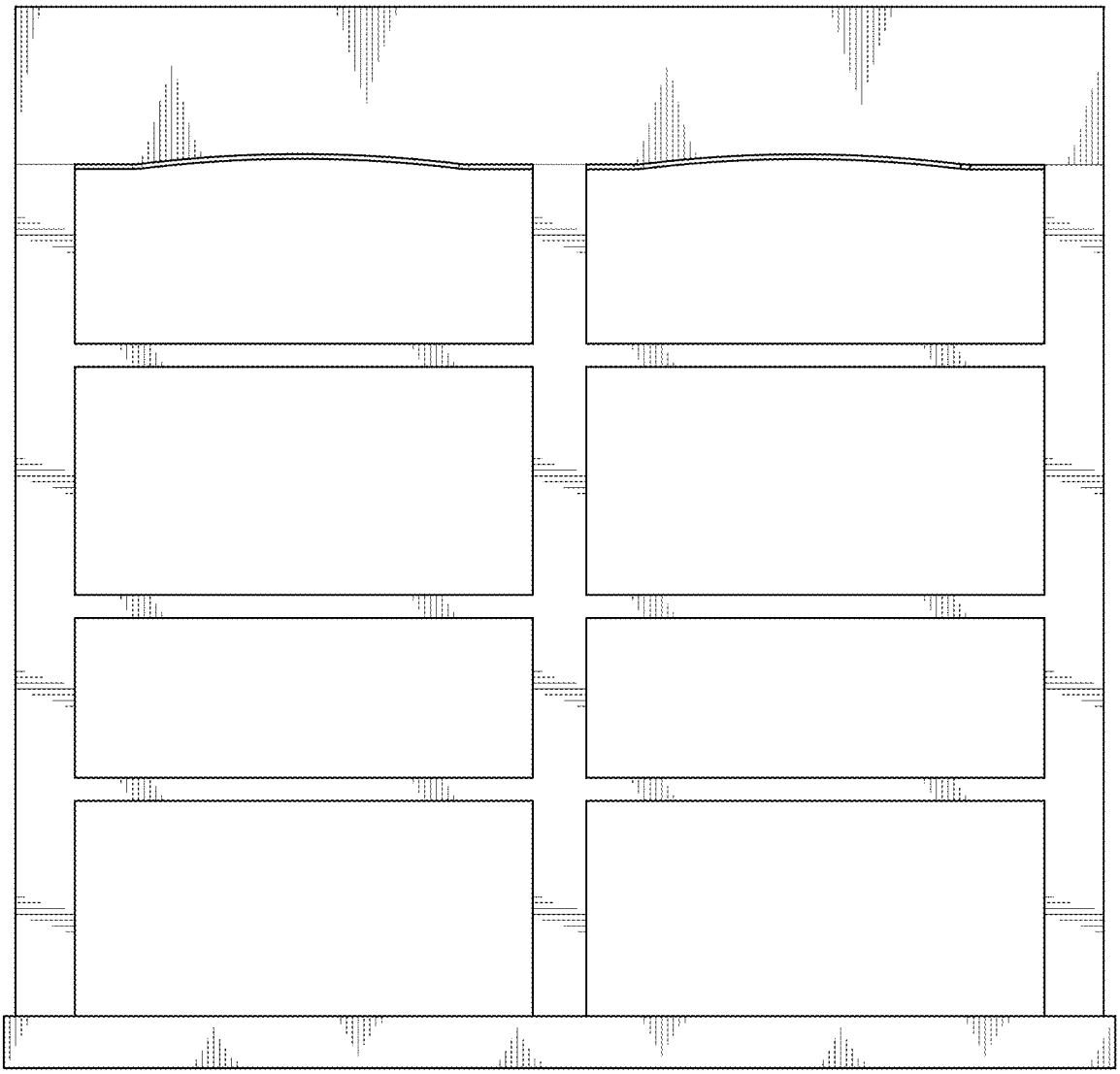
FIG. 53 is a front view.
Figure 54:
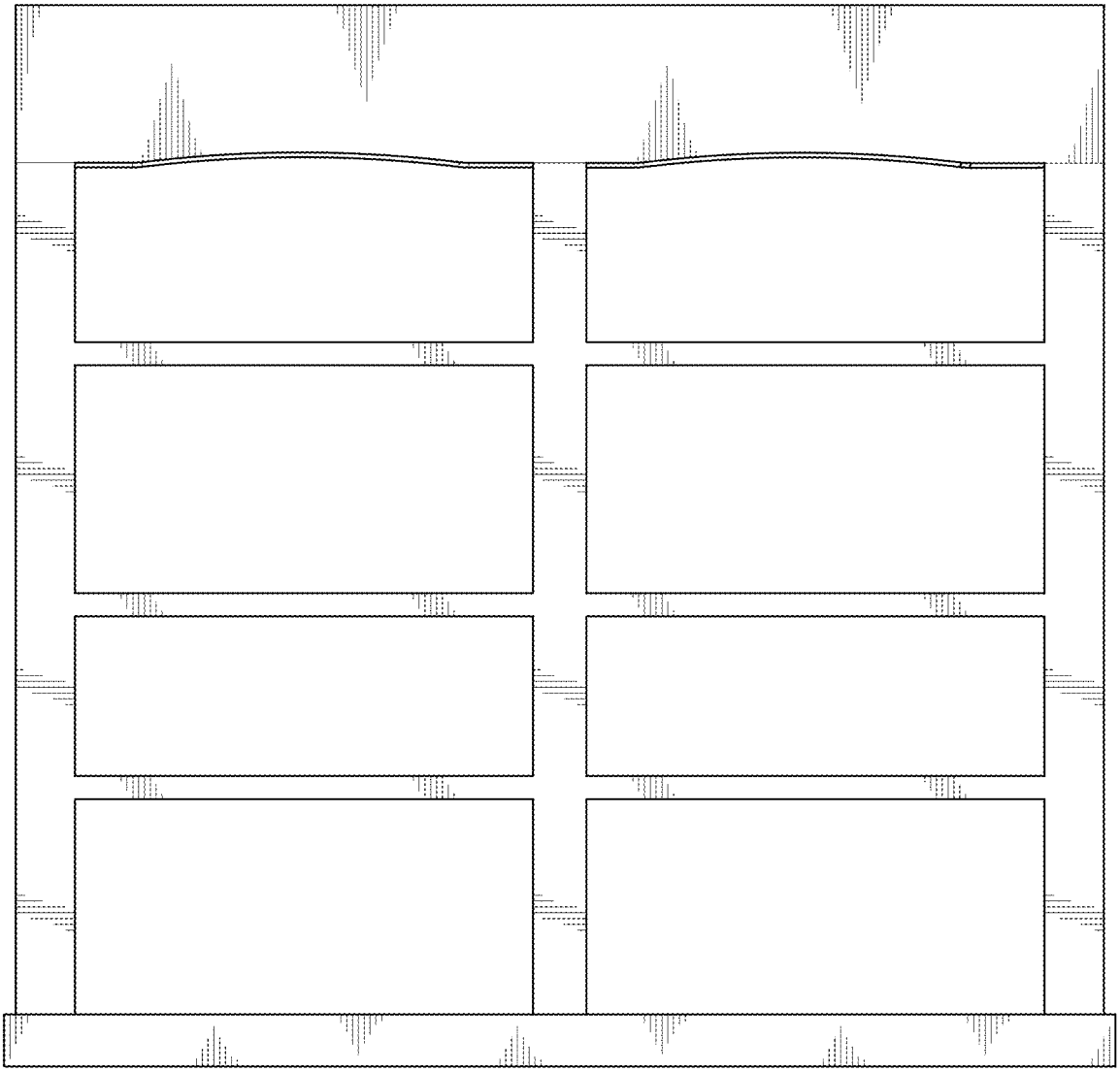
FIG. 54 is a rear view of the eighth temporary display unit, in accordance with some embodiments.
Figure 55:
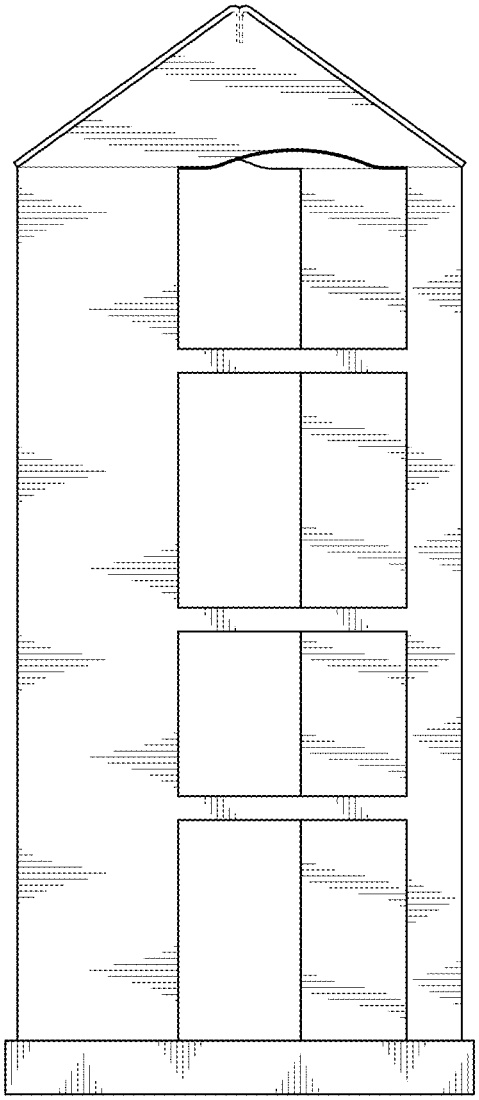
FIG. 55 is a first side view.
Figure 56:
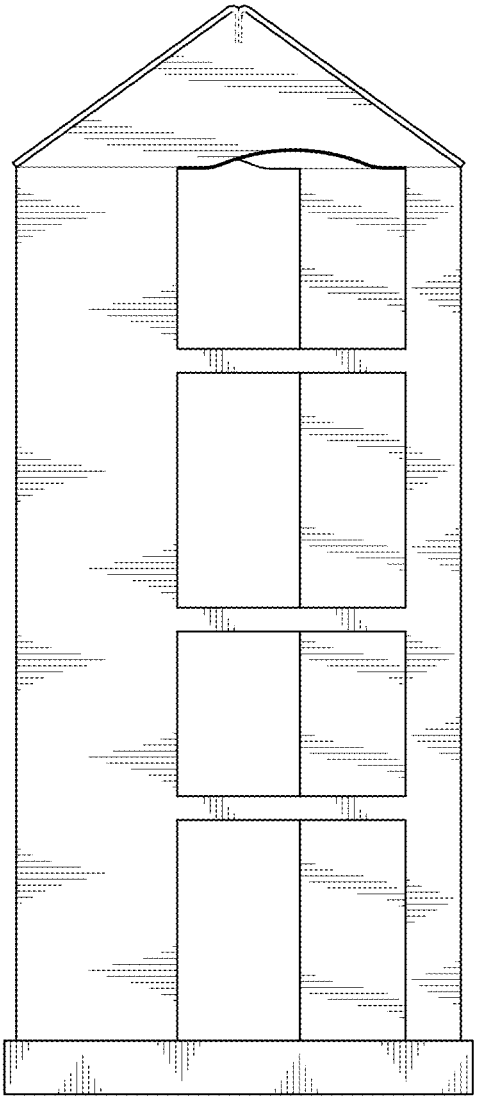
FIG. 56 is a second side view of the eighth temporary display unit, in accordance with some embodiments.
Figure 57:
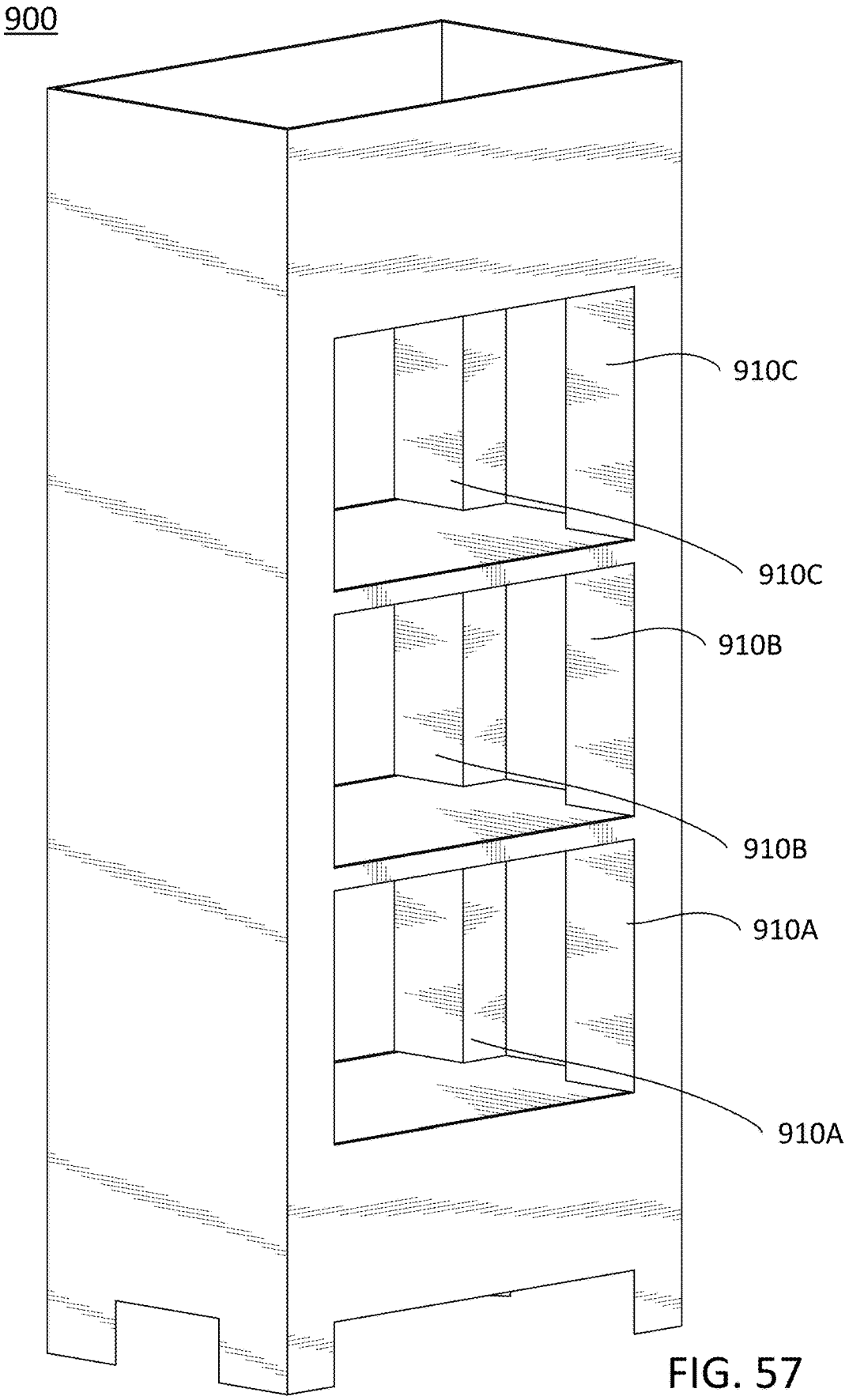
FIG. 57 is a perspective view of a ninth temporary display unit, in accordance with some embodiments.
Figure 58:
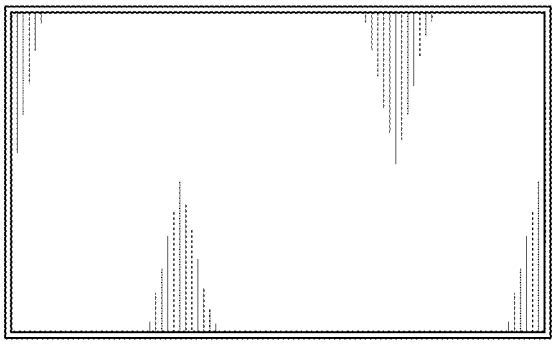
FIG. 58 is a top view.
Figure 59:
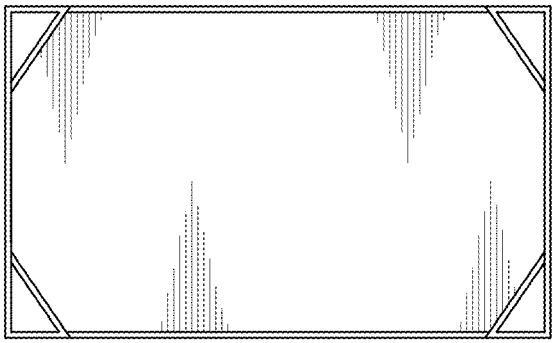
FIG. 59 is a bottom view of the ninth temporary display unit, in accordance with some embodiments.
Figure 60:
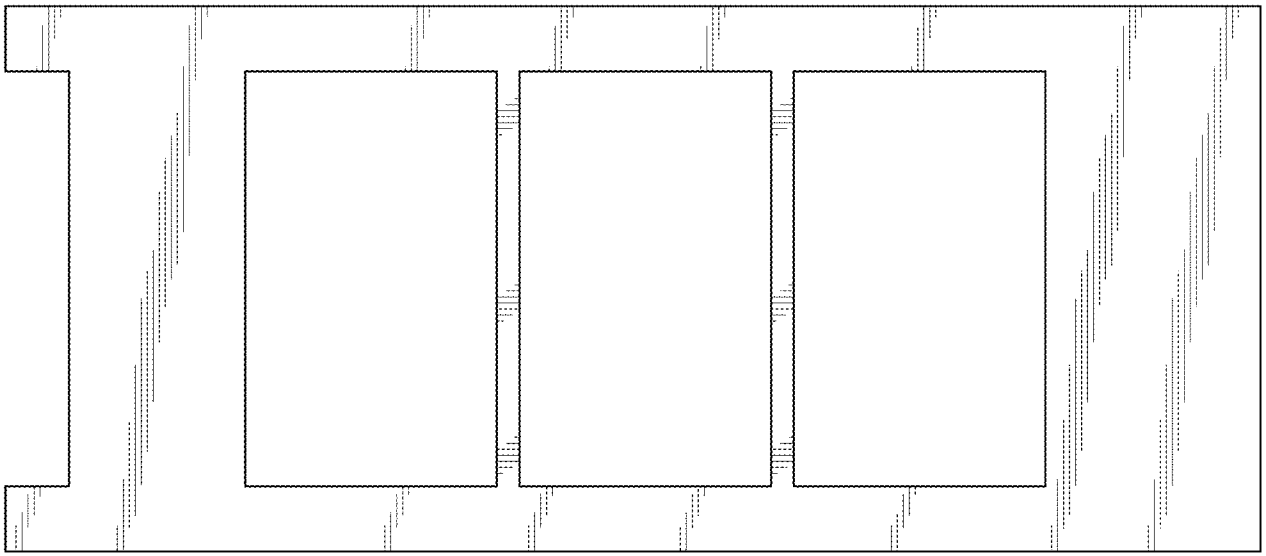
FIG. 60 is a front view.
Figure 61:
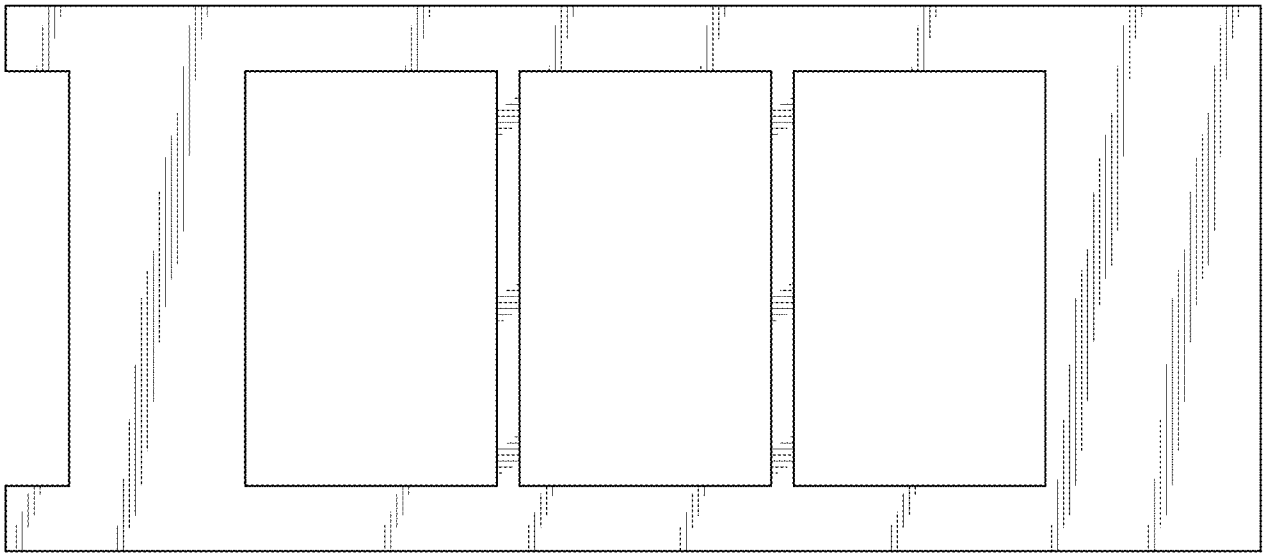
FIG. 61 is a rear view of the ninth temporary display unit, in accordance with some embodiments.
Figure 62:
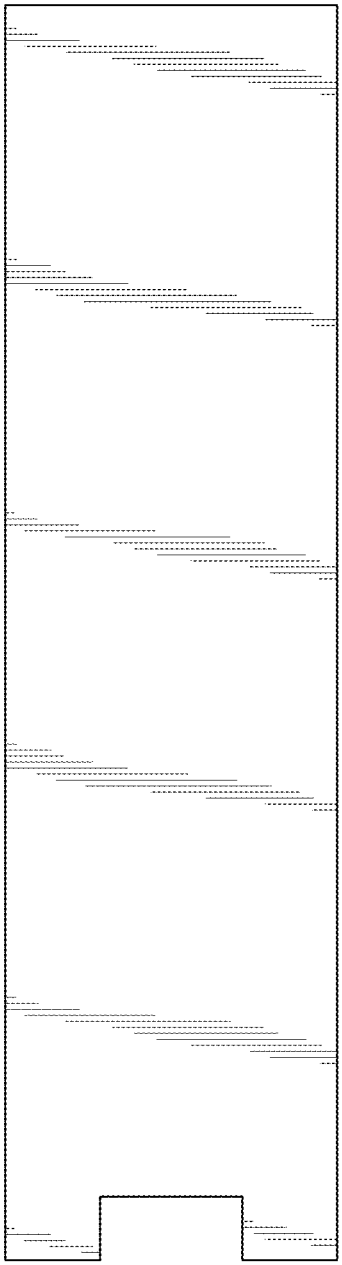
FIG. 62 is a first side view.
Figure 63:
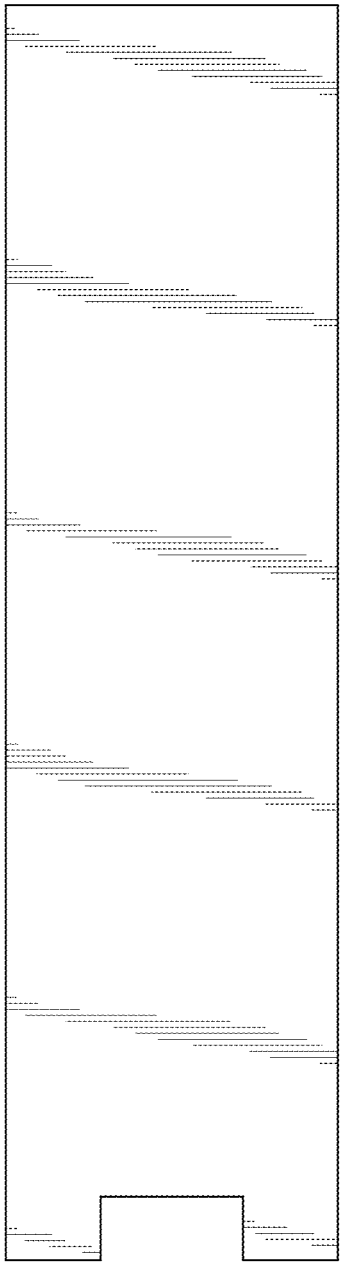
FIG. 63 is a second side view of the ninth temporary display unit, in accordance with some embodiments.
Figure 64:
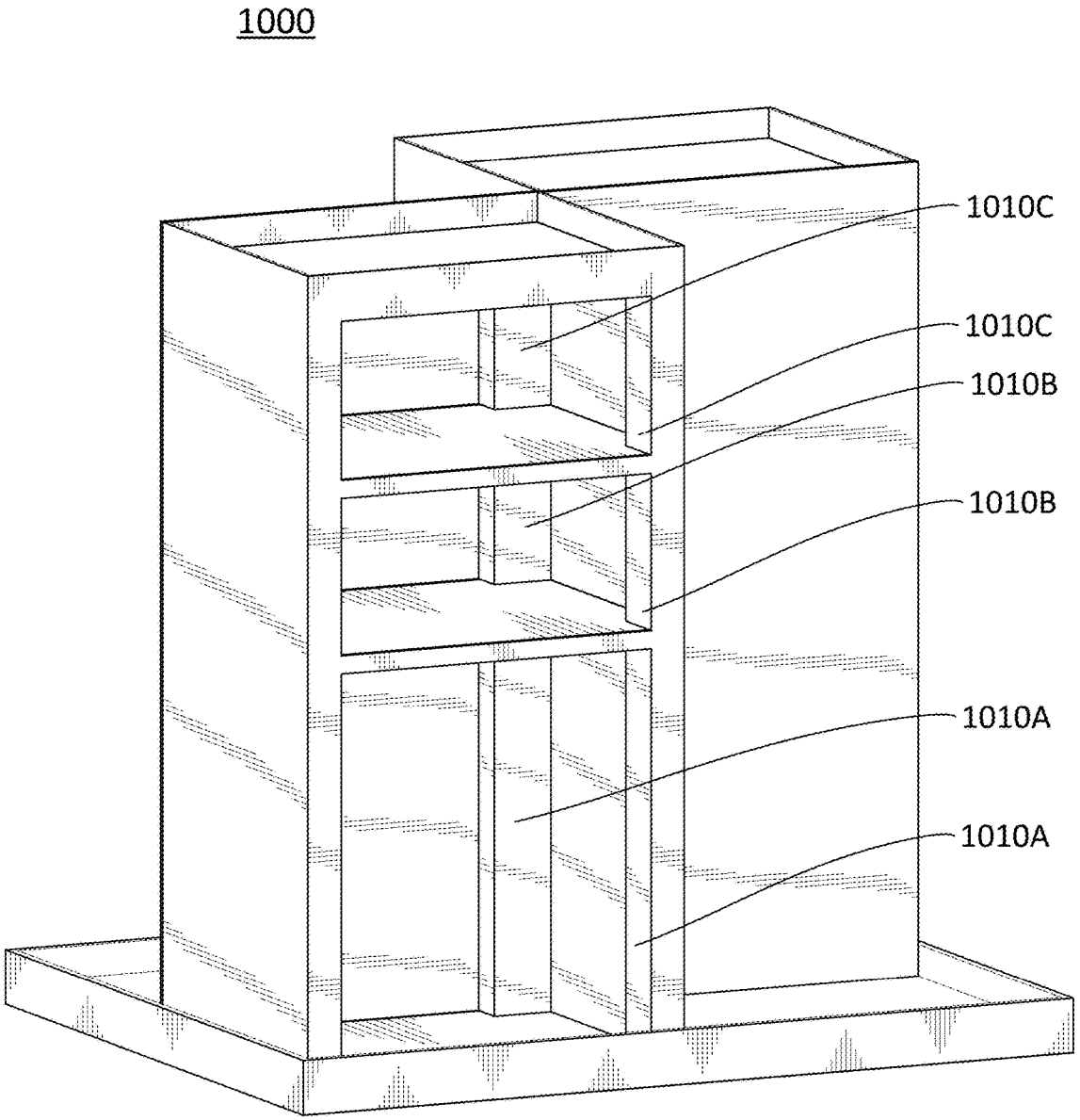
FIG. 64 is a perspective view of a tenth temporary display unit, in accordance with some embodiments.
Figure 65:
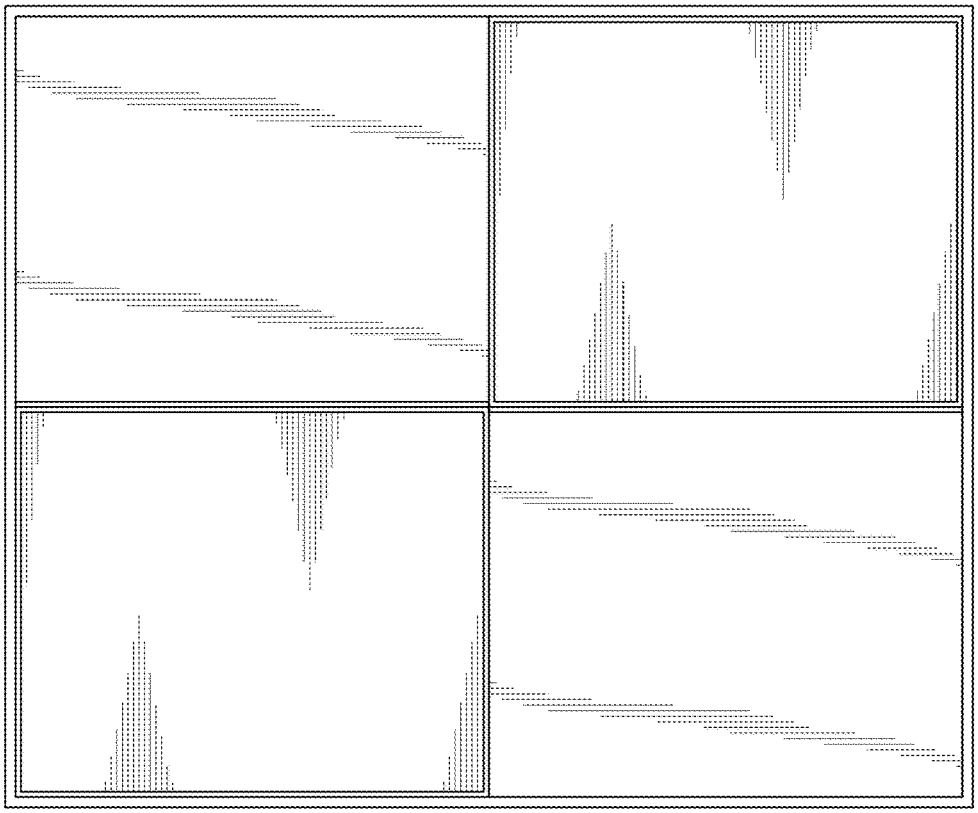
FIG. 65 is a top view.
Figure 66:
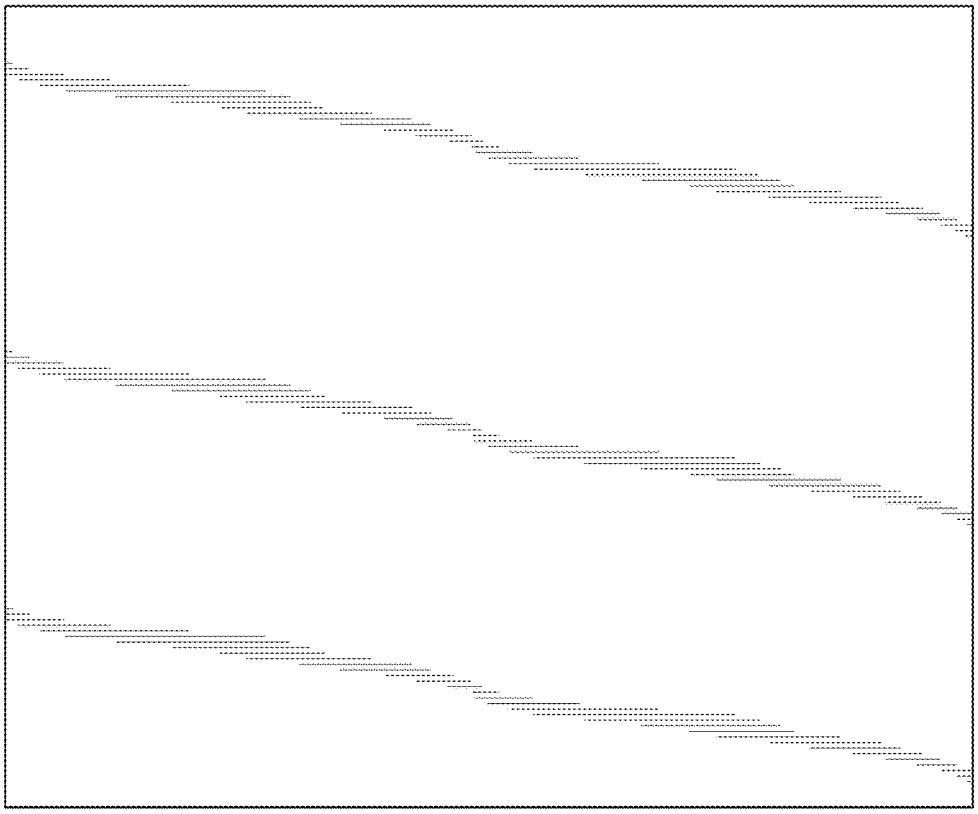
FIG. 66 is a bottom view of the tenth temporary display unit, in accordance with some embodiments.
Figure 67:
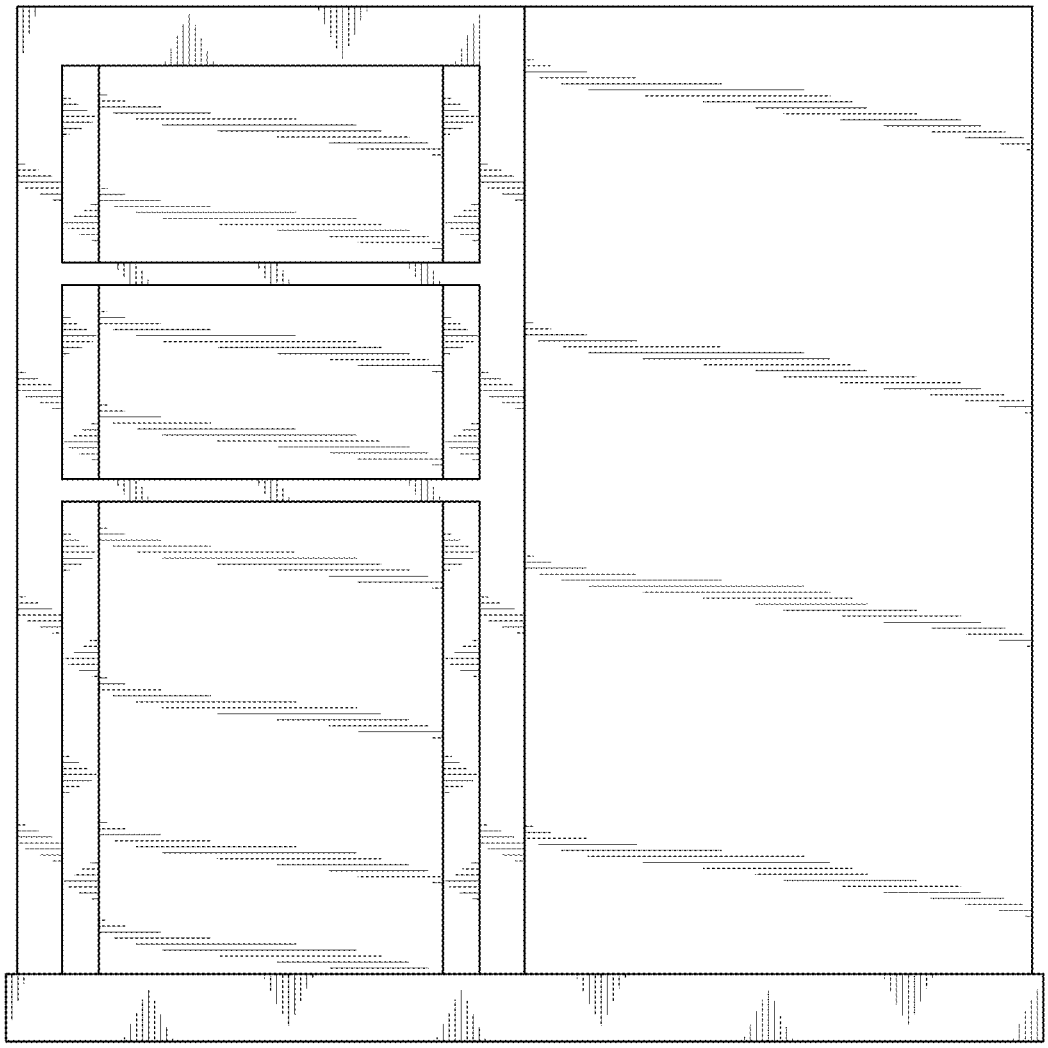
FIG. 67 is a front view.
Figure 68:
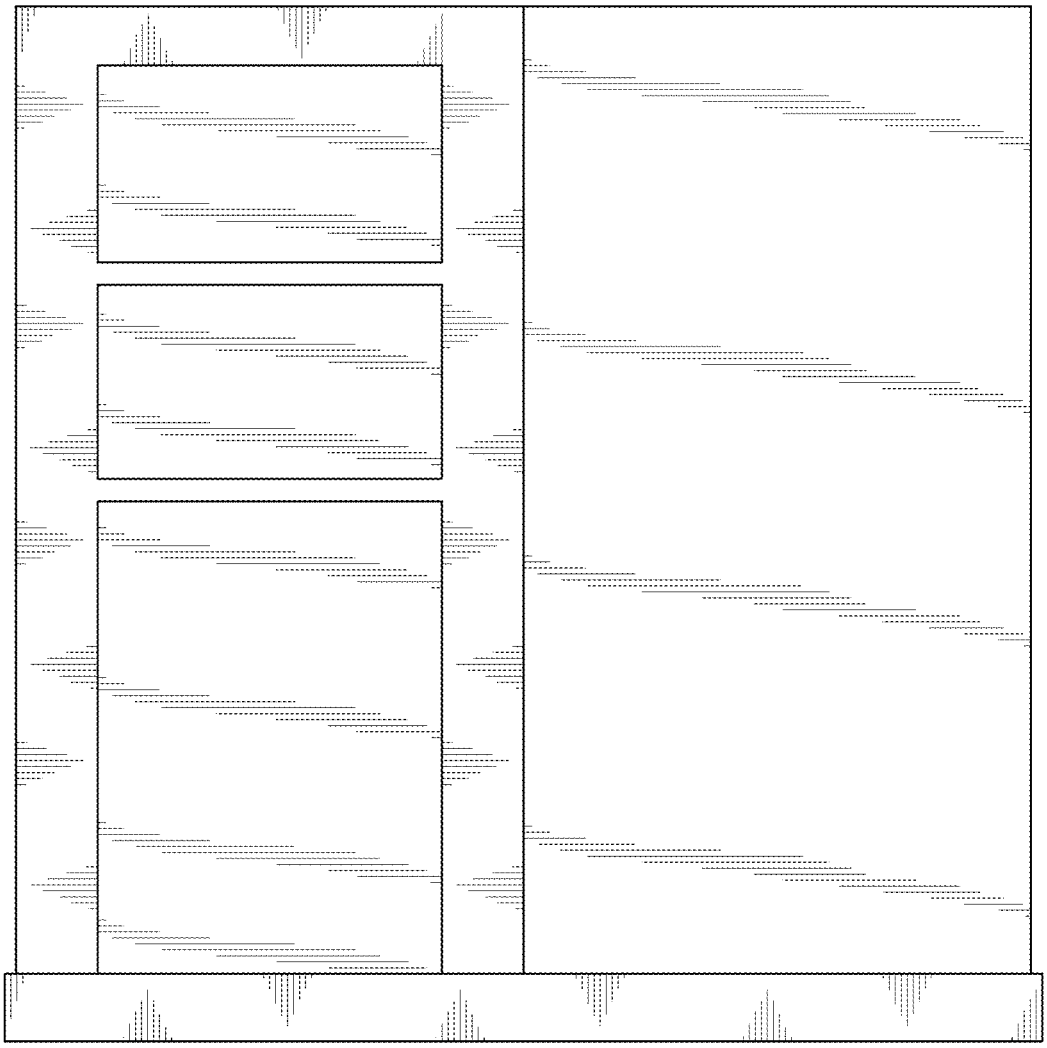
FIG. 68 is a rear view of the tenth temporary display unit, in accordance with some embodiments.

In some embodiments, the display unit 100 includes a frame 130 comprising a first single sheet of material folded into a plurality of vertical panels 140 and a first set of built-in, hollow vertical supports 110A of the plurality of built-in, hollow vertical supports 110. In some embodiments, the plurality of vertical panels 140 includes a vertical front panel 140A, a vertical rear panel 140B, and vertical first and second side panels 140C and 140D. In other embodiments, the frame 130 comprises fewer (e.g., as illustrated in FIG. 43) or more (e.g. as illustrated in FIGS. 29, 36, and 64) vertical panels, depending on specific design considerations for various retail establishments in which the temporary display units will be utilized to hold various types of products.

Figure 4:
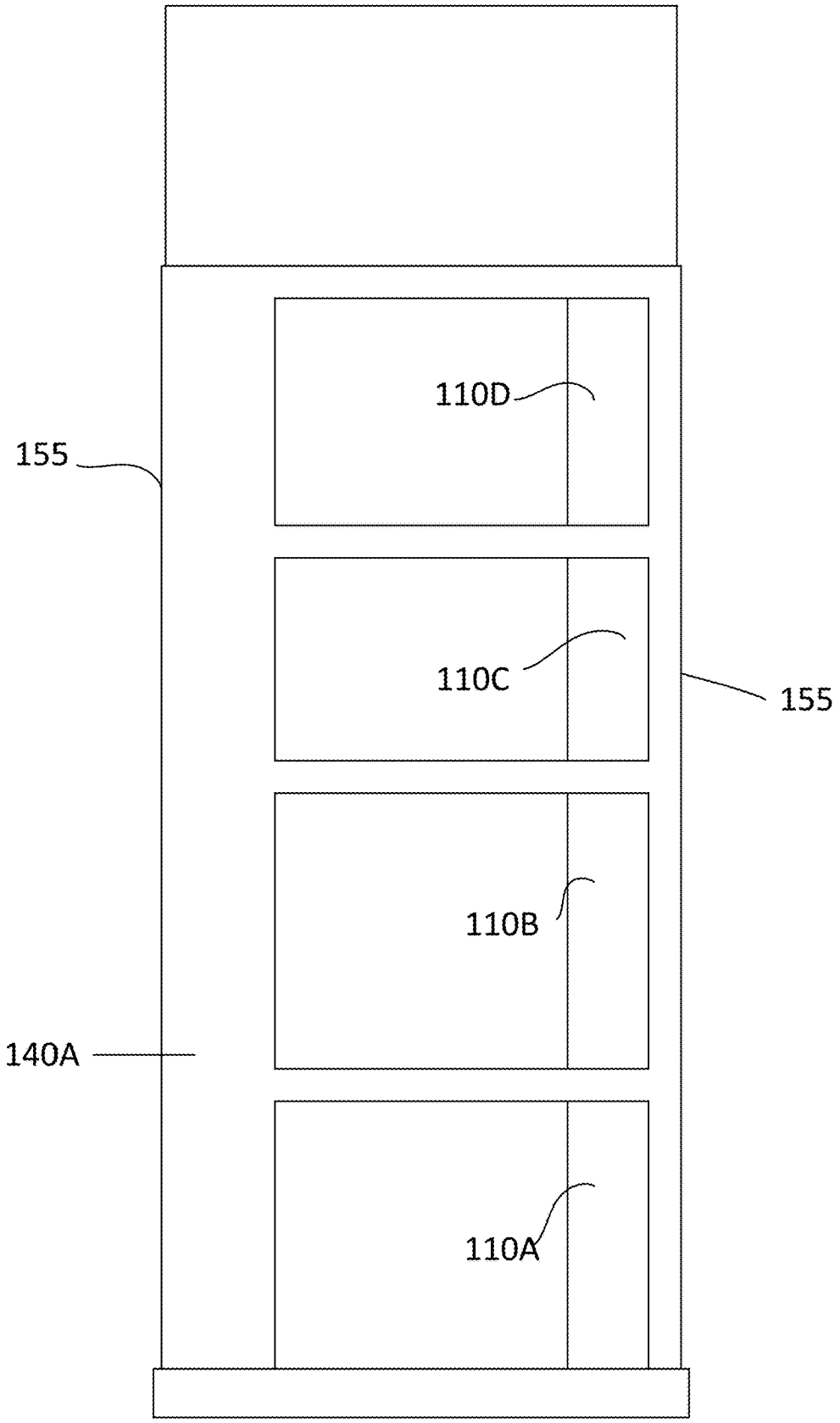
FIG. 4 is a front view.
Figure 5:
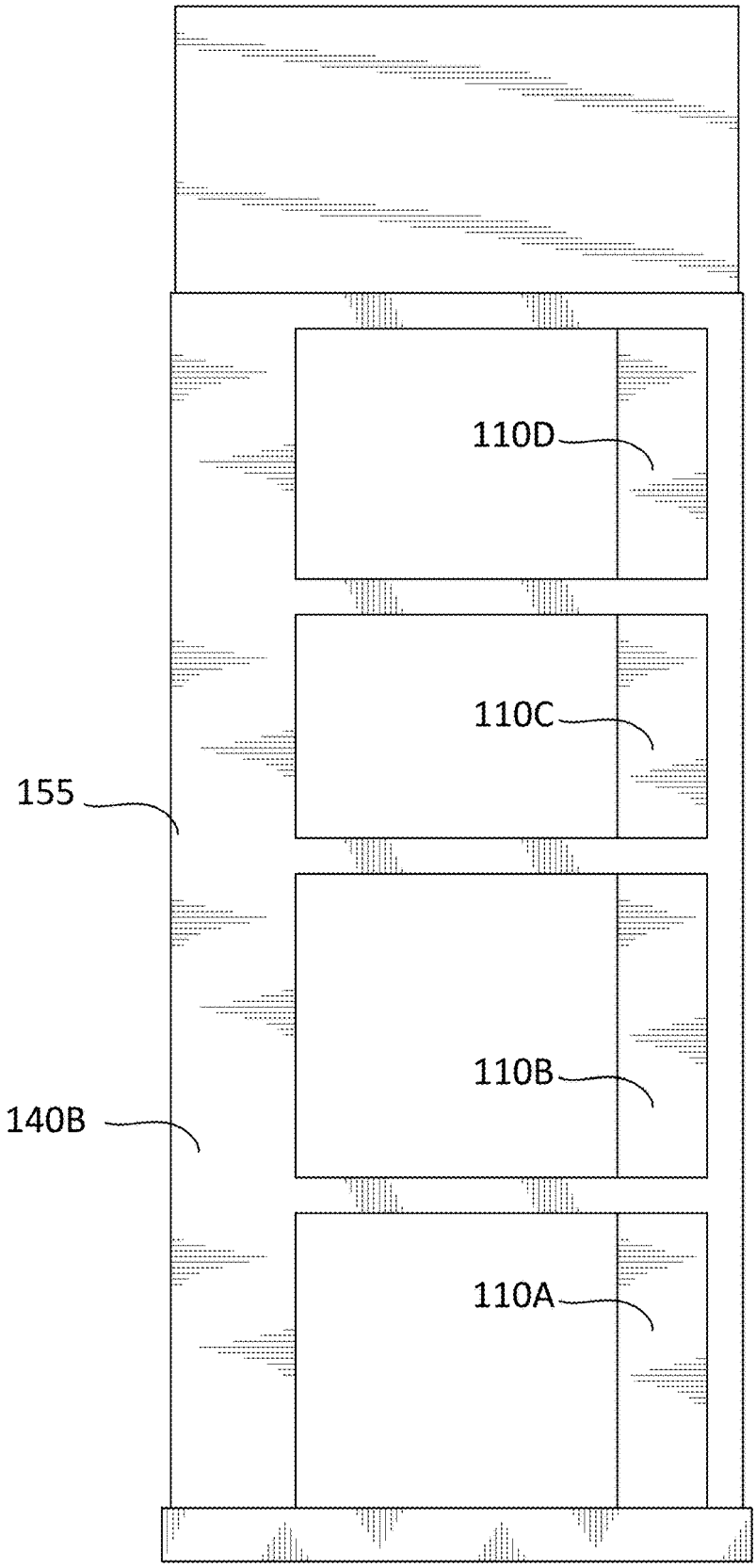
FIG. 5 is a rear view of the first temporary display unit, in accordance with some embodiments.
Figure 6A:
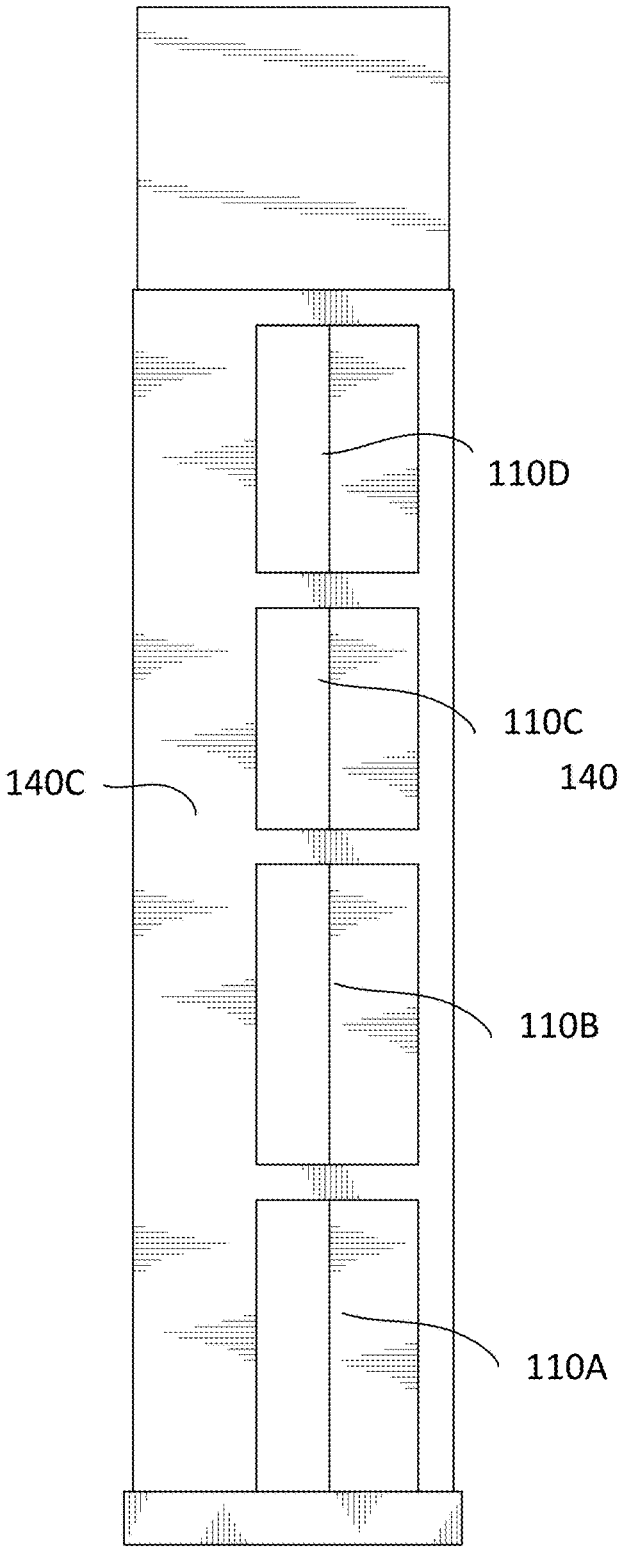
FIG. 6A is a first side view.
Figure 6B:
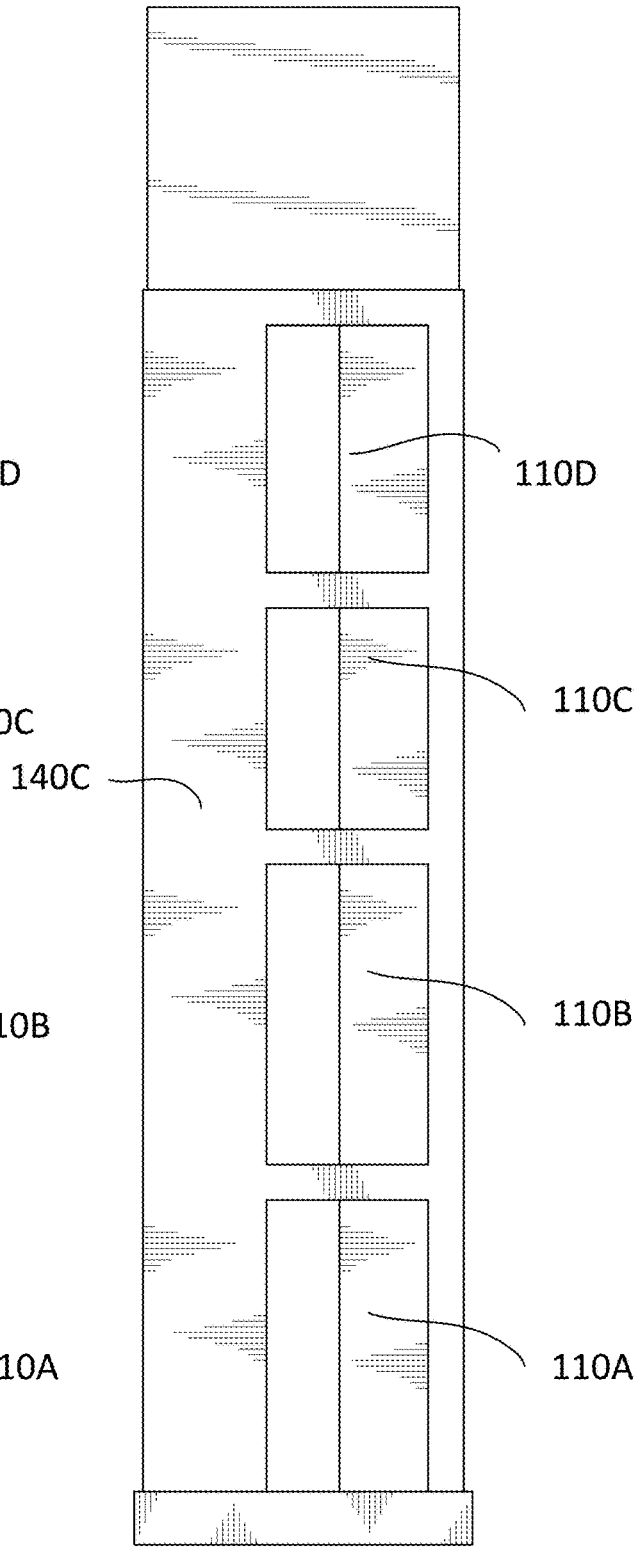
FIG. 6B is a second side view of the first temporary display unit, in accordance with some embodiments.

FIG. 4 is a front view, and FIG. 5 is a rear view of the first temporary display unit 100, in accordance with some embodiments. FIG. 6A is a first side view, and FIG. 6B is a second side view of the first temporary display unit 100, in accordance with some embodiments. As illustrated in FIGS. 1, and 4-6B, each built-in, hollow vertical support 110 contacts one or more of the plurality of vertical panels 140A, 140B, 140C, and 140D. In some embodiments, the frame 130 of the temporary display unit 100 is made of disposable material, i.e., it is a disposable frame 130, but the various embodiments described herein are not limited thereto. As such, the front panel 140A, the rear panel 140B, and the first and second side panels 140C and 140D are made of a disposable material. In some embodiments, the disposable frame 130 is made of recyclable fiber-based materials such as containerboard or a honeycomb cardboard described in more detail with respect to FIG. 7A, but the various embodiments described herein are not limited hereto.

In some embodiments, the frame 130 is a foldable frame (e.g., a chassis, shell, rigid structure, case, casing, body that is capable of collapsing or folding). As shown in FIGS. 1 and 4-7 and Appendix A (of the incorporated-by-reference U.S. Provisional Application No. 62/437,025), the foldable frame 130 includes the front panel 140A, the rear panel 140B, and the first and second side panels 140C and 140D and each vertical panel 140A-140D is coupled with a corresponding adjacent vertical panel 140A-140D via a vertical fold line 155 there between. Thus, in some embodiments, the foldable frame 122 is fully constructed (i.e., each of the panels is already connected without having to attach them using an adhesive as explained above) prior to shipping the components of the display unit.

In some embodiments, the frame 130 is affixed with display graphics (i.e., the display graphics are either permanently affixed or temporarily/removably attached). In some embodiments, the display graphics (also referred to herein as graphics or graphics layer) cover substantially all of the exterior surface(s) of the front panel 140A, the rear panel 140B, and the first and second side panels 140C and 140D. In some embodiments, the rear panel 140B has display graphics only partially covering its exterior surface. In other embodiments, substantially all of or the majority of the rear panel 140B is also affixed with display graphics (i.e., the display graphics are either permanently affixed or temporarily/removably attached to the rear panel 140B).

In some embodiments, the display graphics are designed (or configured to) cover slots extending through the exterior surfaces of the front panel 140A, rear side panel 104, and/or second side panel 106. In some embodiments, the display graphics are pre-adhered (e.g., attached using any known adhering technique, including magnets, hooks, adhesives, staples, sewing, and the like) to the front, rear, and first and second side panels of the foldable frame 130 (e.g., to an exterior surface of each vertical panel), while in other embodiments, the display graphics are not initially adhered (i.e., when the display unit 100 is shipped, the exterior surfaces of the vertical panels are not attached to the display graphics). In these other embodiments, the display graphics are included separately from the vertical panels and are adhered at a later point in time. In this way, the exterior surfaces appear smooth and only the display graphic is visible, creating a pleasing and attractive aesthetic appearance on the exterior surfaces of the temporary display unit (e.g., an exterior surface of each of the vertical panels).

In some embodiments, as illustrated in FIGS. 1, and 4-6B, the temporary display unit 100 includes the one or more of shelves 120, which are configured to be supported by the plurality of built-in, hollow vertical supports 110 of the frame 130. More specifically, the display unit 100 further includes a first shelf 120A of the one or more shelves 120 disposed within the frame 130 and supported by each built-in, hollow vertical support 110 of the first set of built-in, hollow vertical supports 110A. For example, each corner of a respective shelf 120 contacts a top portion of a respective built-in, hollow vertical support 110, so that the respective shelf 120 is supported at each of its corners by the built-in, hollow vertical supports 110. In some embodiments, the shelves 120 are made of a disposable material, i.e., they are disposable shelves 120. Similarly to the frame 140, in some embodiments, the shelves 114 may be affixed with display graphics on substantially all of the showing assembled surfaces (i.e., the display graphics are either permanently affixed or temporarily/removably attached to the shelves). In other embodiments, only the top surface of the shelf is affixed with display graphics that may indicate a place at which products should be placed prior to shipment (for embodiments in which the temporary display unit is fully packed prior to shipment) or a place at which products should be placed once the display unit reaches a retail establishment.

As discussed below with respect to FIG. 7A, each shelf 120 is typically a disposable shelf 120 made of recyclable fiber-based materials such as containerboard or a honeycomb cardboard. In some embodiments, each shelf 120 is supported by a corresponding set of built-in, hollow vertical supports 110 that is configured to support at least 100 pounds of merchandise weight on a respective shelf 120. In some embodiments each shelf 120 is made of recyclable fiber-based materials such as containerboard or a honeycomb cardboard with a thickness of an inch and is configured to support more than 45 lbs. (e.g., 60, 65, 70, 75 lbs., up to 100 lbs.) when each shelf 114 is supported by the plurality of built-in vertical supports.

Figure 7A:
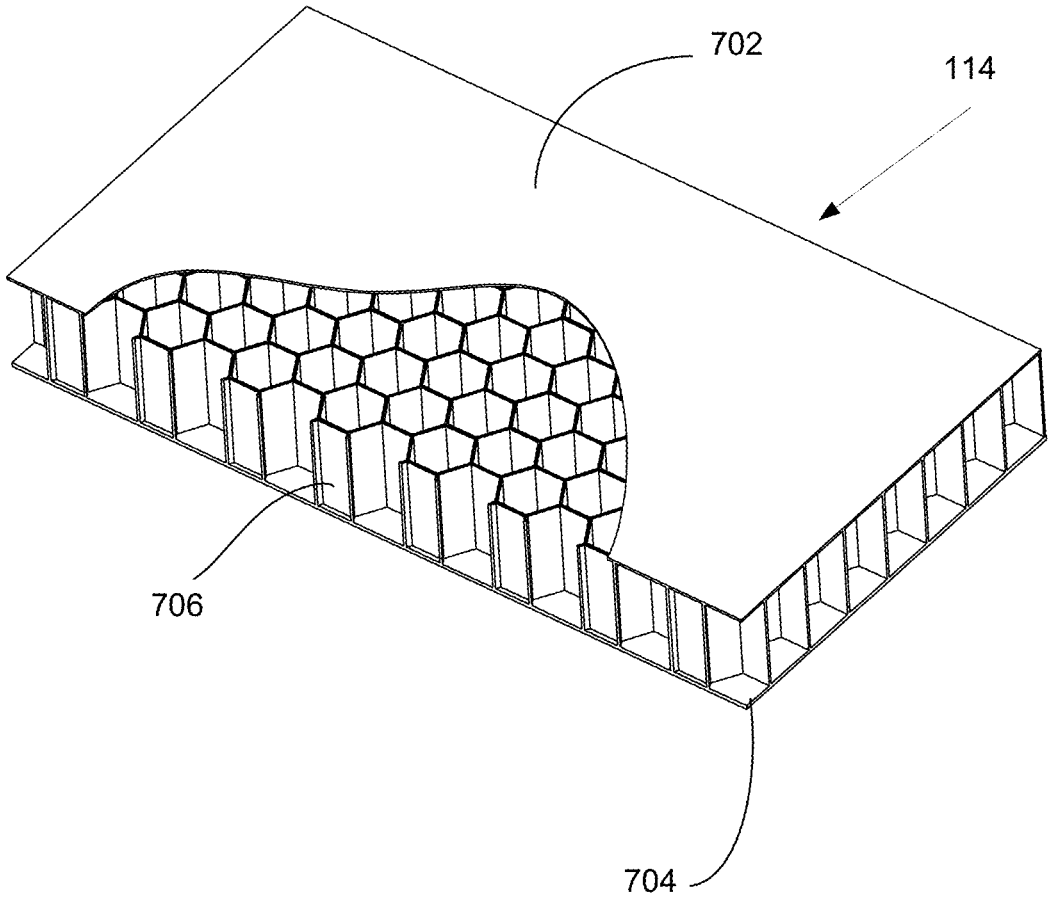
FIG. 7A is a perspective detailed view of a honeycomb material used to make the panels and shelves of the temporary display unit, in accordance with some embodiments.

FIG. 7A is a perspective detailed view of a honeycomb material 700 used to make the one or more shelves 120, and in some embodiments, the plurality of vertical panels (e.g., the single sheet of material used to construct the front panel 140A, rear panel 140B, and first and second side panels 140C and 140D, in accordance with some embodiments). In some embodiments, the honeycomb material 700 is disposable. For instance, in some embodiments, it is made of recyclable fiber-based materials. Thus, these components can be recycled by using existing fiber recycling supply chains at retailers or by using a vendor's internal supply chains. In some embodiments, the honeycomb cardboard material 700 components (i.e., the first single sheet of material comprising the frame 130, and/or the more or more shelves 120 are each less than ¼ of an inch in thickness. In other embodiments, the honeycomb cardboard material 700 components are each approximately ¾ of an inch thick, as opposed to more traditional corrugated cardboard which is typically approximately ⅛ of an inch thick. In some embodiments, the components are made of a honeycomb cardboard 700 material having a thickness of at least half an inch. In some embodiments, the honeycomb cardboard 700 consists of a top layer 702, a bottom layer 704, and a honeycomb shaped internal layer 706, wherein each honeycomb cell has a hexagonal cross section. This honeycomb material 700 allows the components of the temporary display rack 100 to be stronger and lighter than a corresponding corrugated cardboard component. Additionally, the honeycomb cardboard weighs approximately 30% less than a corresponding corrugated cardboard component. As such, the display unit 100 is not only cheaper to ship, but also easier to recycle and even requires less paper for initial construction, which consequently leaves a smaller carbon footprint. In some embodiments, the first single sheet of material from which the frame 130 is formed is a cardboard material having a thickness of less than ¼ of an inch. Furthermore, in some embodiments, each one of the one or more shelves 120 comprises a cardboard material having a honeycomb-shaped cross-section similar in shape to that of the single sheet of material. In other embodiments, each of the one or more shelves 120 is a cardboard material having the honeycomb-shaped cross-section distinct in shape to that of the single sheet of material.

Figure 7B:
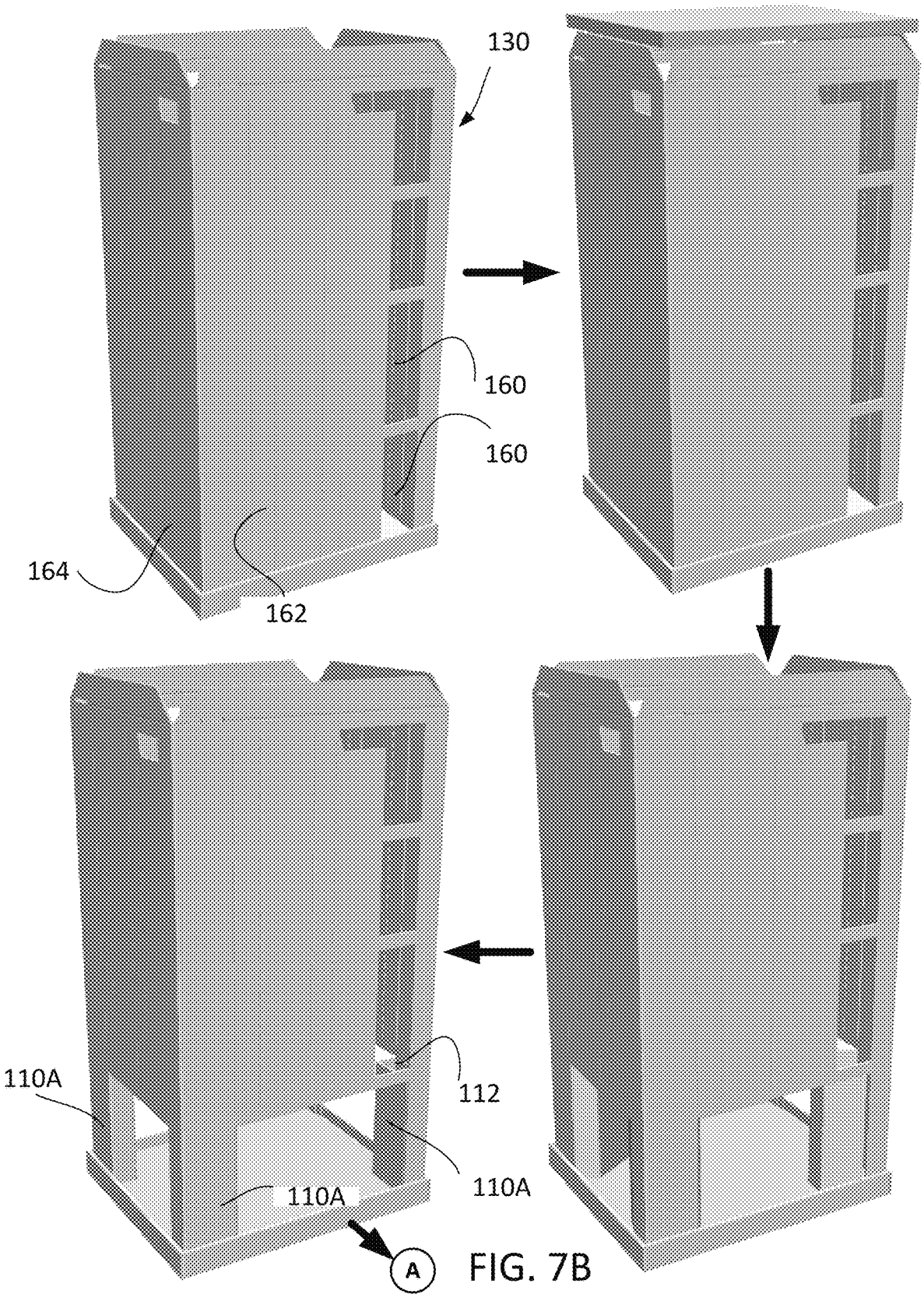
FIGS. 7B and 7C include illustrations for a method of assembling a foldable frame of the temporary display unit into a temporary display unit that includes a plurality of built-in, hollow vertical supports for supporting one or more shelves, in accordance with some embodiments.
Figure 7C:
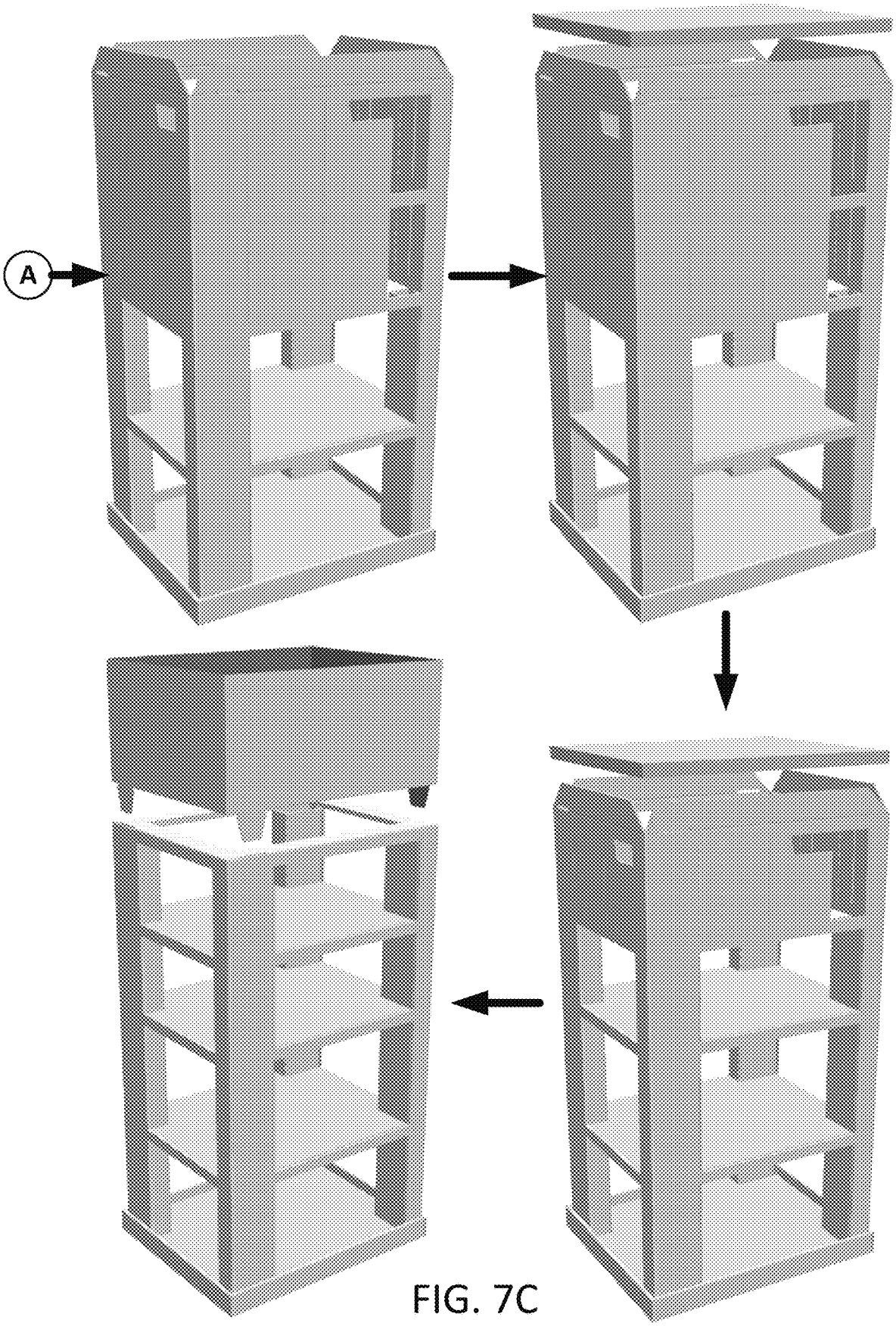

FIGS. 7B and 7C include illustrations for a method of assembling the foldable frame 130 of the temporary display unit 100 to include the plurality of built-in, hollow vertical supports 110 for supporting the one or more shelves 120, in accordance with some embodiments. In some embodiments, the method is performed by an employee at a shipping location for a manufacturer or designer of the display unit (e.g., a print procurement company that designs the display unit and provides the display unit to suppliers, retailers, and/or merchants). For ease of explanation, the following describes this method as performed by such an employee. Some operations in this example method are, optionally, combined and/or the order of some operations is, optionally, changed.

In some embodiments, each of the plurality of built-in, hollow vertical supports 110 is formed from a respective predefined section of a first single sheet of material. Specifically, each of the vertical panels 140A-140D (which are all a part of a single sheet of material) is partitioned into specific predefined sections from which each of the built-in, hollow vertical supports is formed, accounting for desired heights and widths of each of the built-in, hollow vertical supports. In some embodiments, the first single sheet of material is split, sectioned, and folded to form respective built-in, hollow vertical supports.

Figure 8:
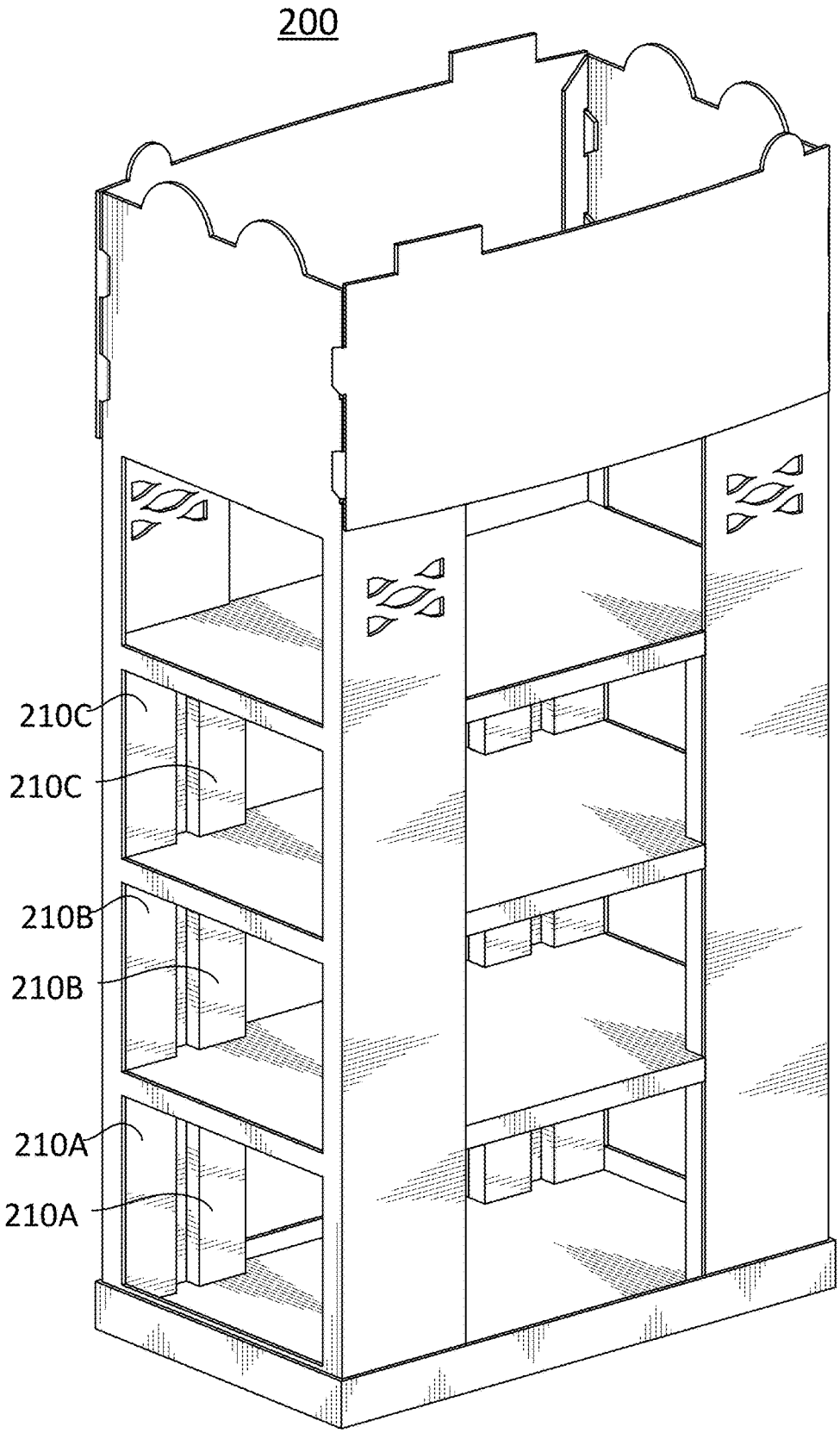
FIG. 8 is a perspective view of a second temporary display unit, in accordance with some embodiments.
Figure 9:
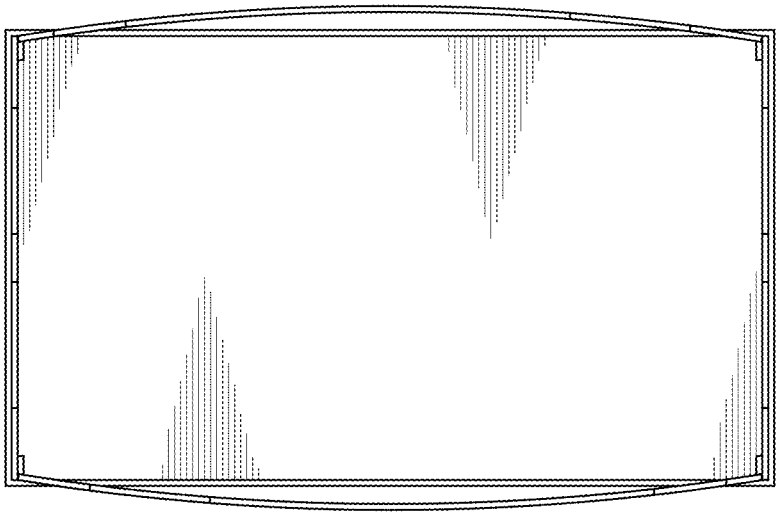
FIG. 9 is a top view.
Figure 10:
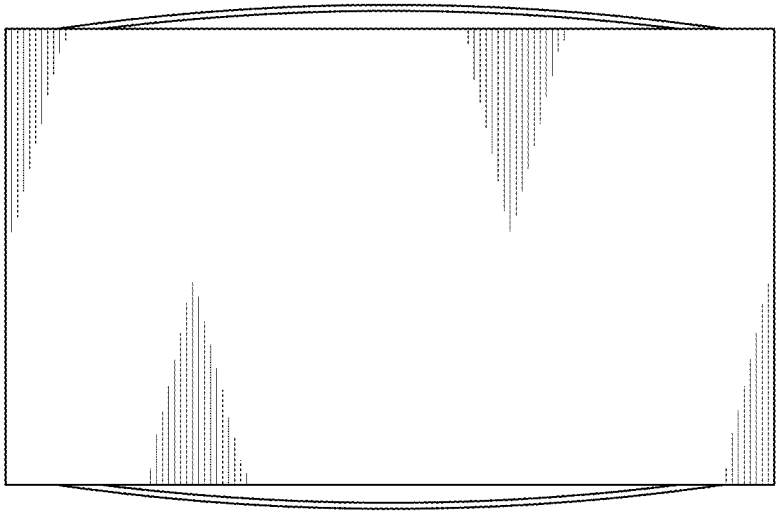
FIG. 10 is a bottom view of the second temporary display unit, in accordance with some embodiments.
Figure 11:
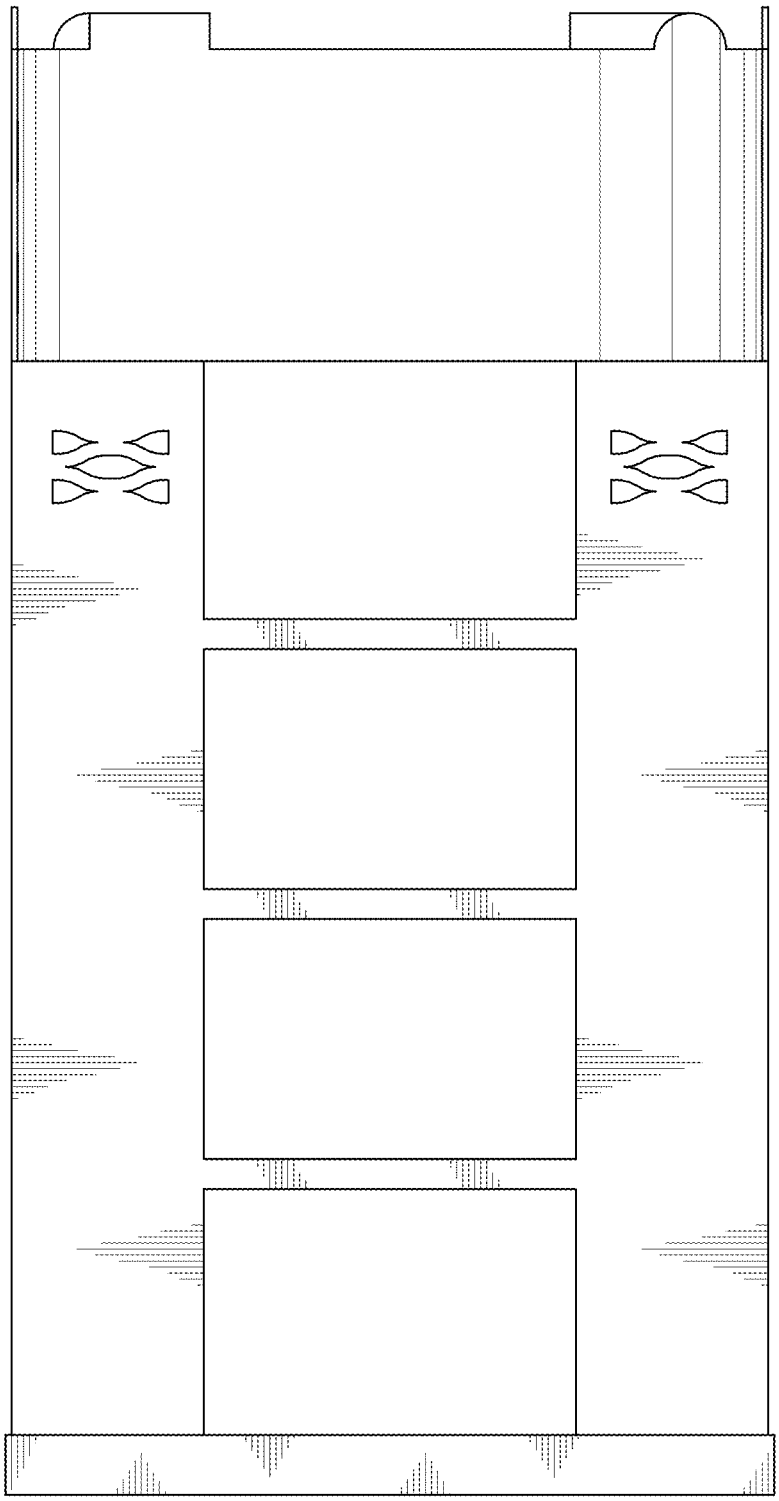
FIG. 11 is a front view.
Figure 12:
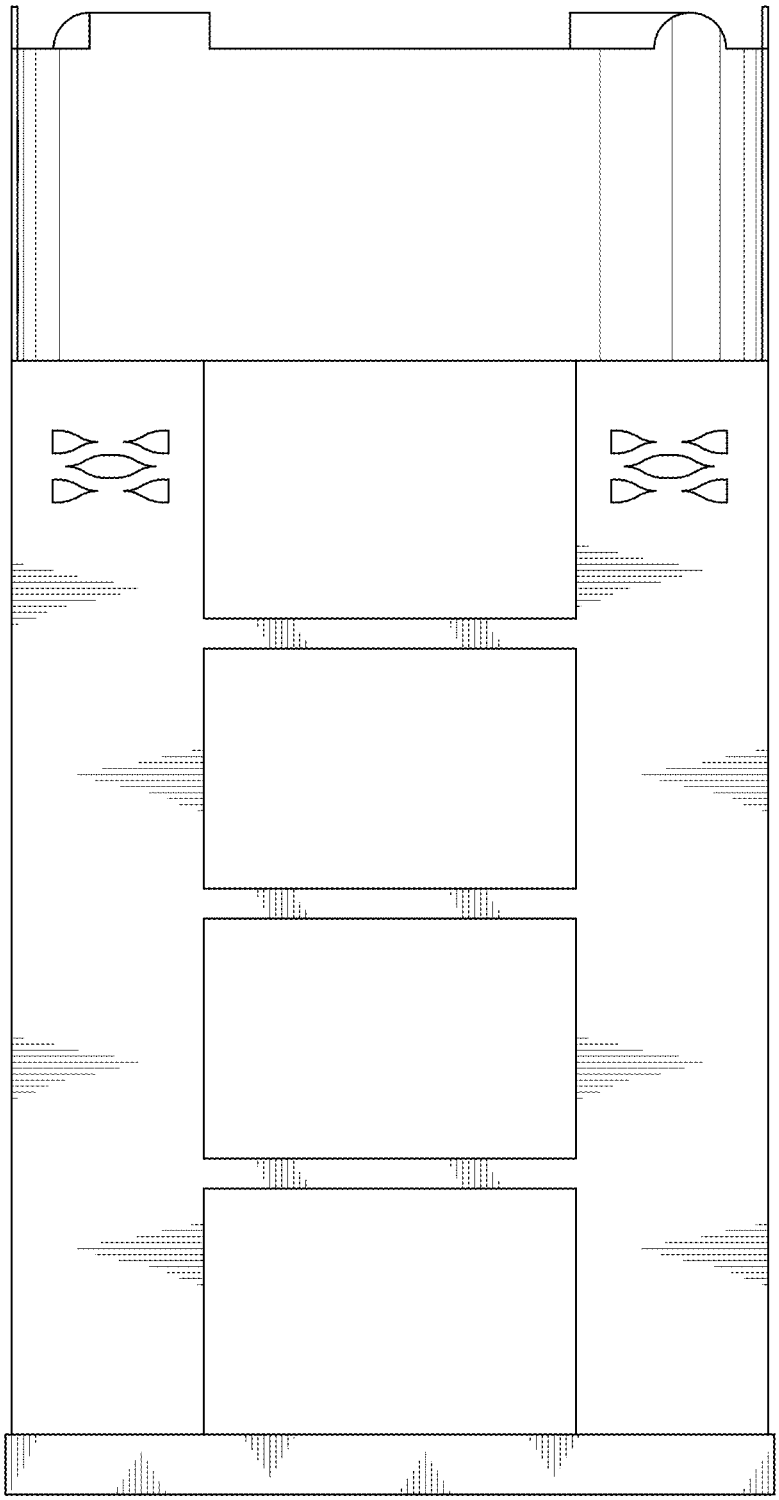
FIG. 12 is a rear view of the second temporary display unit, in accordance with some embodiments.
Figure 13:
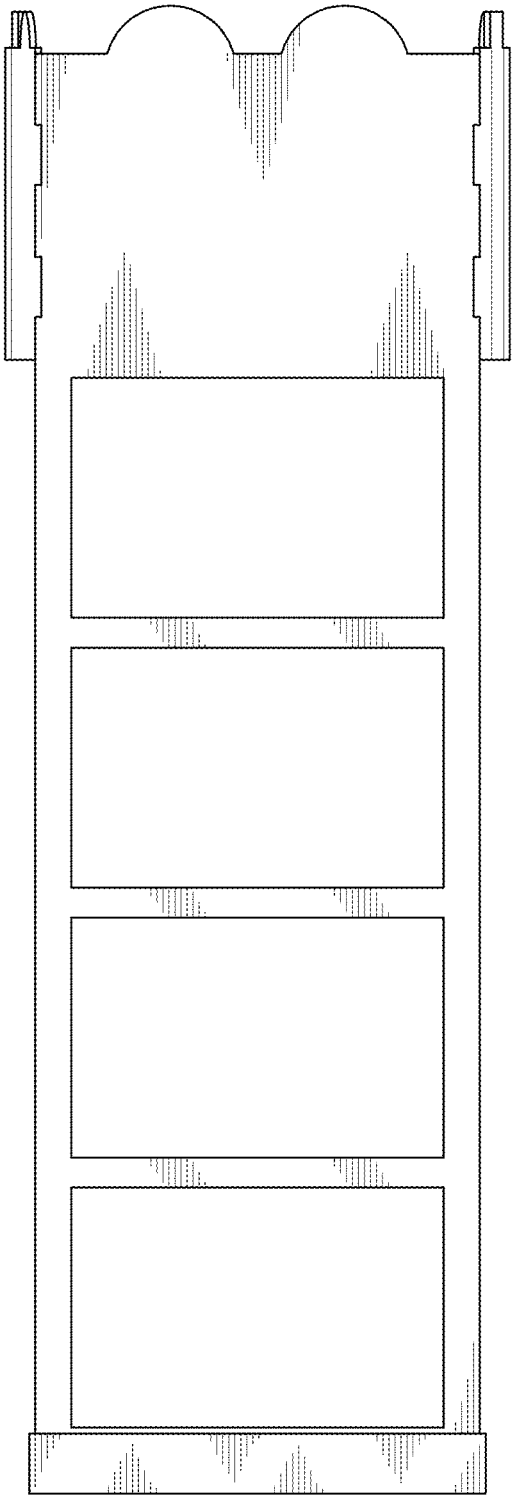
FIG. 13 is a first side view.
Figure 14:
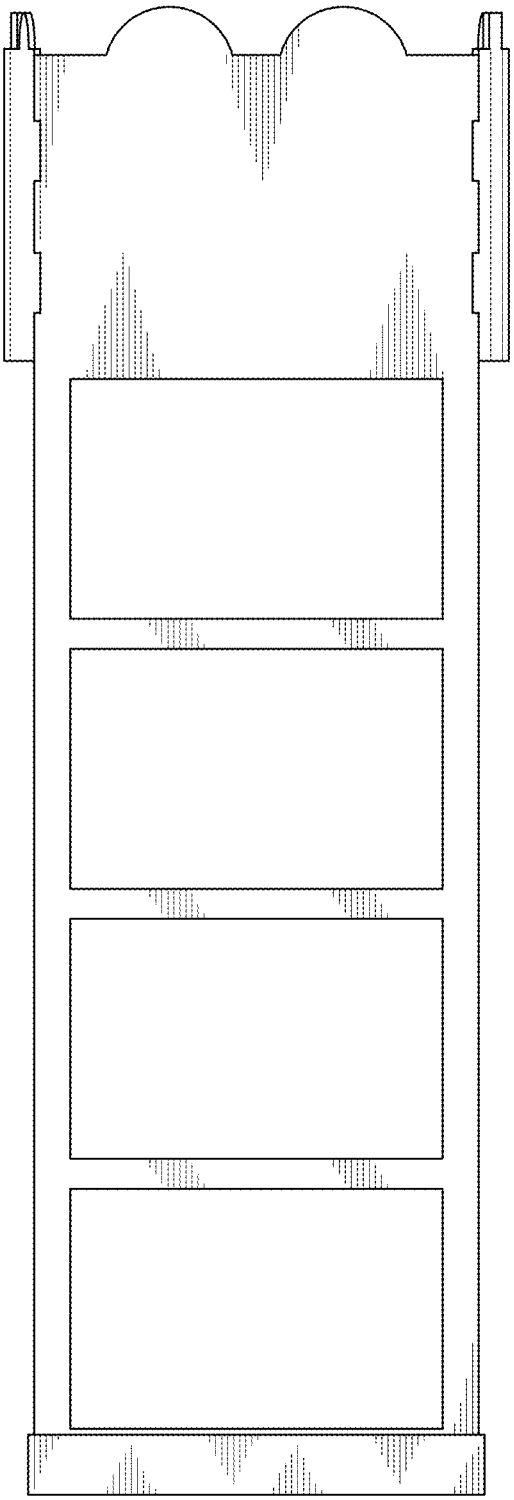
FIG. 14 is a second side view of the second temporary display unit, in accordance with some embodiments.
Figure 15:
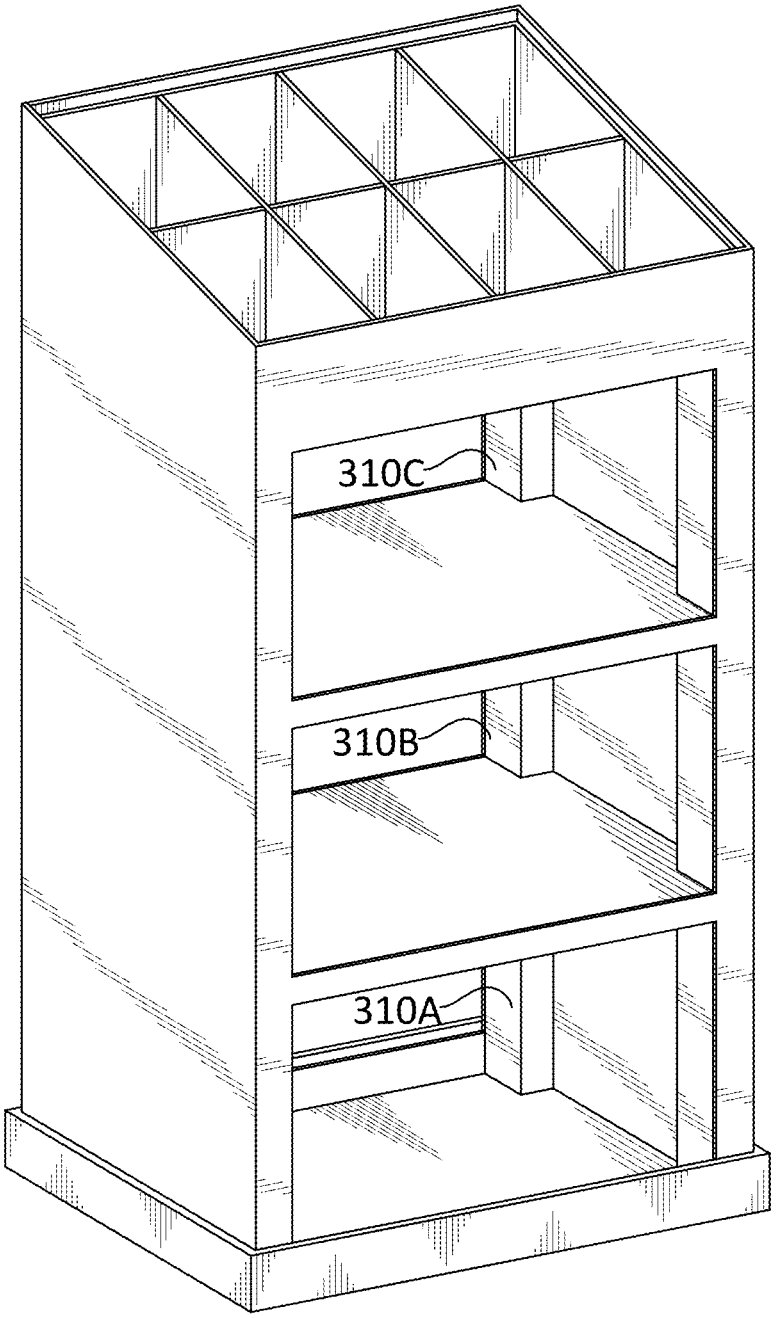
FIG. 15 is a perspective view of a third temporary display unit, in accordance with some embodiments.
Figure 16:
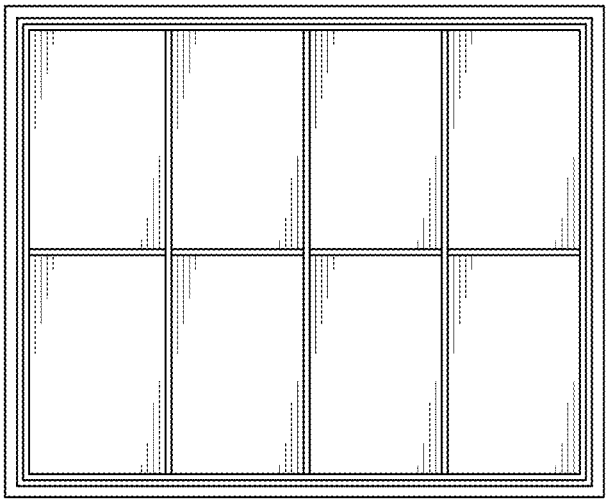
FIG. 16 is a top view.
Figure 17:
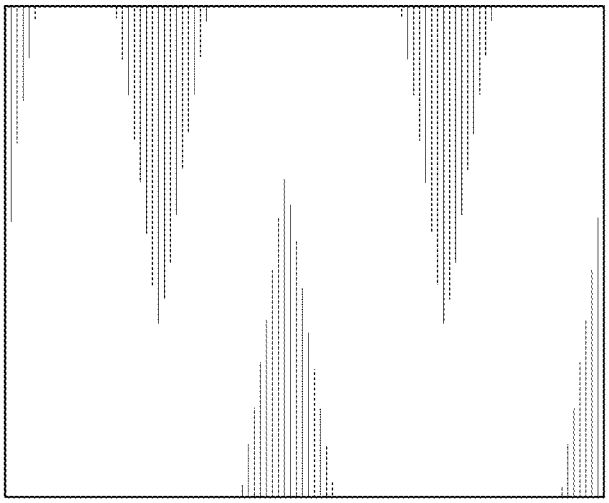
FIG. 17 is a bottom view of the third temporary display unit, in accordance with some embodiments.
Figure 18:
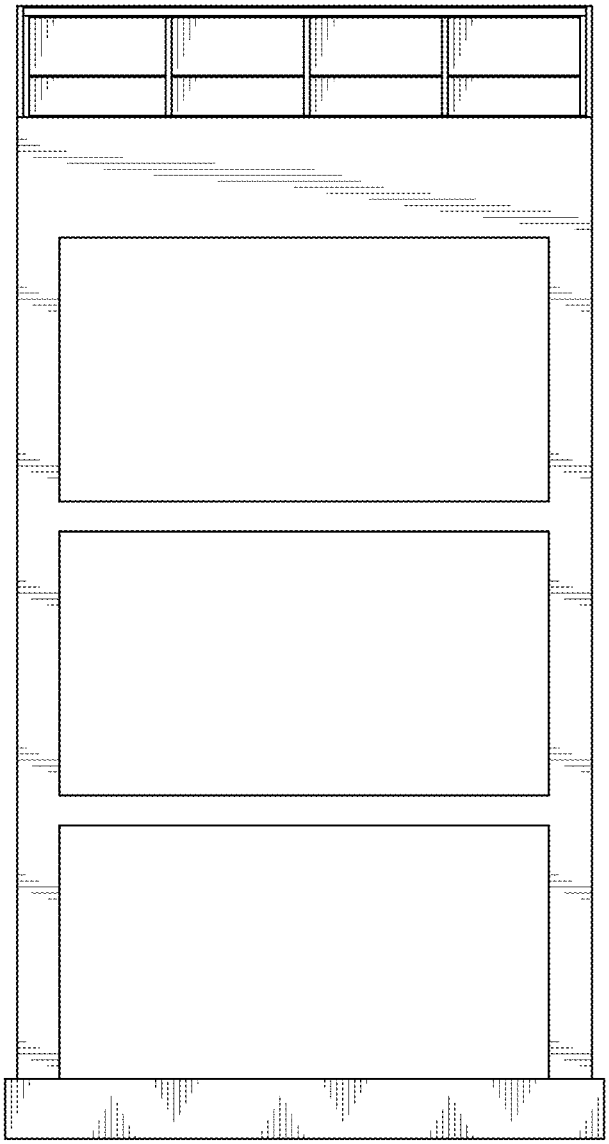
FIG. 18 is a front view.
Figure 19:
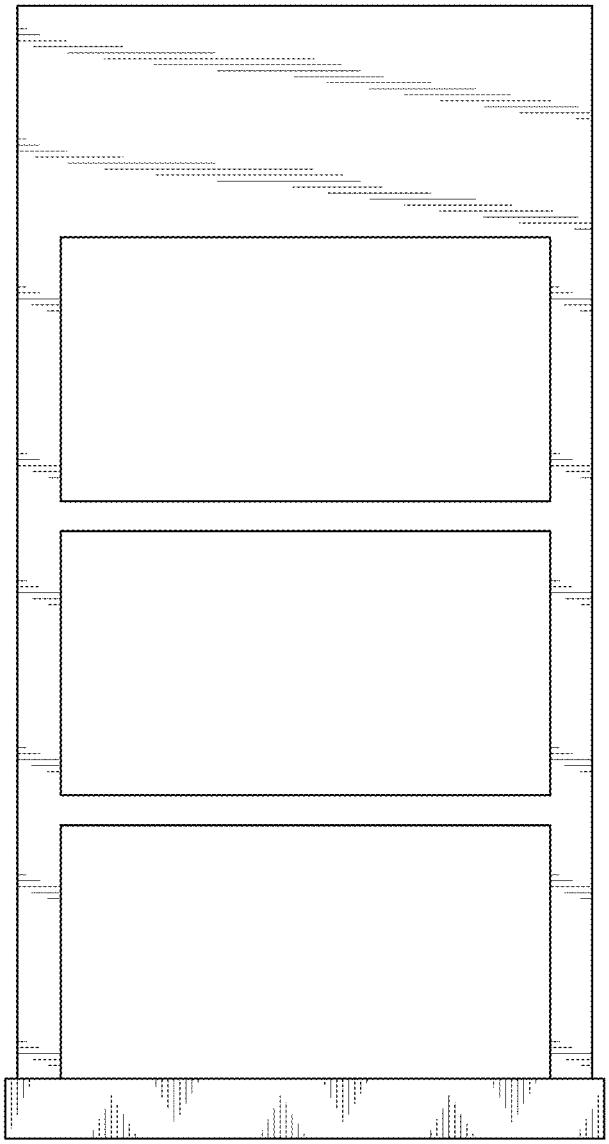
FIG. 19 is a rear view of the third temporary display unit, in accordance with some embodiments.
Figure 20:
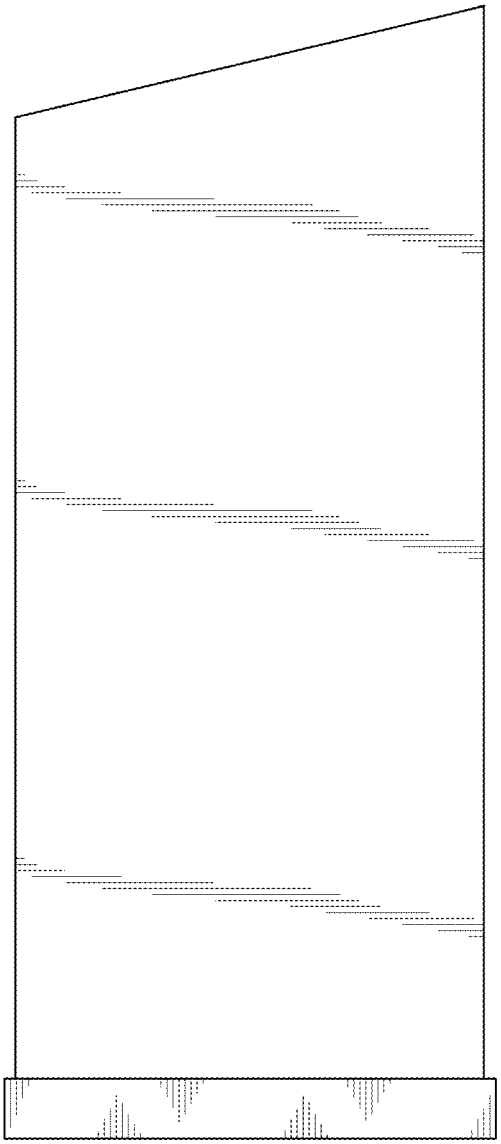
FIG. 20 is a first side view.
Figure 21:
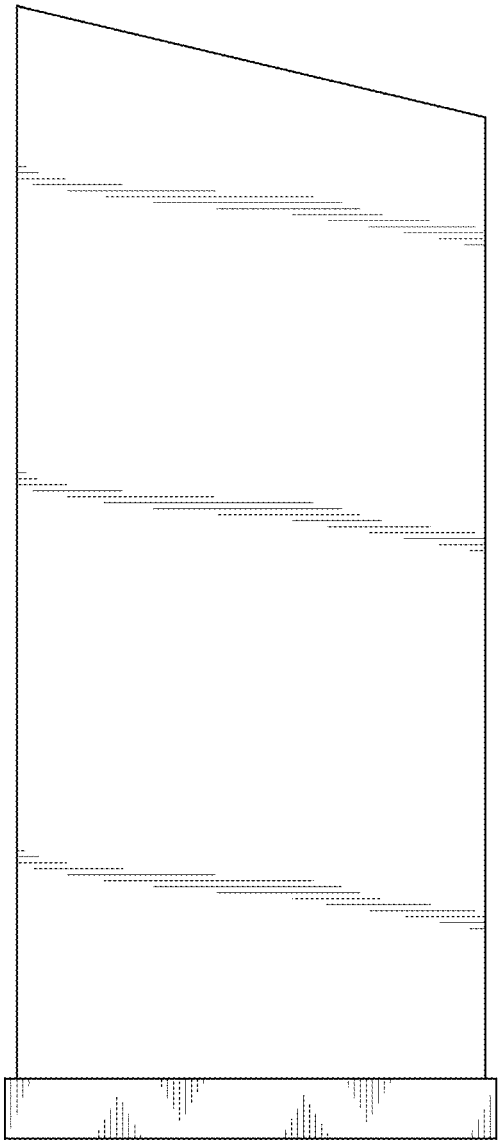
FIG. 21 is a second side view of the third temporary display unit, in accordance with some embodiments.
Figure 22:
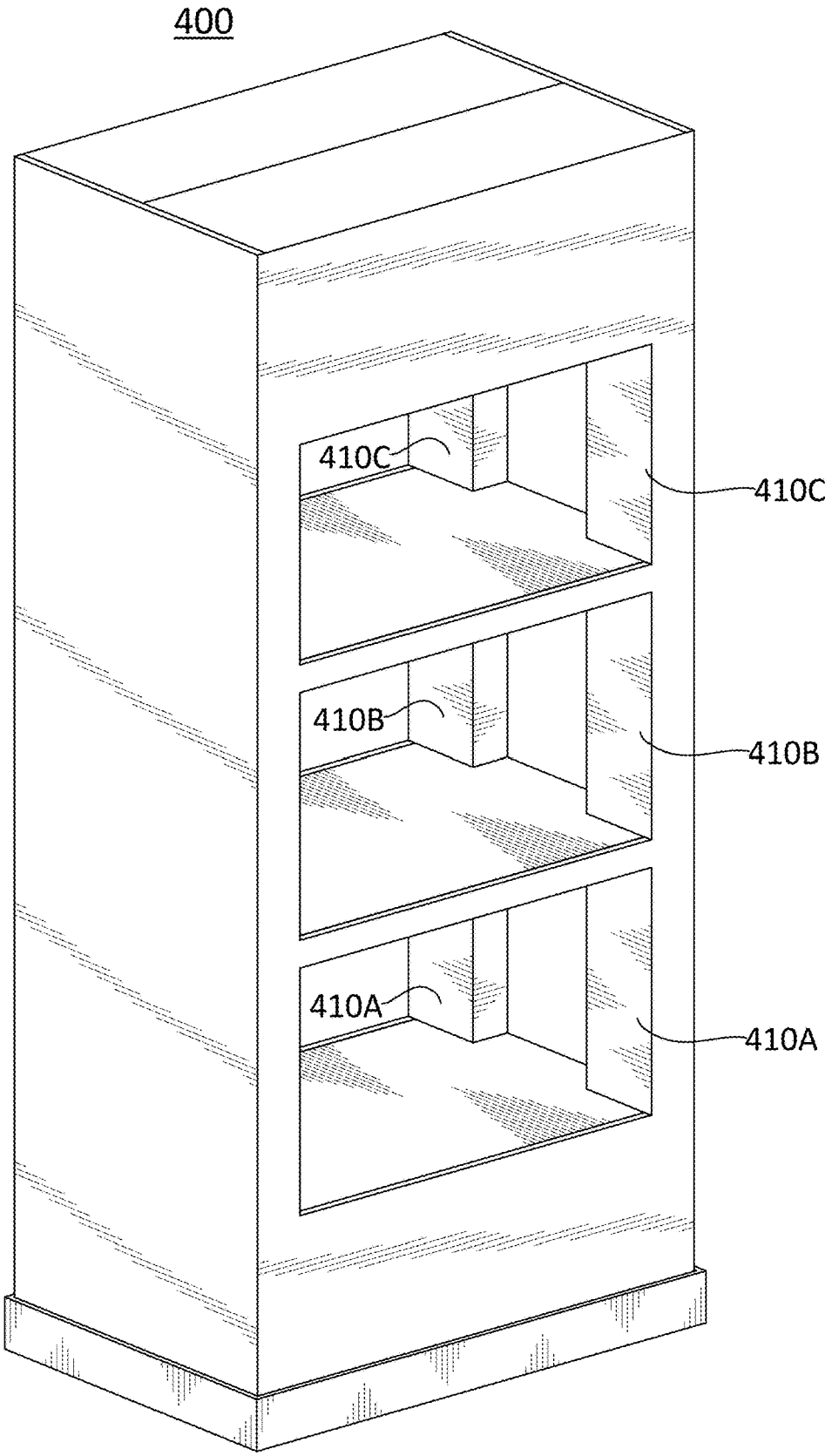
FIG. 22 is a perspective view of a fourth temporary display unit, in accordance with some embodiments.
Figure 23:
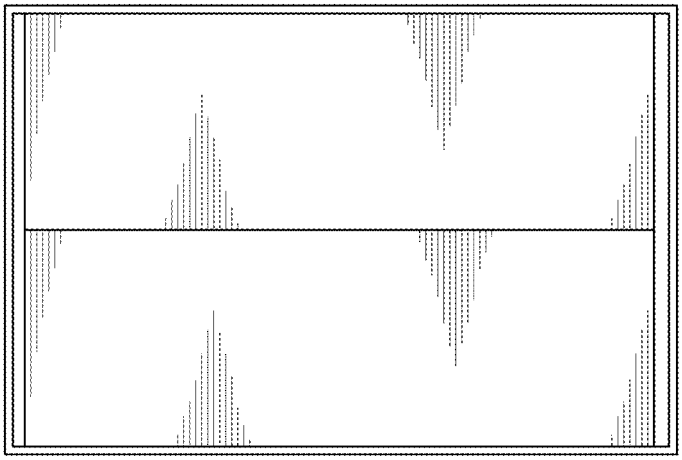
FIG. 23 is a top view.
Figure 24:
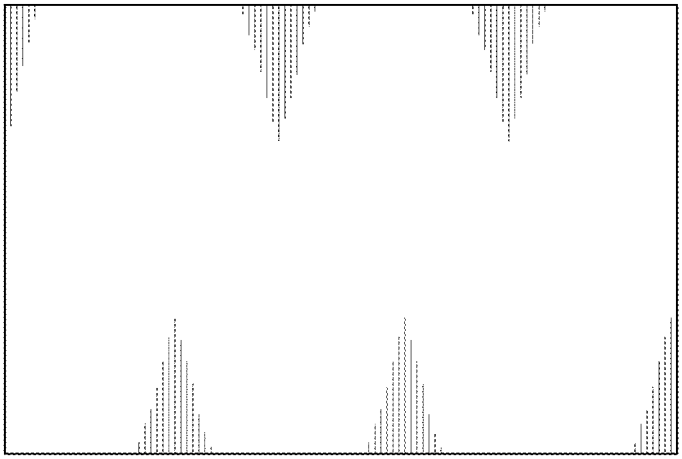
FIG. 24 is a bottom view of the fourth temporary display unit, in accordance with some embodiments.
Figure 25:
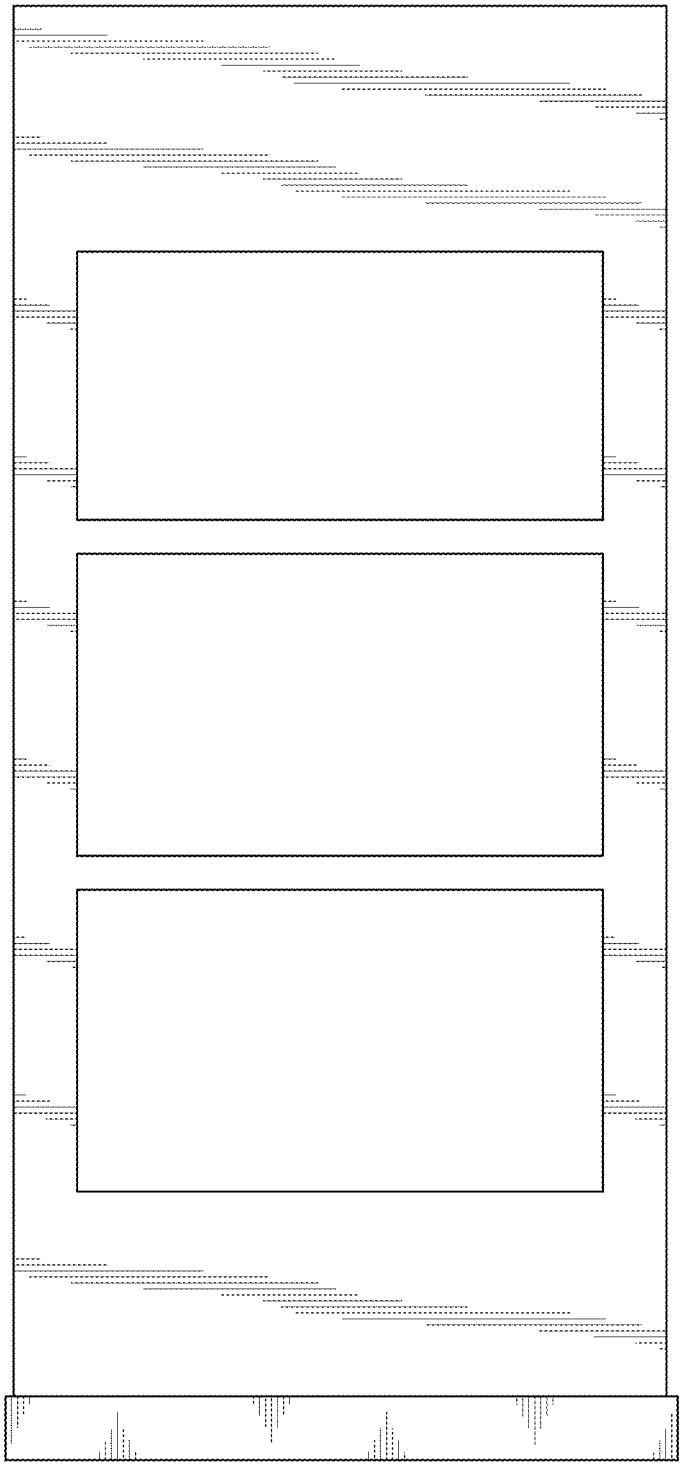
FIG. 25 is a front view.
Figure 26:
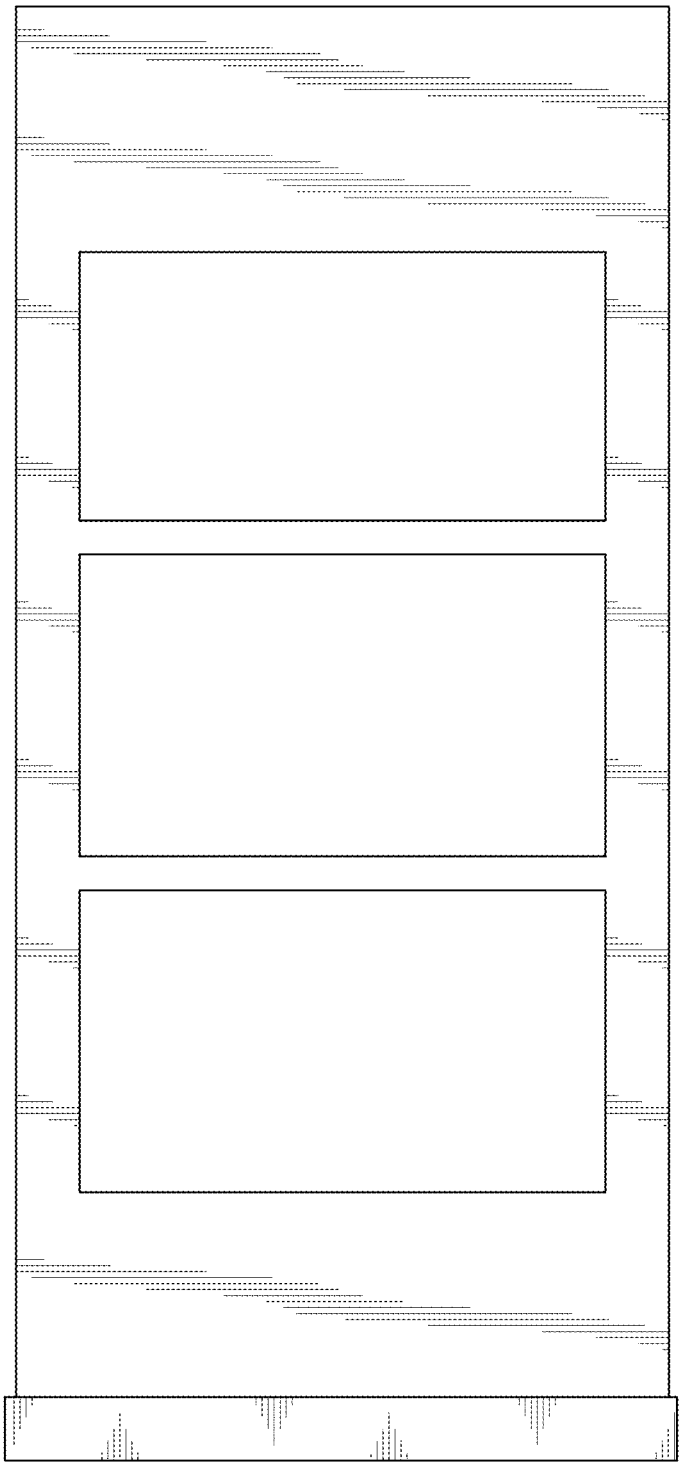
FIG. 26 is a rear view of the fourth temporary display unit, in accordance with some embodiments.
Figure 27:
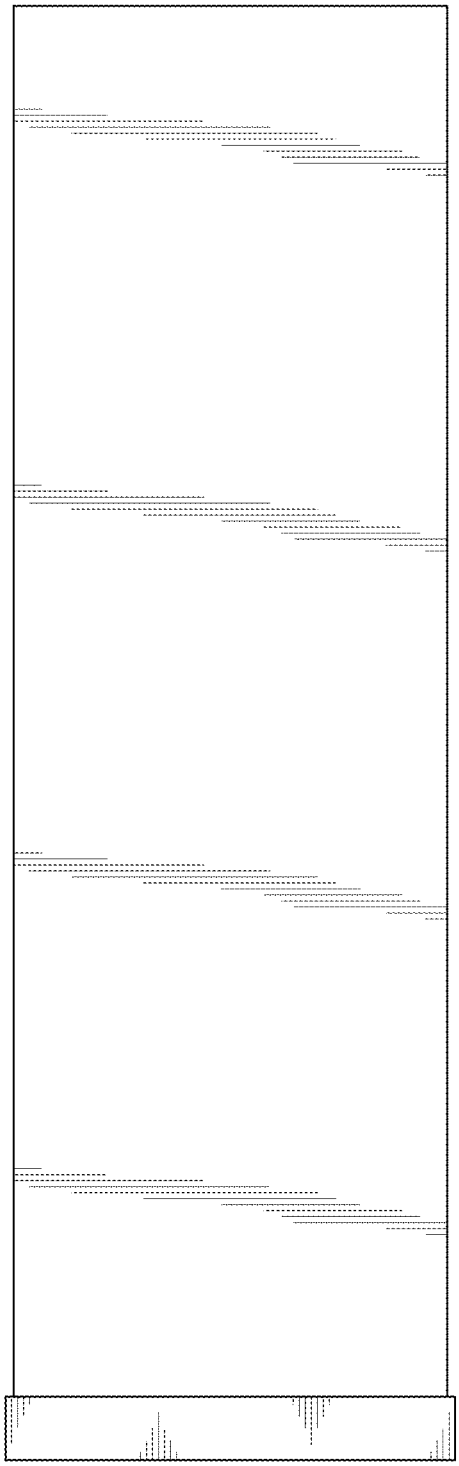
FIG. 27 is a first side view.
Figure 28:
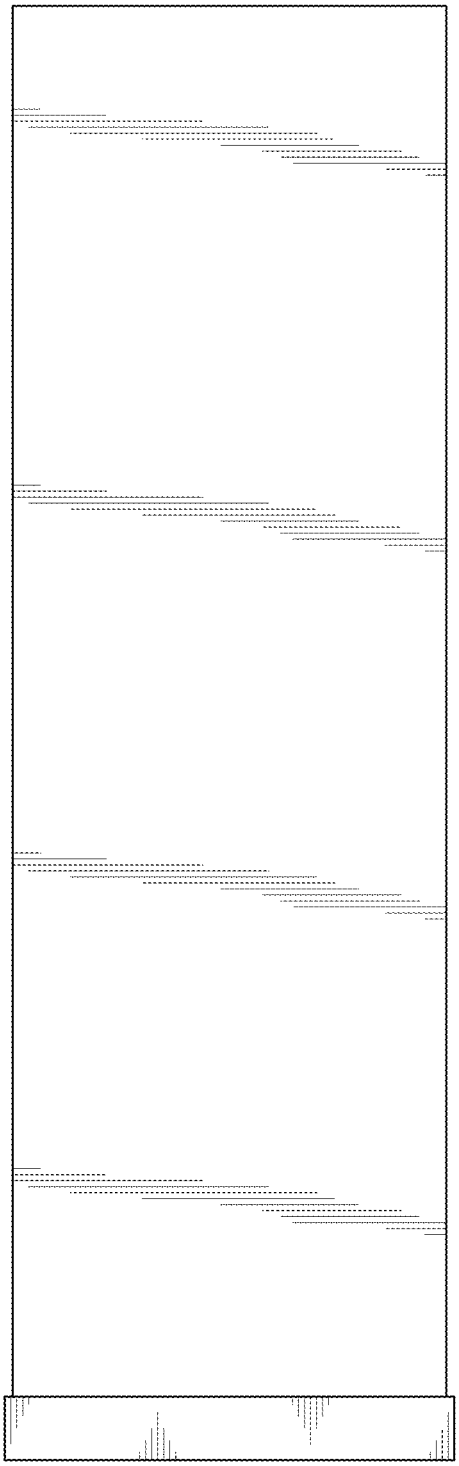
FIG. 28 is a second side view of the fourth temporary display unit, in accordance with some embodiments.
Figure 70:
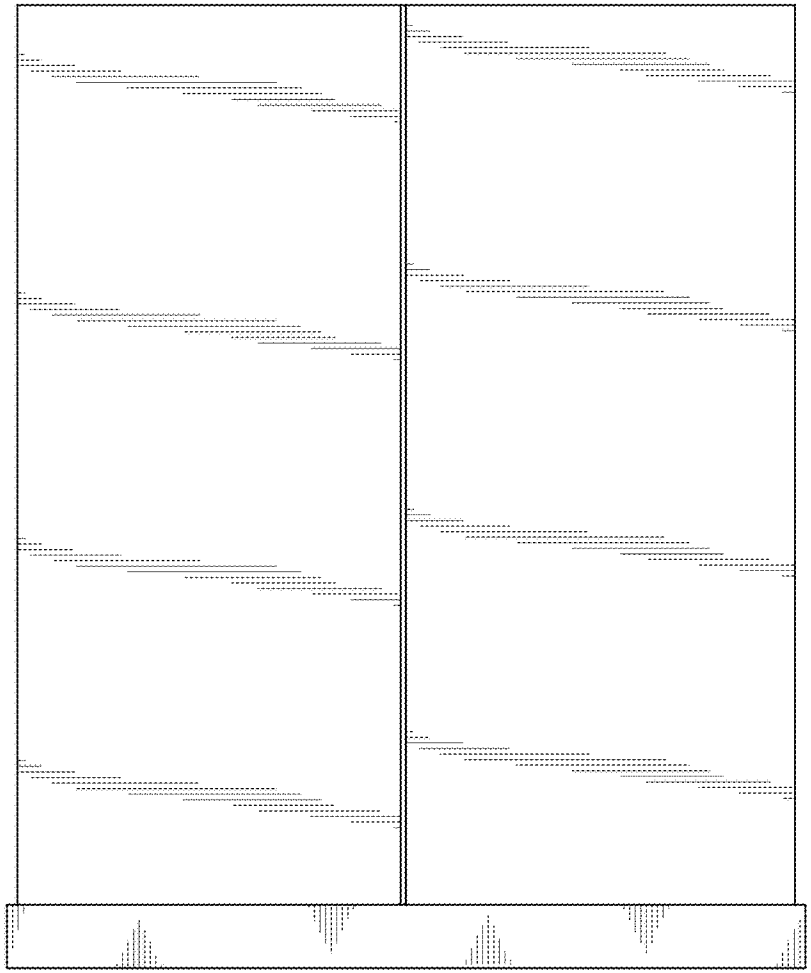
FIG. 70 is a second side view of the tenth temporary display unit, in accordance with some embodiments.
Figure 69:
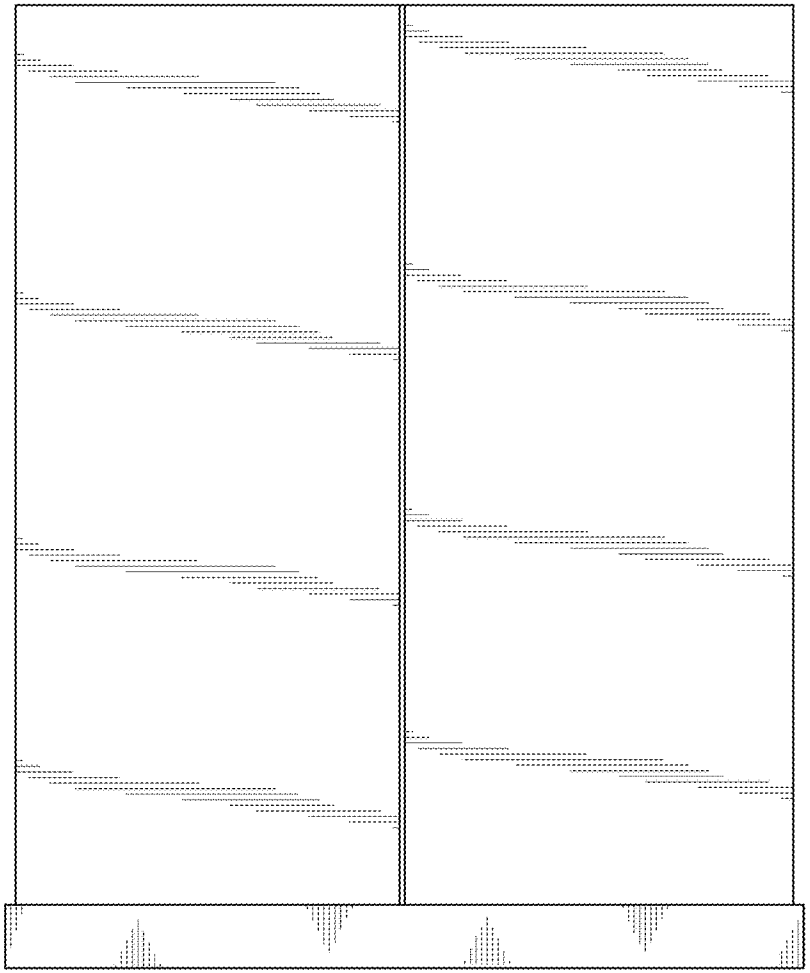
FIG. 69 is a first side view.

In some embodiments, each predefined section of the first single sheet of material is predefined because each predefined section is defined prior to assembly of the display unit, and includes perforated markings and/or creases to identify how the predefined section should be split, sectioned and folded to produce a respective built-in vertical support. As illustrated in FIGS. 7A and 7B, each built-in vertical support, for example each support of the first set of built-in vertical supports 110A is thus formed by splitting each predetermined section of the first single sheet of material at the respective perforated marking line or crease line and folding the section of the material outwards towards a respective corner of the display unit 100, in the shape of a rectangular column with a hollow interior extending upwards to an open top surface 112 of each built-in vertical support 110A. As illustrated, the built-in vertical supports 110 each have a rectangular shape, but the various embodiments described herein are not limited thereto. In other embodiments, the built-in vertical supports 110 may have a square, a triangular, a circular, oval, hexagonal, or any other suitable or desirable shape. Furthermore, as illustrated, the frame 130 is provided in a rectangular shape, but the various embodiments described herein are not limited thereto (and numerous other configurations are illustrated and described in reference to the second through tenth temporary display units shown in FIGS. 8-70, and in appendices A-J).

In some embodiments, a first portion 162 of a respective built-in, hollow vertical support of the plurality of built-in, hollow vertical supports is adhesively connected to a second portion 164 of the respective built-in, hollow vertical support. This configuration lends increased reinforcement, stability and rigidity to each of the built-in, hollow supports as a result of being adhered to the plurality of vertical panels forming an outer frame of the display unit, an requires only an adhesive to form a respective built-in, hollow vertical support and no additional materials to reinforce the respective vertical support.

In some embodiments, as illustrated in FIG. 7B, a window through which displayed items placed on a respective shelf of the one or more shelves 120 are viewed (e.g., FIG. 7B shows construction of a window at a first level of the first temporary display rack after folding and FIG. 7C shows that after folding together all of the built-in, hollow vertical supports, then windows are provided at four different levels to provide easy visibility to products stocked on the first temporary display unit).

In some embodiments, as described above, each of the one or more shelves 120 comprises a cardboard material having a honeycomb-shaped cross-section as illustrated in FIG. 7A. In these embodiments, at least a portion of the plurality of vertical panels 140A-140D bordering each window is configured to conceal the honeycomb-shaped cross-sections of the one or more shelves. The aforementioned configuration provides the advantage that the exterior surfaces of the display unit 100 which are visible to consumers are aesthetically pleasing as the hexagonal structure of the honeycomb-shaped cross-section of each of the selves is concealed behind respective portions of the vertical panels 140A-140D.

As described above, the first set of built-in, hollow vertical supports 110A are configured to support a first shelf of the one or more shelves 120 disposed in the frame 130. As illustrated, the first shelf is supported at each of its respective corners by an open top surface 112 of each built-in vertical support 110A. The aforementioned configuration eliminates the need for additional assembly of separate, conventional support posts or columns. The aforementioned configuration further provides the advantage of reduction of assembly parts, thus reducing material and labor costs by integrally forming the built-in, hollow vertical supports 110 from the same sheet of material as the frame 130 (i.e. body or chassis). Additionally, the display unit having the built-in, hollow vertical supports 110 with the aforementioned configuration is capable of supporting a significant weight as compared to the conventional display units. For example, in some embodiments, the first set of built-in, hollow vertical supports 110A are capable of supporting at least 100 pounds of weight placed on the first shelf.

Figure 7D:
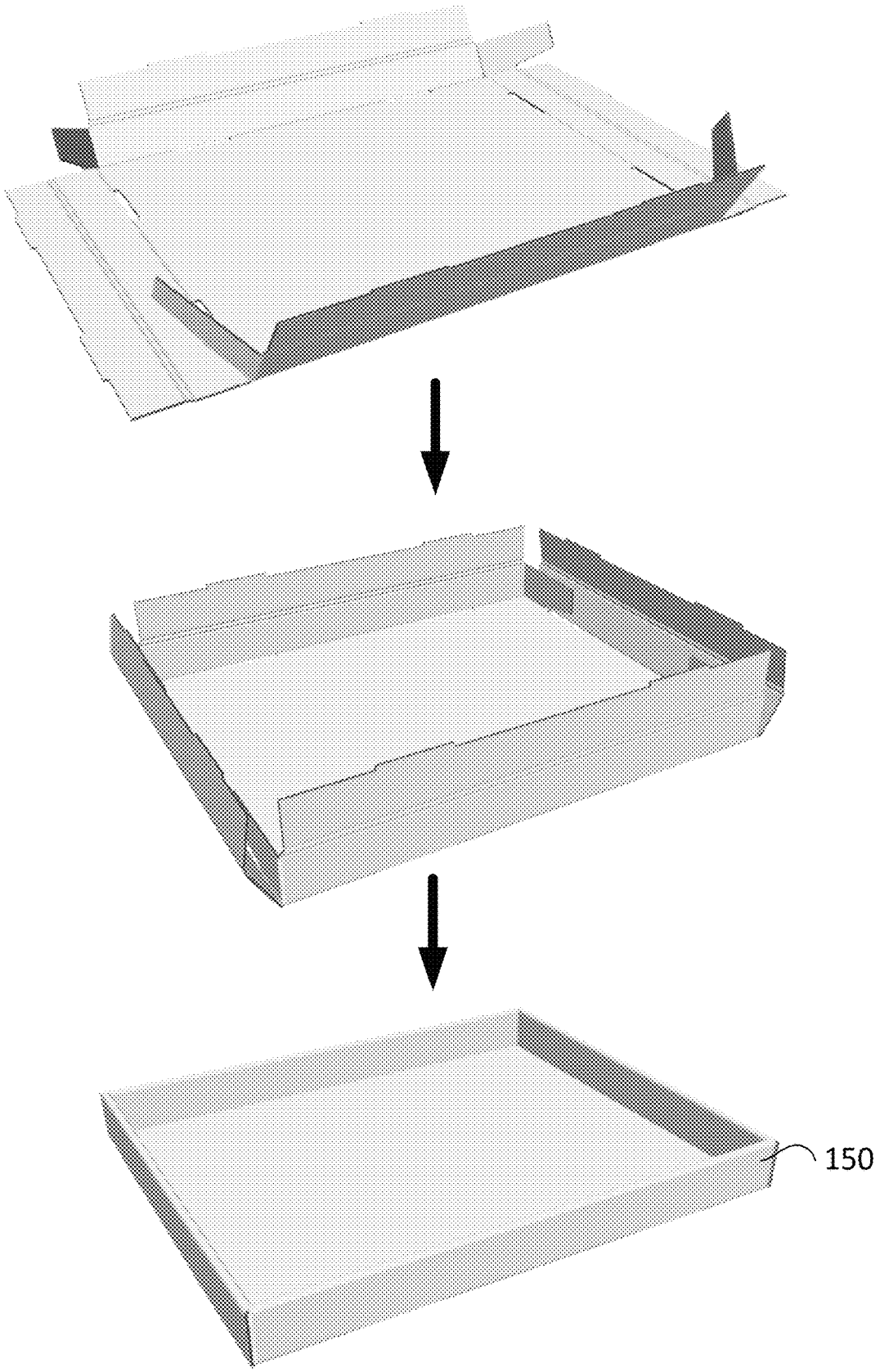
FIG. 7D is an illustration of a method of assembling a base of the temporary display unit, in accordance with some embodiments.

FIG. 7D is an illustration of a method of assembling a base of the temporary display unit 100, in accordance with some embodiments. In some embodiments, the display unit 100 may further include the base 150 formed from a second single sheet of material, separate and distinct from the first single sheet of material, with an open top. As illustrated in FIG. 1, the frame 130 is disposed at least partially in the base 150, and the base 150 is configured to support the frame 130 when assembled. In some embodiments, the base 150 may include wheels (not shown) for easy transportation of the display unit. In some embodiments, as illustrated in FIG. 7D, the base 150 includes one or more tabs 152 on outer perimeters of lateral edges of the second single sheet of material. The tab(s) 152 are sized to substantially fill a corresponding receiving slot 154 in the base 150 when the second single sheet of material is folded in at predetermined positions to form the base 150. In some embodiments, as illustrated in FIG. 1, a shelf of the one or more shelves 120 is disposed in the base 150.

In some embodiments, with reference now to FIG. 1, the display unit 100 further includes at least a second set of built-in, hollow vertical supports 110B of the plurality of built-in, hollow vertical supports 110, disposed above the first set of built-in, hollow vertical supports 110A. The configuration of the second set of built-in, hollow vertical supports 110B is the same in structure as that of the first set of built-in, hollow vertical supports 110A, therefore the description of the first set of built-in, hollow vertical supports 110A applies to both the first and second sets of built-in, hollow vertical supports 110A and 110B. In some embodiments, the display unit 100 further includes at least a third shelf 120C disposed within the frame 130, disposed on and supported by the second set of built-in, hollow vertical supports. The configuration of third shelf 120C is the same in structure as that of the first shelf 120B, therefore the description of the first shelf 120B and the manner in which the first shelf 120B is supported by the first set of built-in, hollow vertical supports 110A applies correspondingly to the third shelf 120C and the manner in which the third shelf 120C is in turn supported by the second set of built-in, hollow vertical supports 110B.

Figure 7E:
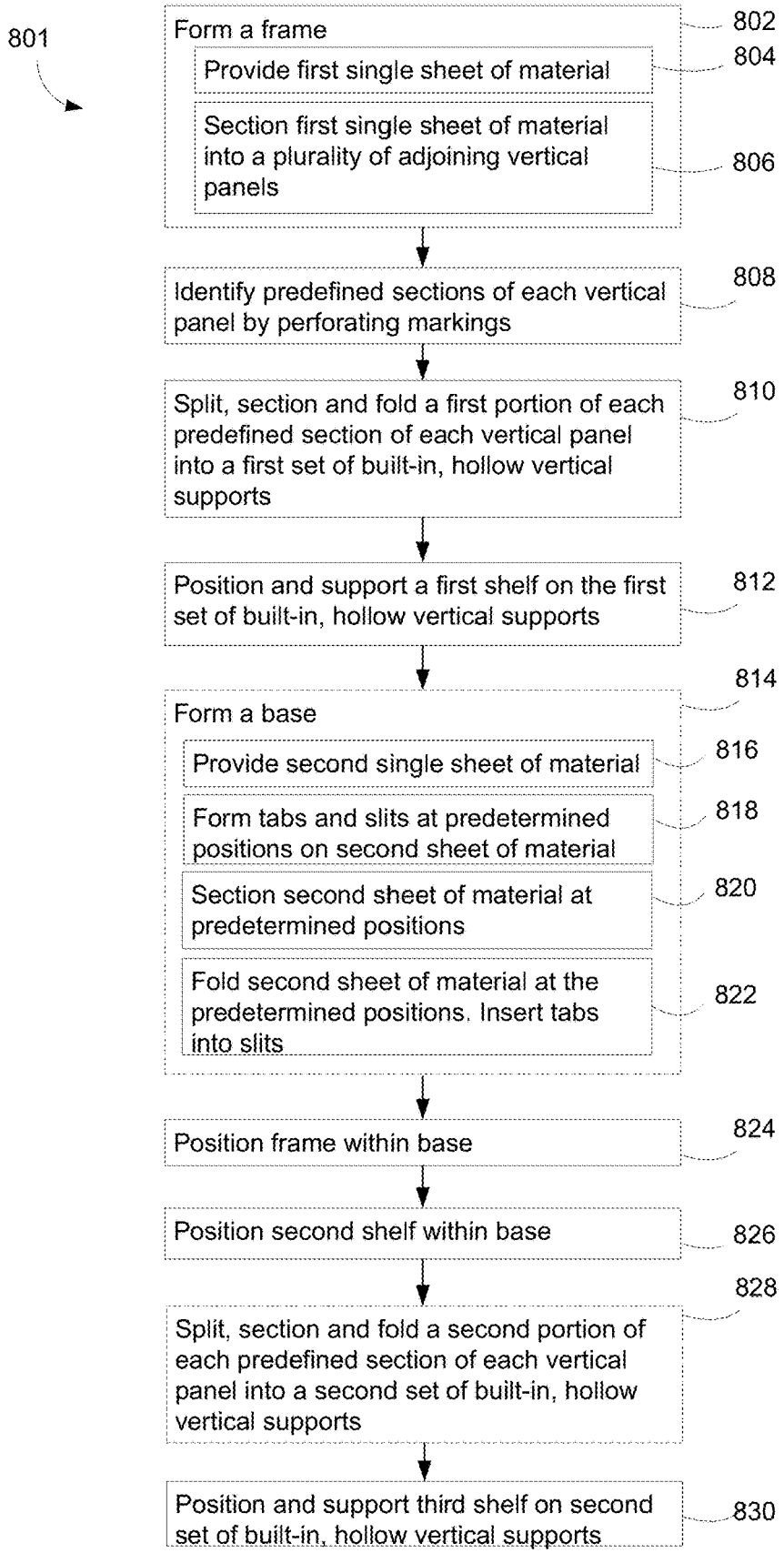
FIG. 7E is a flowchart representing the method of assembling the example foldable frame into the first temporary display unit, in accordance with some embodiments.

FIG. 7E is a flowchart representing an example method 801 of assembling the example foldable frame into the temporary display unit illustrated in FIG. 1, in accordance with some embodiments.

First, a frame is formed (802). In some embodiments, the frame is formed from a first single sheet of material (804), as discussed above. In some embodiments the frame is formed by sectioning the first single sheet of material at predetermined positions into a plurality of adjoining vertical panels (806). In some embodiments, the method further includes identifying predefined sections of each of the plurality of adjoining vertical panels by perforated markings on each of the vertical panels indicating where each of the vertical panels is to be split, sectioned, and folded (808). The vertical panels may each include perforated markings based on pre-determined dimensions conforming to a desired size of each built-in, hollow vertical support to be formed.

In some embodiments, the method further includes splitting, sectioning and folding at least a first portion of each of the plurality of adjoining vertical panels of the frame into a first set of built-in, hollow vertical supports (810). In some embodiments, each predetermined section of the first single sheet of material is split at a respective perforated marking line or crease line and folded towards a respective corner of the display unit in the shape of a column with a hollow interior extending upwards to an open top surface of each built-in vertical support. In some embodiments, the method further includes positioning a first shelf of the one or more shelves within the frame, where the first shelf is disposed on and supported by each built-in, hollow vertical support of the first set of built-in, hollow vertical supports (812).

At step 814, a based is formed, as described above with respect to FIG. 7D. In some embodiments, the step 814 may be performed before step 802. In some embodiments, forming the base at step 814 includes: (i) providing a second single sheet of material (816), (ii) forming tabs and slits at predetermined positions on the second sheet of material based on perforated markings in the second single sheet of material (818), (iii) sectioning the second single sheet of material at the predetermined positions (820), and (iv) folding the second sheet of material at the predetermined.

At step 824, the frame (formed at steps 802-812 to include the plurality of built-in, hollow vertical supports) is positioned and/or inserted within the base. In some embodiments, additional sets of built-in, hollow vertical supports are each formed and respective shelves are placed on each of those sets of built-in, hollow vertical supports (steps 828-830). In some embodiments, all sets of built-in, hollow vertical supports may be formed before positioning the frame within the base, while in other embodiments, at least some of the sets of built-in, hollow vertical supports are formed after positioning the frame within the base.

Additional details regarding the first temporary display unit are also provided in Appendix A.

FIGS. 8-14 illustrate a second temporary display unit 200, in accordance with some embodiments. As with the first temporary display unit, the second temporary display unit includes a plurality of hollow, built-in vertical supports 210 that are formed out of the same single sheet of material used to construct the frame (e.g., a respective set of hollow, built-in vertical supports at each level/section A, B, C of the display unit) and are able to support substantial merchandise weight placed on shelves that are resting on respective built-in vertical supports 210 at each level of the second temporary display unit.

Additional details regarding the second temporary display unit are also provided in Appendix B (of the incorporated-by-reference U.S. Provisional Application No. 62/437,025).

FIGS. 15-21 illustrate a third temporary display unit 300, in accordance with some embodiments. As with the first and second temporary display units, the third temporary display unit includes a plurality of hollow, built-in vertical supports 310 that are formed out of the same single sheet of material used to construct the frame (e.g., a respective set of hollow, built-in vertical supports at each level/section A, B, C of the display unit) and are able to support substantial merchandise weight placed on shelves that are resting on respective built-in vertical supports 310 at each level of the second temporary display unit.

Additional details regarding the third temporary display unit are also provided in Appendix C (of the incorporated-by-reference U.S. Provisional Application No. 62/437,025).

FIGS. 22-28 illustrate a fourth temporary display unit 400, in accordance with some embodiments. As with the first through third temporary display units, the fourth temporary display unit includes a plurality of hollow, built-in vertical supports 410 that are formed out of the same single sheet of material used to construct the frame (e.g., a respective set of hollow, built-in vertical supports at each level/section A, B, C of the display unit) and are able to support substantial merchandise weight placed on shelves that are resting on respective built-in vertical supports 410 at each level of the fourth temporary display unit.

Additional details regarding the fourth temporary display unit are also provided in Appendix D (filed herewith and also included in the incorporated-by-reference U.S. Provisional Application No. 62/437,025).

FIGS. 29-35 illustrate a fifth temporary display unit 500, in accordance with some embodiments. As with the first through fourth temporary display units, the fifth temporary display unit includes a plurality of hollow, built-in vertical supports 510 that are formed out of the same single sheet of material used to construct the frame (e.g., a respective set of hollow, built-in vertical supports at each level/section A, B, C of the display unit) and are able to support substantial merchandise weight placed on shelves that are resting on respective built-in vertical supports 510 at each level of the fifth temporary display unit.

Additional details regarding the fifth temporary display unit are also provided in Appendix E (of the incorporated-by-reference U.S. Provisional Application No. 62/437,025).

FIGS. 36-42 illustrate a sixth temporary display unit 600, in accordance with some embodiments. As with the first through fifth temporary display units, the sixth temporary display unit includes a plurality of hollow, built-in vertical supports 610 that are formed out of the same single sheet of material used to construct the frame (e.g., a respective set of hollow, built-in vertical supports at each level/section A, B, C of the display unit) and are able to support substantial merchandise weight placed on shelves that are resting on respective built-in vertical supports 610 at each level of the sixth temporary display unit.

Additional details regarding the sixth temporary display unit are also provided in Appendix F (filed herewith and also included in the incorporated-by-reference U.S. Provisional Application No. 62/437,025).

FIGS. 43-49 illustrate a seventh temporary display unit 700, in accordance with some embodiments. As with the first through sixth temporary display units, the seventh temporary display unit includes a plurality of hollow, built-in vertical supports 710 that are formed out of the same single sheet of material used to construct the frame (e.g., a respective set of hollow, built-in vertical supports at each level/section A, B, C, D, E of the display unit) and are able to support substantial merchandise weight placed on shelves that are resting on respective built-in vertical supports 710 at each level of the seventh temporary display unit.

Additional details regarding the seventh temporary display unit are also provided in Appendix G (of the incorporated-by-reference U.S. Provisional Application No. 62/437,025).

FIGS. 50-56 illustrate an eighth temporary display unit 800, in accordance with some embodiments. As with the first through seventh temporary display units, the eighth temporary display unit includes a plurality of hollow, built-in vertical supports 810 that are formed out of the same single sheet of material used to construct the frame (e.g., a respective set of hollow, built-in vertical supports at each level/section A, B, C of the display unit) and are able to support substantial merchandise weight placed on shelves that are resting on respective built-in vertical supports 810 at each level of the eighth temporary display unit.

Although the eighth temporary display unit 800 is shown with some windows of different sizes (i.e., space between each of the shelves that allows consumers to view products stocked on each shelf), in some embodiments, the windows are each of substantially the same size and in these embodiments the space between each respective shelf is substantially the same.

Additional details regarding the eighth temporary display unit are also provided in Appendix H (of the incorporated-by-reference U.S. Provisional Application No. 62/437,025).

FIGS. 57-63 illustrate a ninth temporary display unit 900, in accordance with some embodiments. As with the first through eighth temporary display units, the ninth temporary display unit includes a plurality of hollow, built-in vertical supports 910 that are formed out of the same single sheet of material used to construct the frame (e.g., a respective set of hollow, built-in vertical supports at each level/section A, B, C of the display unit) and are able to support substantial merchandise weight placed on shelves that are resting on respective built-in vertical supports 910 at each level of the ninth temporary display unit.

Additional details regarding the ninth temporary display unit are also provided in Appendix I (filed herewith and also included in the incorporated-by-reference U.S. Provisional Application No. 62/437,025).

FIGS. 64-70 illustrate a tenth temporary display unit 1000, in accordance with some embodiments. As with the first through ninth temporary display units, the tenth temporary display unit includes a plurality of hollow, built-in vertical supports 1010 that are formed out of the same single sheet of material used to construct the frame (e.g., a respective set of hollow, built-in vertical supports at each level/section A, B, C of the display unit) and are able to support substantial merchandise weight placed on shelves that are resting on respective built-in vertical supports 1010 at each level of the tenth temporary display unit.

Additional details regarding the tenth temporary display unit are also provided in Appendix J (of the incorporated-by-reference U.S. Provisional Application No. 62/437,025).

Figure 71A:
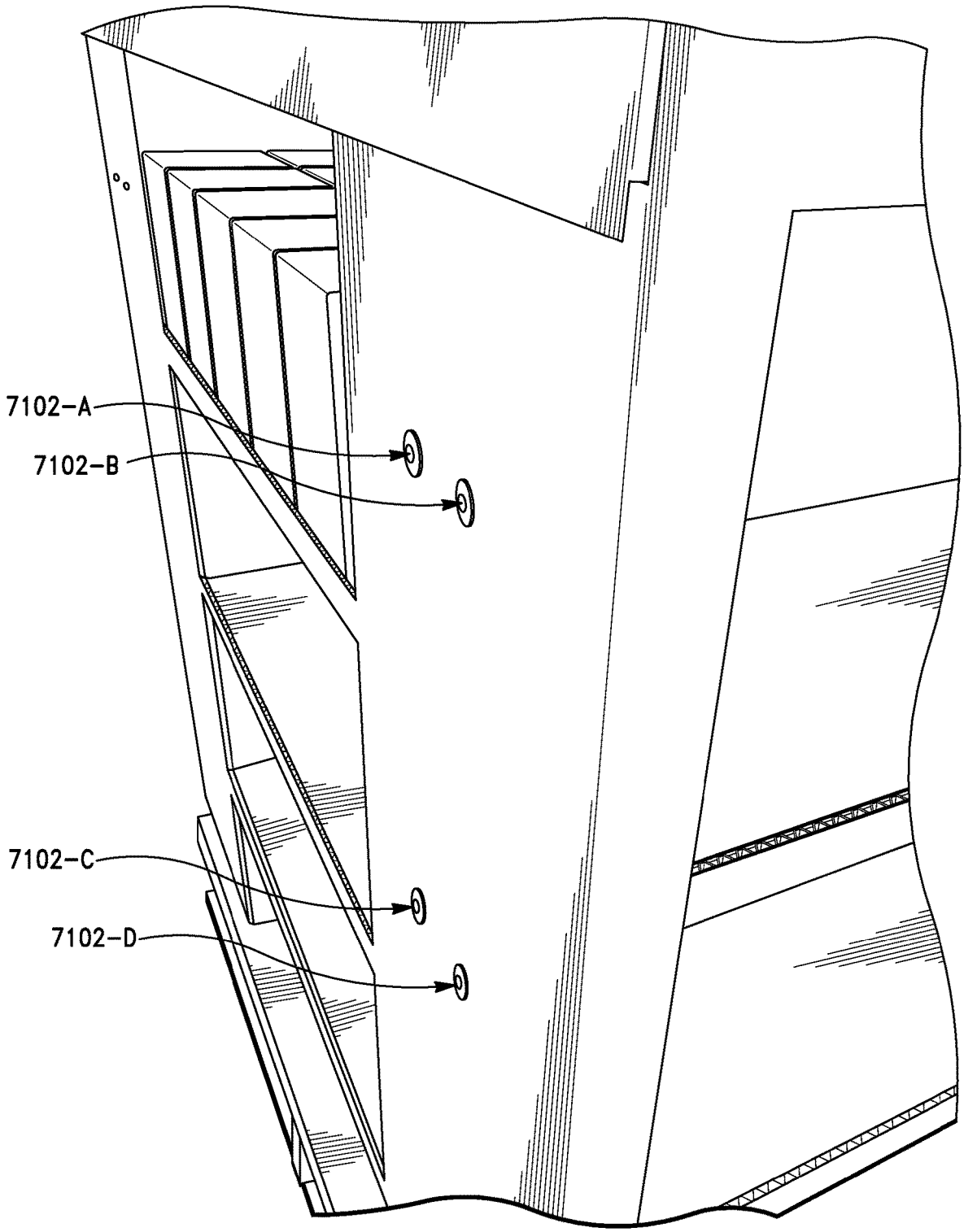
FIGS. 71A and 71B illustrate an example attachment mechanism which is used in some embodiments to secure a portion of a respective display unit together.
Figure 71B:
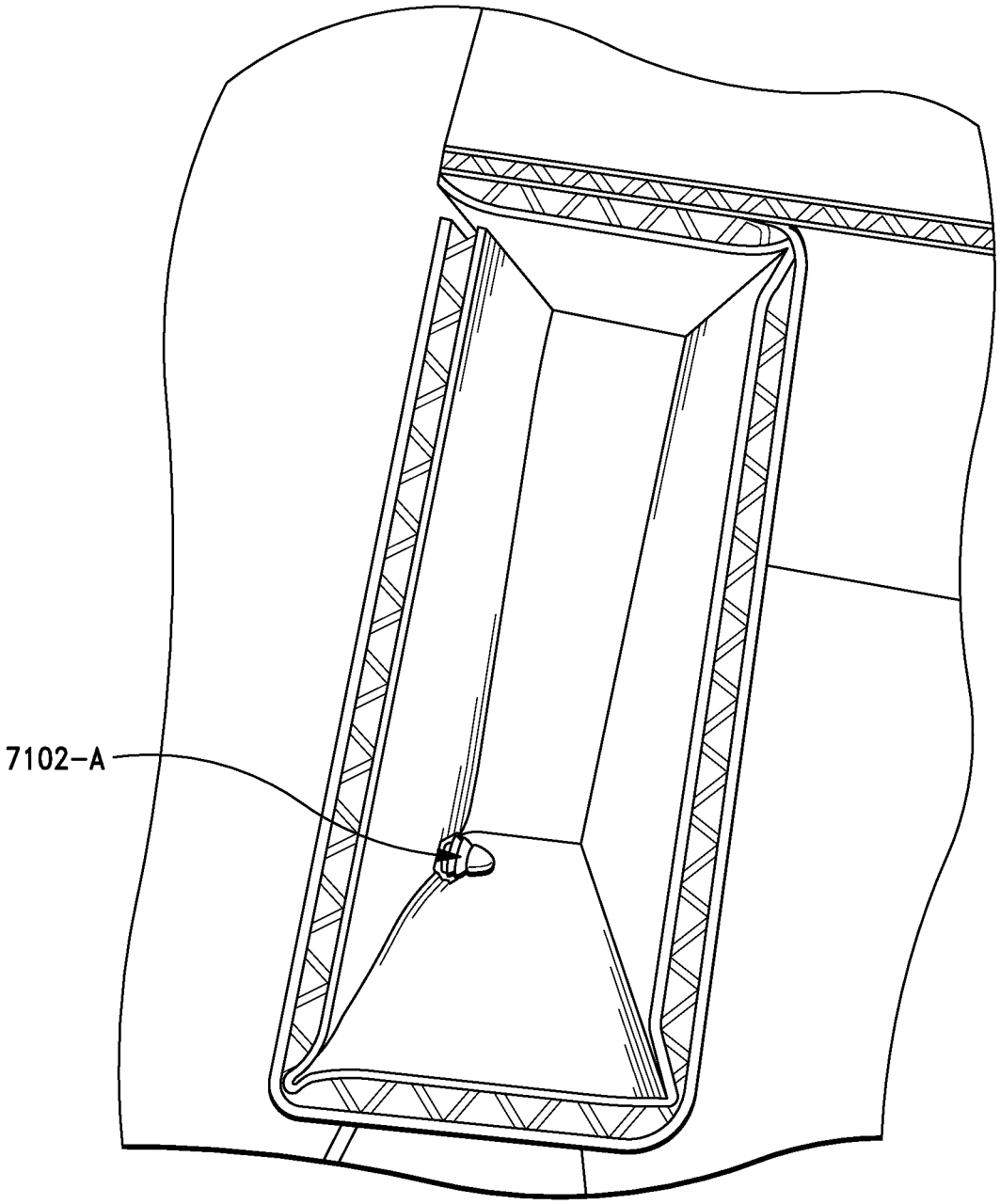

FIGS. 71A and 71B illustrate an example attachment mechanism (e.g., 7102-A through 7102-D, FIGS. 71A and 7B) which is used in some embodiments to secure a portion of a respective display unit together. In some embodiments and as a non-limiting example, the example attachment mechanism is a Christmas tree clip available from manufacturers such as FFR merchandising (e.g., part number 8502477408). In some embodiments, the example attachment mechanism is pushed through an exterior surface of a respective temporary display unit and goes through at least a portion of a respective built-in, hollow vertical support, thereby securing the respective built-in, hollow vertical support in place.

In some embodiments, an adhesive is also used to secure the respective built-in, hollow vertical support in place and the example attachment mechanism is used in addition to the adhesive. In other embodiments, either the adhesive or the example attachment mechanism is utilized.

The above description, for explanatory purposes, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. Various modifications may be made in the embodiments described above without departing from the scope and spirit of this invention. Thus, as an example, the various example temporary display units described herein may be generally of any size, shape, or style capable of displaying product in a retail environment and the built-in, hollow vertical supports may also generally be of any size or shape capable of supporting respective shelves.

What is claimed is:

1. A display unit having a plurality of built-in, hollow vertical supports for supporting one or more shelves, the display unit comprising:

a frame comprising a first single sheet of material the first single sheet of material including:

(i) a first portion of the first single sheet of material that has a plurality of vertical panels; and (ii) a remainder of the first single sheet of material that is folded into at least a first set of built-in, hollow vertical supports of the plurality of built-in, hollow vertical supports, wherein each built-in, hollow vertical support contacts one or more of the plurality of vertical panels; and a first shelf of the one or more shelves disposed within the frame and rests upon a top edge of each built-in, hollow vertical support of the first set of built-in, hollow vertical supports.

2. The display unit of claim 1, further comprising:

a base comprising a second single sheet of material, separate and distinct from the first single sheet of material, with an open top, wherein:

the frame is disposed at least partially in the base, and a second shelf of the one or more shelves is disposed in the base.

3. The display unit of claim 2, further comprising:

at least a second set of built-in, hollow vertical supports of the plurality of built-in, hollow vertical supports, disposed above the first set of built-in, hollow vertical supports; and at least a third shelf disposed within the frame, disposed on and rests upon top edges of the second set of built-in, hollow vertical supports.

4. The display unit of claim 1, wherein a first side edge of a respective built-in, hollow vertical support of the plurality of built-in, hollow vertical supports is adhesively connected to a second side edge of the respective built-in, hollow vertical support.

5. The display unit of claim 1, wherein the first single sheet of material comprises a cardboard material having a thickness of less than 14 of an inch.

6. The display unit of claim 5, wherein each of the one or more shelves comprises a cardboard material having a honeycomb-shaped cross-section distinct in shape to that of the single sheet of material.

7. The display unit of claim 5, wherein each of the one or more shelves comprises a cardboard material having a honeycomb-shaped cross-section similar in shape to that of the single sheet of material.

8. The display unit of claim 1, wherein the first set of built-in, hollow vertical supports is configured to support at least 100 pounds of weight placed on the first shelf.

9. The display unit of claim 6, wherein the honeycomb-shaped cross-section is concealed by portions of each of the plurality of vertical panels.

10. The display unit of claim 1, wherein each of the plurality of built-in, hollow vertical supports is formed from a respective predefined section of a respective vertical panel of the plurality of vertical panels.

11. The display unit of claim 10, wherein a window, through which displayed items placed on a respective shelf of the one or more shelves are viewed, is defined between the first set of built in, hollow vertical supports.

12. The display unit of claim 11, wherein:

each of the one or more shelves comprises a cardboard material having a honeycombshaped cross-section; and at least a portion of the first single sheet of material bordering the window is configured to conceal the honeycomb-shaped cross-sections of the first shelf.

13. The display unit of claim 10, wherein each of the respective predefined sections of the respective vertical panels of the plurality of panels of the first single sheet of material comprises a section of the first single sheet of material including perforated markings identifying where the first single sheet of material is split, sectioned, and folded to form the respective built-in, hollow vertical supports.

14. A method of manufacturing a display unit having a plurality of built-in, hollow vertical supports for supporting one or more shelves, the method comprising the steps of:

forming a frame, by sectioning a first single sheet of material at predetermined positions into a plurality of adjoining vertical panels;

identifying predefined sections of each of the plurality of adjoining vertical panels by perforating markings on each of the vertical panels indicating where the each of the vertical panels is to be split, sectioned, and folded;

splitting, sectioning and folding at least a first portion of each of the plurality of adjoining vertical panels of the frame into a first set of built-in, hollow vertical supports, wherein each built-in, hollow vertical support of the first set of built-in, hollow supports contacts one or more corresponding vertical panels from the plurality of vertical panels; and positioning a first shelf of the one or more shelves within the frame, the first shelf disposed on and rests upon a top edge of supported by each built-in, hollow vertical support of the first set of built-in, hollow vertical supports.

15. The method of claim 14, further comprising the steps of: forming a base by:

providing a second single sheet of material, separate and distinct from the first single sheet of material;

forming a plurality of tabs and slits on the second sheet of material;

sectioning the second sheet of material at predetermined positions corresponding to the plurality of vertical panels; and folding the second sheet of material at the predetermined positions corresponding to the sectioning, and inserting the tabs into the slits;

positioning the frame at least partially within the base; and positioning a second shelf within the base at a bottom portion of the frame.

16. The method of claim 15, further comprising the steps of:

splitting, sectioning and folding at least a second portion of each of the plurality of adjoining vertical panels of the frame into a second set of built-in, hollow vertical supports positioned above the first set of built-in, hollow vertical supports, wherein each built-in, hollow vertical support of the second set of built-in, hollow supports contacts one or more of the corresponding vertical panels from the plurality of vertical panels; and positioning a third shelf of the one or more shelves within the frame, the third shelf disposed on and rests upon a top edge of supported by each built-in, hollow vertical support of the second set of built-in, hollow vertical supports.

17. The method of claim 14, wherein the first single sheet of material comprises a cardboard material having a thickness of less than !4 of an inch.

18. The method of claim 14, wherein each of the one or more shelves comprises a cardboard material having a honeycomb-shaped cross-section different in shape to that of the single sheet of material.

19. The method of claim 14, wherein each of the one or more shelves comprises a cardboard material having a honeycomb-shaped cross-section similar in shape to that of the single sheet of material.

20. The method of claim 15, wherein the first set of built-in, hollow vertical supports is configured to support at least 100 pounds of weight placed on the first shelf.

21. The method of claim 14, wherein a window, through which displayed items placed on the first shelf are viewed, is defined between the first set of built in, hollow vertical supports.

* * * * *